US009547264B2

(12) United States Patent
Kurata et al.

(10) Patent No.: US 9,547,264 B2
(45) Date of Patent: Jan. 17, 2017

(54) IMAGE HEATING APPARATUS HAVING A CONTROLLER FOR GENERATING MAGNETIC FLUX IN A COIL TO GENERATE HEAT

(71) Applicant: CANON KABUSHIKI KAISHA, Tokyo (JP)

(72) Inventors: Munehito Kurata, Boise, ID (US); Aoji Isono, Naka-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/887,794

(22) Filed: Oct. 20, 2015

(65) Prior Publication Data

US 2016/0109835 A1 Apr. 21, 2016

(30) Foreign Application Priority Data

Oct. 21, 2014 (JP) ..... 2014-214504

(51) Int. Cl.
*G03G 15/20* (2006.01)

(52) U.S. Cl.
CPC ..... *G03G 15/2053* (2013.01); *G03G 15/2042* (2013.01); *G03G 15/2046* (2013.01); *G03G 2215/2035* (2013.01)

(58) Field of Classification Search
CPC ..... G03G 15/2053
USPC ..... 399/67, 328; 219/216
See application file for complete search history.

(56) References Cited

U.S. PATENT DOCUMENTS 8,331,819 B2 12/2012 Fukuzawa et al.
8,725,020 B2 5/2014 Fukuzawa et al.
8,744,296 B2 6/2014 Fukuzawa et al.
8,918,001 B2 12/2014 Kurata et al.
9,091,974 B2 7/2015 Yoshioka et al.
2006/0237445 A1* 10/2006 Nagahira ..... G03G 15/2042 219/619

(Continued)

FOREIGN PATENT DOCUMENTS

JP S51-120451 A 10/1976
JP 2000-223253 A 8/2000

(Continued)

OTHER PUBLICATIONS

Computer translation of JP2004-163896A to Yamamoto, Jun. 2004.*
U.S. Appl. No. 14/802,159, filed Jul. 17, 2015.
U.S. Appl. No. 14/804,548, filed Jul. 21, 2015.

*Primary Examiner* — Quana M Grainger
(74) *Attorney, Agent, or Firm* — Fitzpatrick, Cella, Harper & Scinto

(57) ABSTRACT

An image heating apparatus for heating an image includes a cylindrical rotatable member including an electroconductive layer; a helical coil provided in the rotatable member, the coil having a helix axis extending along a generatrix direction of the rotatable member; a magnetic core provided in the coil and having an end portion; and a controller configured to control a frequency of an AC current supplied to the coil; wherein the image is heated by heat of the rotatable member heated by electromagnetic induction heat generation of the electroconductive layer, wherein the controller sets the frequency to a first frequency corresponding to a size of a recording material, and wherein the controller sets the frequency to a second frequency higher than the first frequency when a print ratio of the image is larger than a predetermined value.

14 Claims, 26 Drawing Sheets

(56) References Cited

U.S. PATENT DOCUMENTS

| | | | |
|---|---|---|---|
| 2013/0045021 | A1 | 2/2013 | Yoshioka et al. |
| 2015/0268602 | A1 | 9/2015 | Yoshioka et al. |

FOREIGN PATENT DOCUMENTS

| | | | | |
|---|---|---|---|---|
| JP | 2002-260836 | A | | 9/2002 |
| JP | 2004-157503 | A | | 6/2004 |
| JP | 2004163896 | A | * | 6/2004 |
| JP | 2008268784 | A | * | 11/2008 |
| JP | 2013-41118 | A | | 2/2013 |

* cited by examiner (a)

(b)

(a)

(b)

(a)

(b)

(a)

(b)

(a) SECTION OF AREA 1

(b) SECTION OF AREA 2

(a)

(b)

$$|X| = \frac{1}{\sqrt{\left(\frac{1}{R'}\right)^2 + \left(\frac{1}{\omega M}\right)^2}}$$

(a)

(b)

(c)

$$|X_e| = \frac{1}{\sqrt{\left(\frac{1}{6^2R}\right)^2+\left(\frac{1}{\omega M_e}\right)^2}} \qquad |X_c| = \frac{1}{\sqrt{\left(\frac{1}{6^2R}\right)^2+\left(\frac{1}{\omega M_c}\right)^2}}$$

(a)

(b)

(a)

(b)

IMAGE HEATING APPARATUS HAVING A CONTROLLER FOR GENERATING MAGNETIC FLUX IN A COIL TO GENERATE HEAT

FIELD OF THE INVENTION AND RELATED ART

The present invention relates to an image heating device which uses a heating method based on electromagnetic induction.

As examples of image heating device, a fixing device for heating an unfixed toner image formed on a sheet of recording medium, to permanently or temporarily fix the unfixed toner to the sheet of recording medium, a heating device for reheating a fixed image on a sheet of recording medium, to increase the fixed image in gloss, can be listed.

Generally speaking, a fixing device, as an image heating device, which is installed in an image forming apparatus, such as an electrophotographic copying machine, an electrophotographic printer, and the like, has a rotational heating component, and a pressure roller which is kept pressed upon the rotational heating component. It heats a sheet of recording medium which is bearing an unfixed toner image while conveying the sheet through the nip formed between its rotational heating component and pressure roller, in order to fix the toner image to the sheet.

In recent years, fixing devices which use a heating method based on electromagnetic induction have been proposed. In the case of these fixing devices, heat is directly generated in the electrically conductive layer of their rotational heating component. Thus, they are meritorious in that they are short in the length of warm-up time, and low in electric power consumption.

There is disclosed in Japanese Laid-open Patent Application Sho51-120451, a fixing device which is equipped with a cylindrical component formed of an electrically conductive substance. The cylindrical component is placed in the passage of an alternating magnetic flux. Thus, heat is directly generated in the cylindrical component by the electric current induced in the cylindrical component and the electrical resistance of the cylindrical component. In other words, the cylindrical component itself functions as a heater. Therefore, this fixing device is meritorious in that it is simple in structure and high in thermal efficiency.

Also in recent years, it has been increasingly desired to reduce the rotational heating component of a fixing device in diameter, in order to reduce the fixing device in size, and to reduce the rotational heating component in thermal capacity. One of the methods for reducing the rotational heating component in diameter is to reduce in size the coil and core, which are placed within the hollow of the rotational heating component. Another method is to structure the fixing device so that the magnetic flux passage is not endless. In either case, a phenomenon that the magnetic core becomes saturated with magnetic flux has to be taken into consideration. As the core becomes saturated with magnetic flux, the coil suddenly reduces in inductance, allowing thereby a large amount of electric current to flow through the coil. Thus, it is possible that the electric power source will be damaged.

In order to prevent the core from becoming saturated with magnetic flux, a limit has to be set to the largest amount by which magnetic flux is allowed to be generated in the core. One of the methods for setting a limit to the amount by which magnetic flux is generated in the core is to control the amount by which electrical power is supplied to the coil.

That is, the top limit is set to the amount by which magnetic flux is generated in the core so that the core does not become saturated with magnetic flux in any situation. This, however, creates a problem. That is, as the amount by which electric power is supplied to the coil is restricted to limit the amount by which magnetic flux is generated in the core, it is possible that the fixing device will be supplied with an insufficient amount of electric power, which in turn will trigger the occurrence of image defects attributable to unsatisfactory fixation.

SUMMARY OF THE INVENTION

According to an aspect of the present invention, there is provided an image heating apparatus for heating an image, said image heating apparatus comprising a cylindrical rotatable member including an electroconductive layer; a helical coil provided in said rotatable member, said coil having a helix axis extending along a generatrix direction of said rotatable member; a magnetic core provided in said coil and having an end portion; and a controller configured to control a frequency of an AC current supplied to said coil; wherein the image is heated by heat of said rotatable member heated by electromagnetic induction heat generation of said electroconductive layer, wherein said controller sets the frequency to a first frequency corresponding to a size of a recording material, and wherein said controller sets the frequency to a second frequency higher than the first frequency when a print ratio of the image is larger than a predetermined value.

According to another aspect of the present invention, there is provided an image heating apparatus for heating an image, said image heating apparatus comprising a cylindrical rotatable member including an electroconductive layer; a helical coil provided in said rotatable member, said coil having a helix axis extending along a generatrix direction of said rotatable member; a magnetic core provided in said coil and having an end portion; and a controller configured to control a frequency of an AC current supplied to said coil; wherein the image is heated by heat of said rotatable member heated by electromagnetic induction heat generation of said electroconductive layer, and wherein said controller sets the frequency in accordance with a size of a recording material and a print ratio of the image.

Further features of the present invention will become apparent from the following description of exemplary embodiments with reference to the attached drawings.

Figure 2:
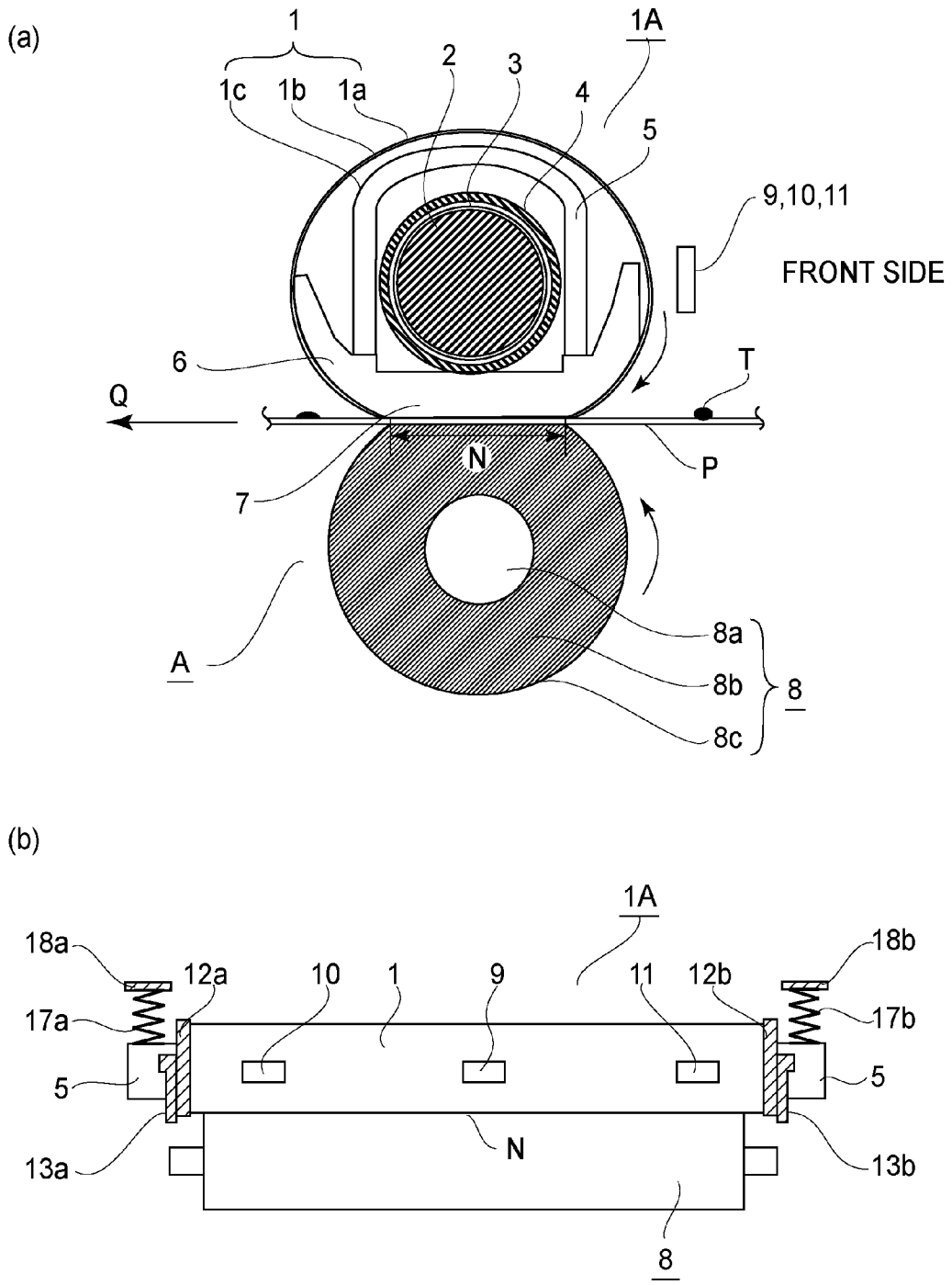

Part (a) of FIG. 2 is a schematic sectional view of the essential portion of the fixing device in the first embodiment, at a plane which is perpendicular to the lengthwise direction of the device.

part (b) of FIG. 2 is a schematic front view of the essential portion of the fixing device.

Figure 3:
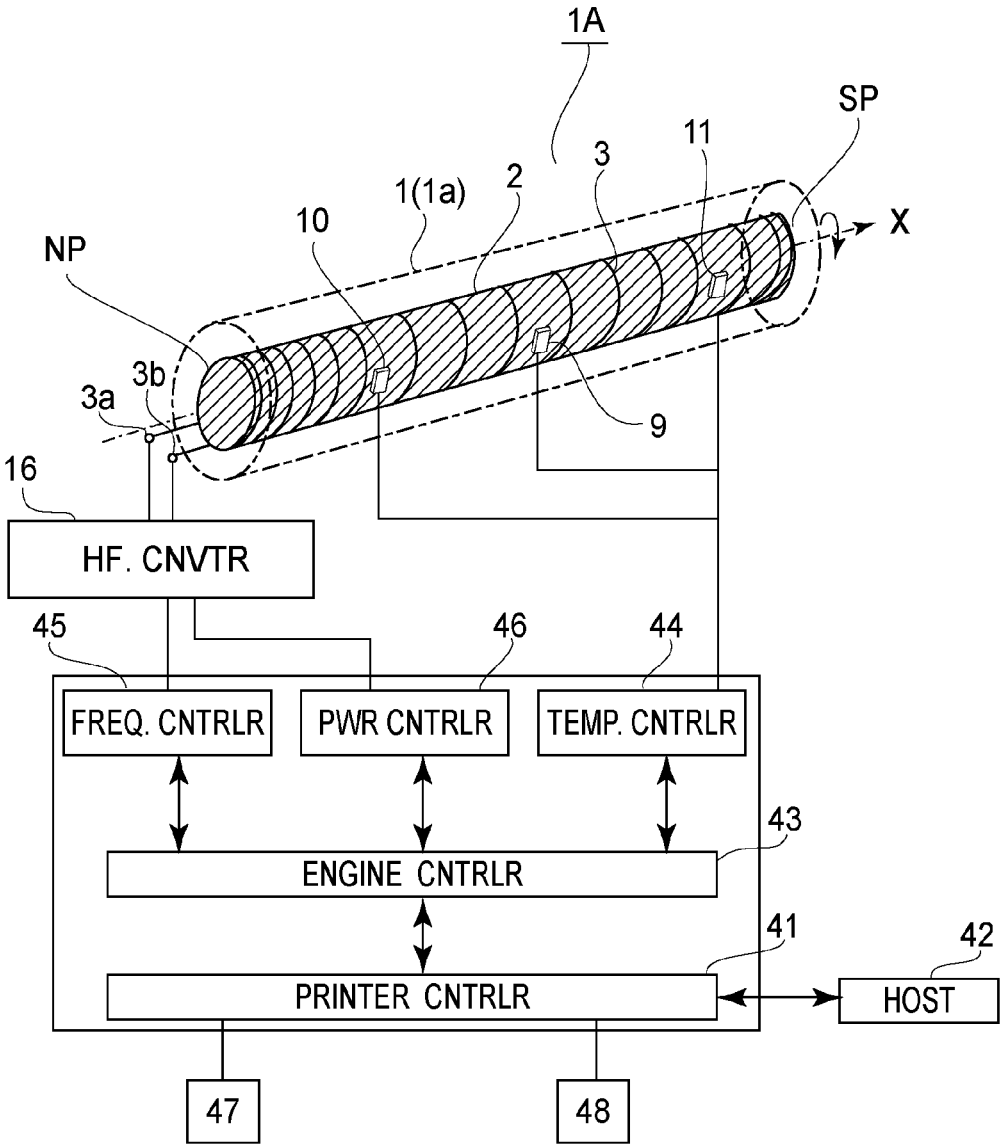

FIG. 3 is a combination of a schematic drawing of the heat generation unit of the fixing device, and a block diagram of the control system.

Figure 4:
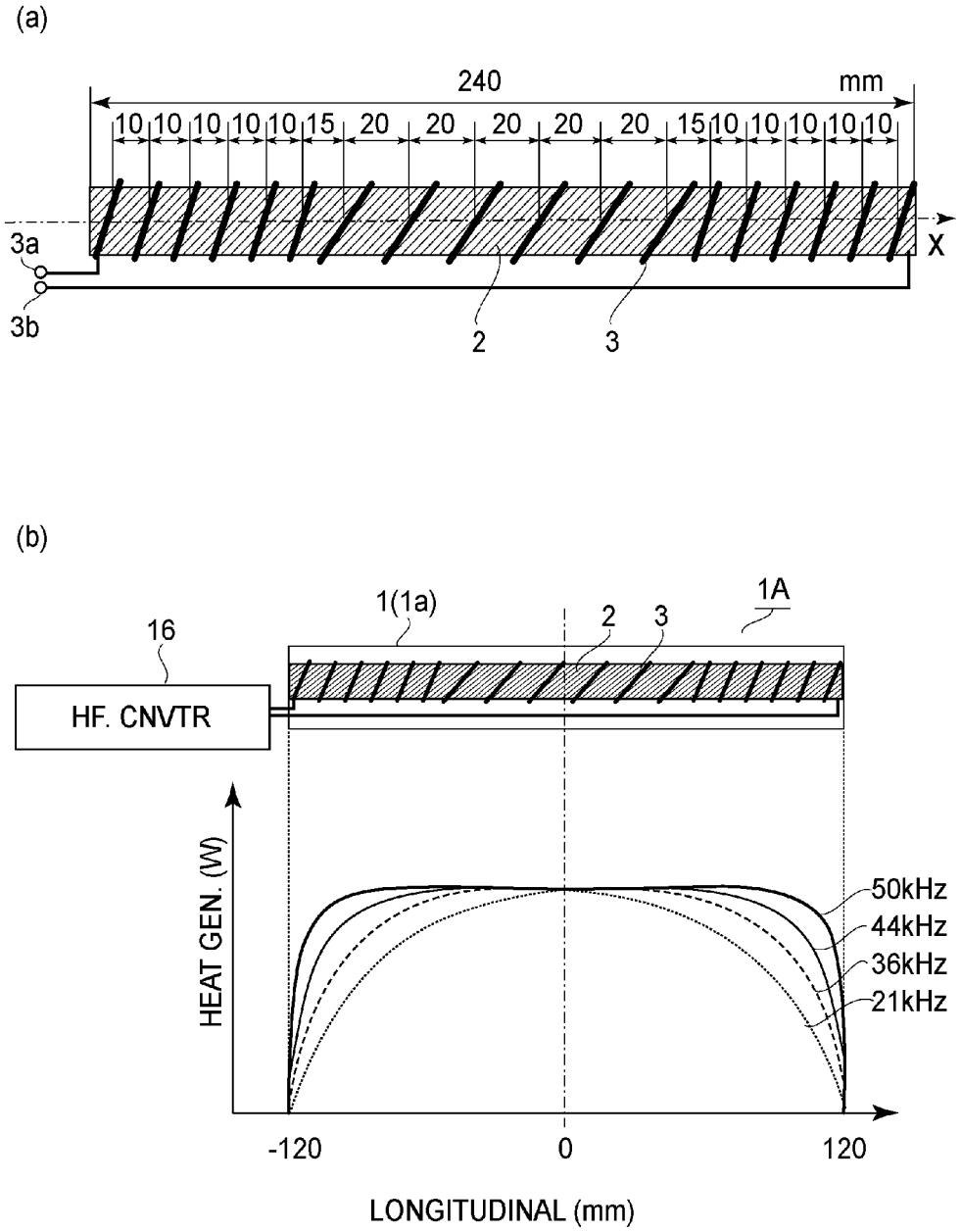

Part (a) of FIG. 4 is a schematic drawing for showing the winding interval of the excitation coil.

part (b) of FIG. 4 is a drawing which shows the heat generation pattern of the heat generation unit in terms of the lengthwise direction of the heat generation unit.

Figure 5:
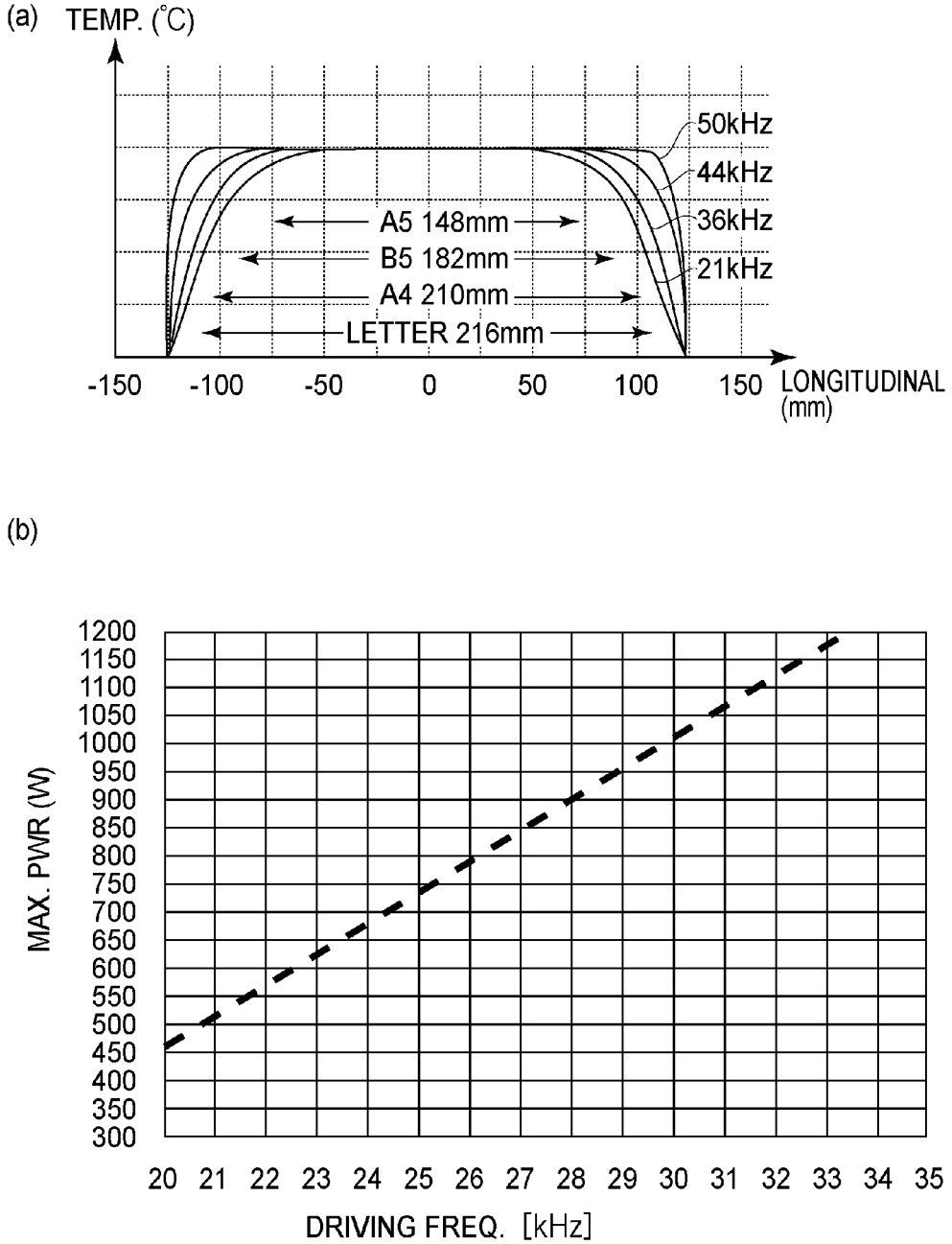

Part (a) of FIG. 5 is a drawing which shows the relationship between the recording medium size and the driving frequency.

part (b) of FIG. 5 is a drawing which shows the relationship between the driving frequency, and the maximum amount of electric power which is available to the heat generation unit.

Figure 6:
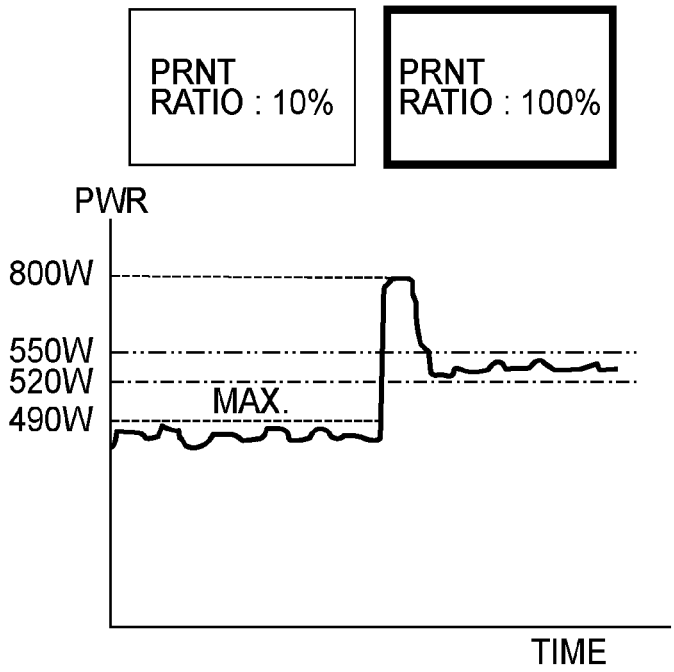

FIG. 6 is a graph which shows the changes in the necessary amount of electric power.

Figure 7:
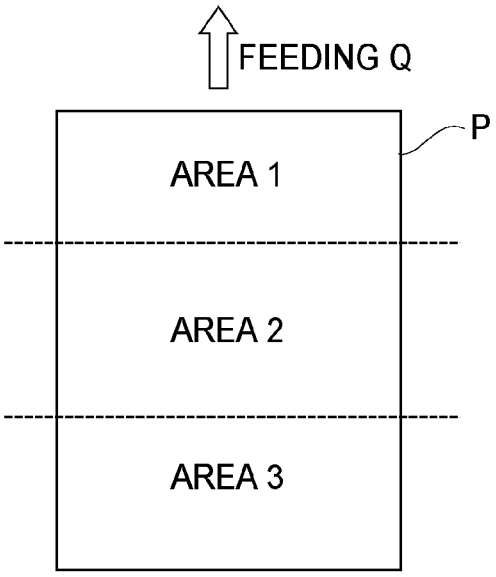

FIG. 7 is a drawing which shows the sections into which the surface of a sheet of recording medium are divided in the second embodiment.

Figure 8:
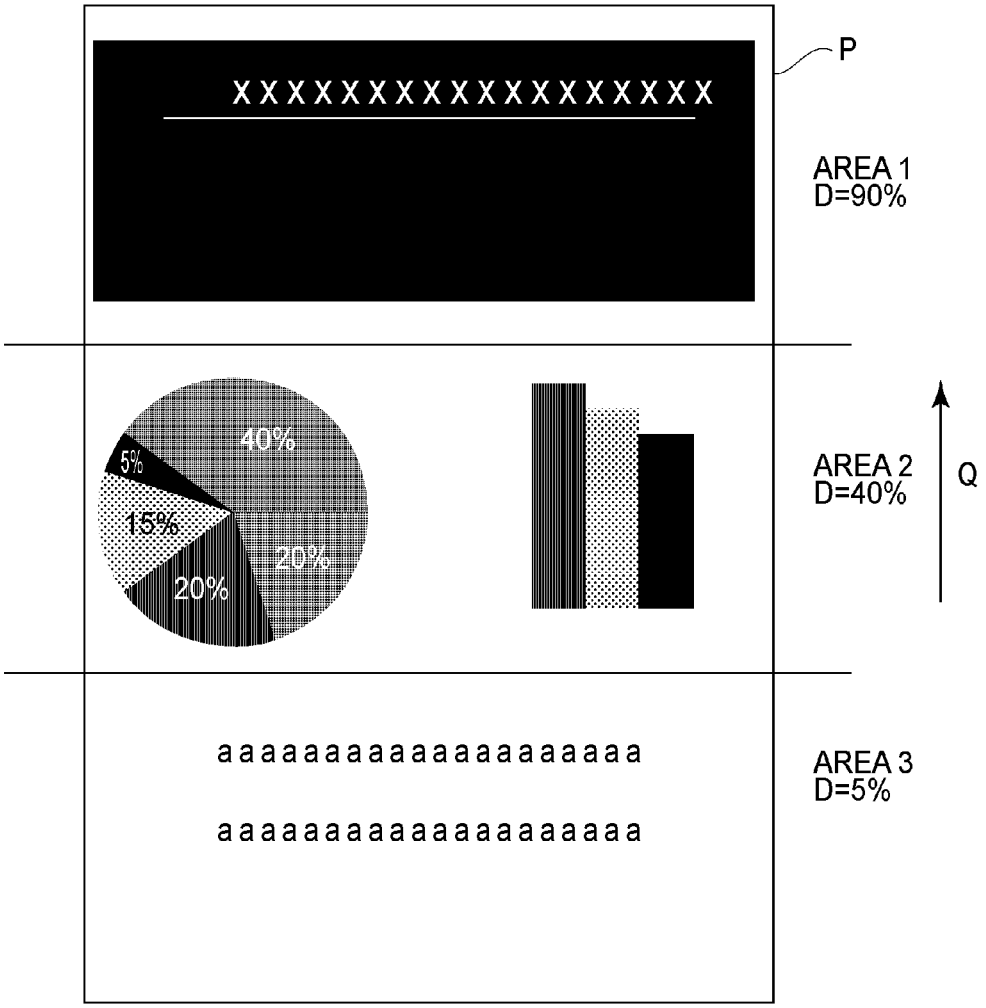

FIG. 8 is a drawing of an example of image in the second embodiment.

Figure 9:
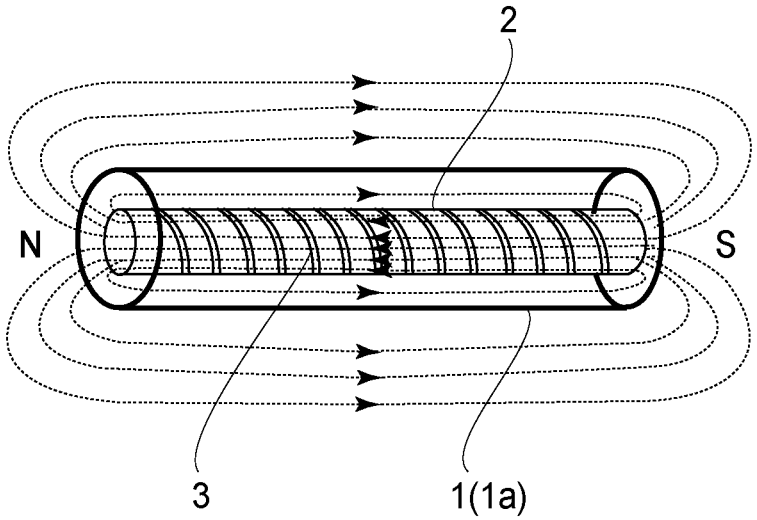
Figure 9:
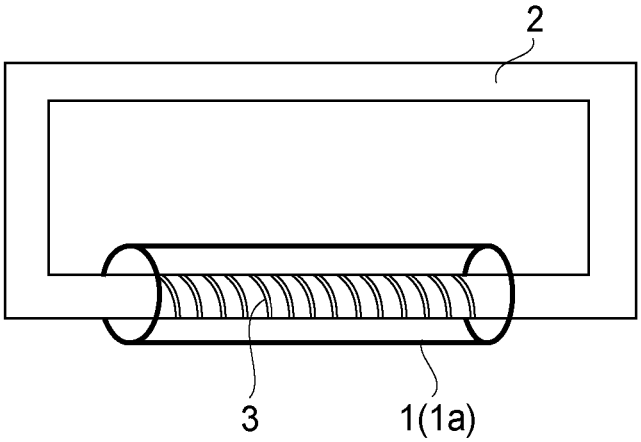

Part (a) of FIG. 9 is a drawing for describing the heat generation mechanism.

Part (b) of FIG. 9 is another drawing for describing the heat generation mechanism.

Figure 10:
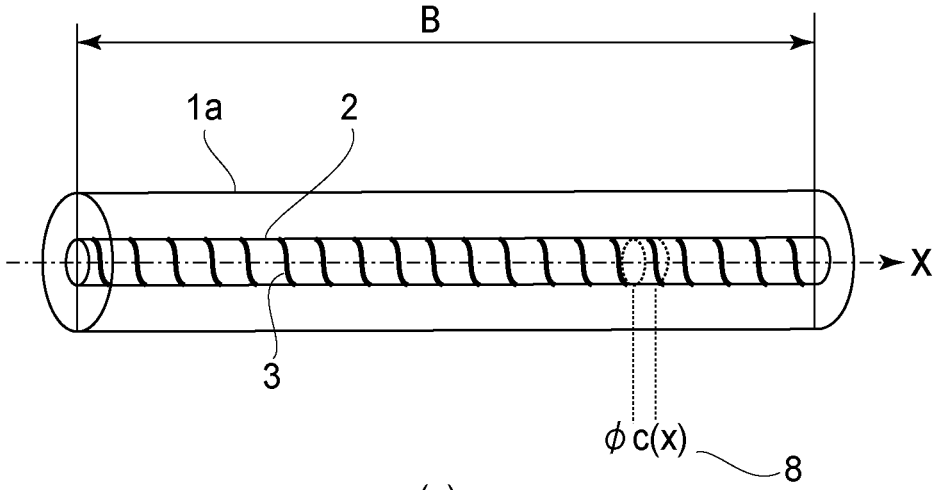
Figure 10:
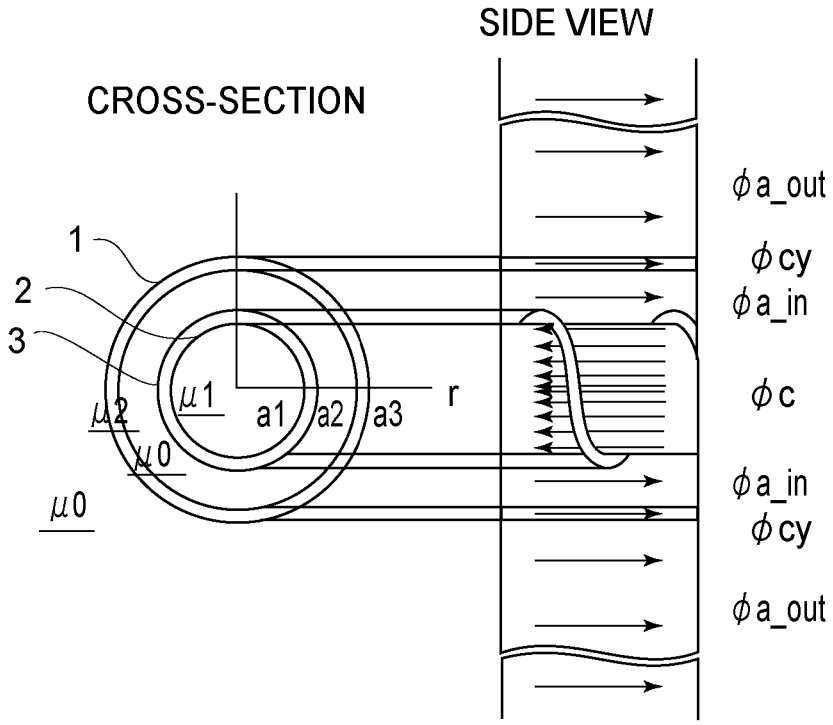

Part (a) of FIG. 10 is a drawing for describing the magnetic flux.

Part (b) of FIG. 10 is another drawing for describing the magnetic flux.

Figure 11:
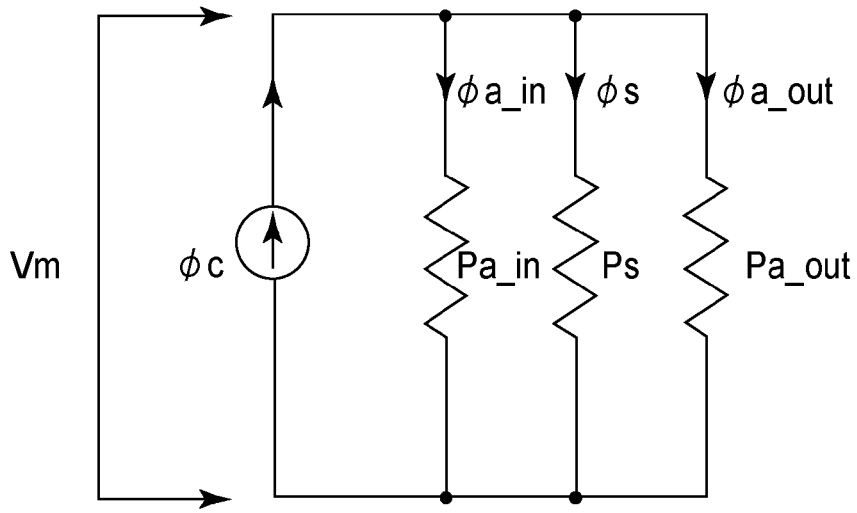
Figure 11:
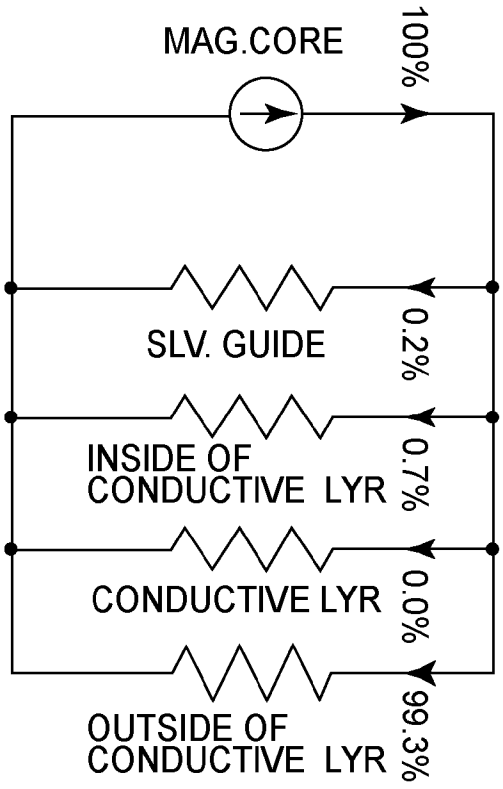

Part (a) of FIG. 11 is a drawing of an electrical circuit which is equivalent to a magnetic circuit in part (b) of FIG. 11.

Part (b) of FIG. 11 shows the magnetic circuit, the equivalent circuit of which is shown in part (a) of FIG. 11.

Figure 12:
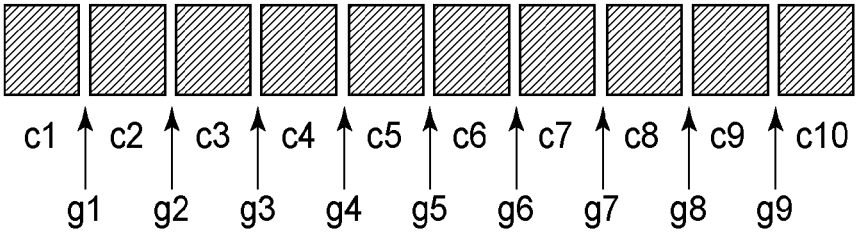

FIG. 12 is a schematic sectional view of the magnetic core at a plane which coincides with the axial line of the core. It shows the structure of the magnetic core.

Figure 13:
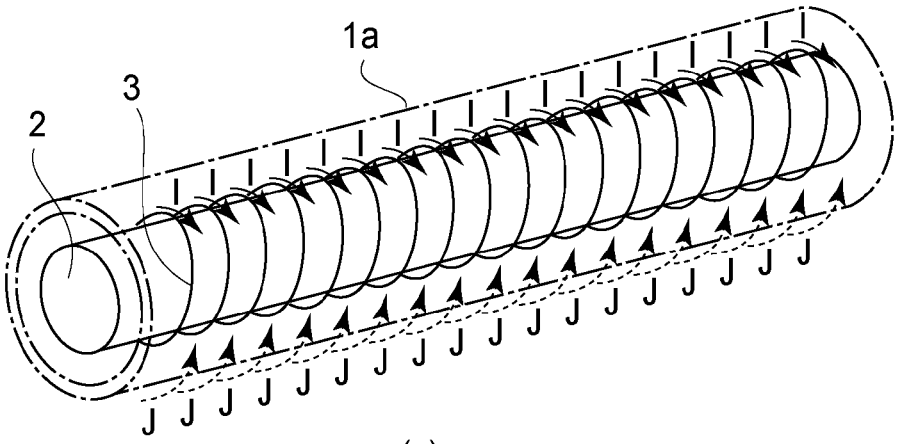
Figure 13:
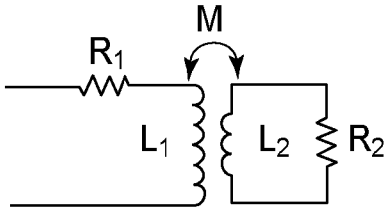

Parts (a) and (b) of FIG. 13 are drawings for describing the efficiency of the circuit.

Figure 14:
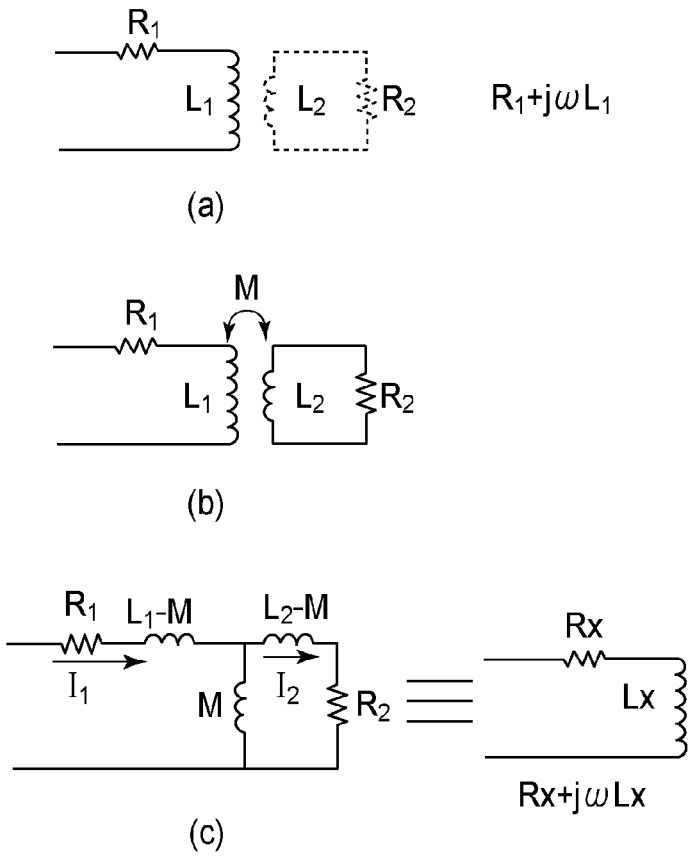

Parts (a), (b) and (c) of FIG. 14 are drawings for describing the equivalent circuit.

Figure 15:
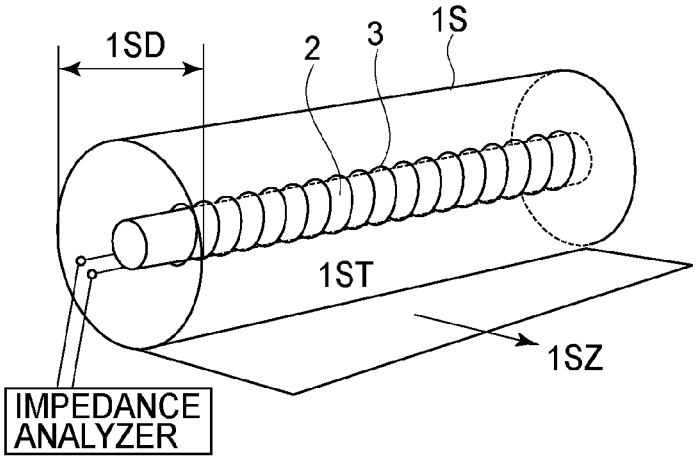

FIG. 15 is a drawing of the testing equipment which is to be used for measuring the amount of electric power conversion efficiency.

Figure 16:
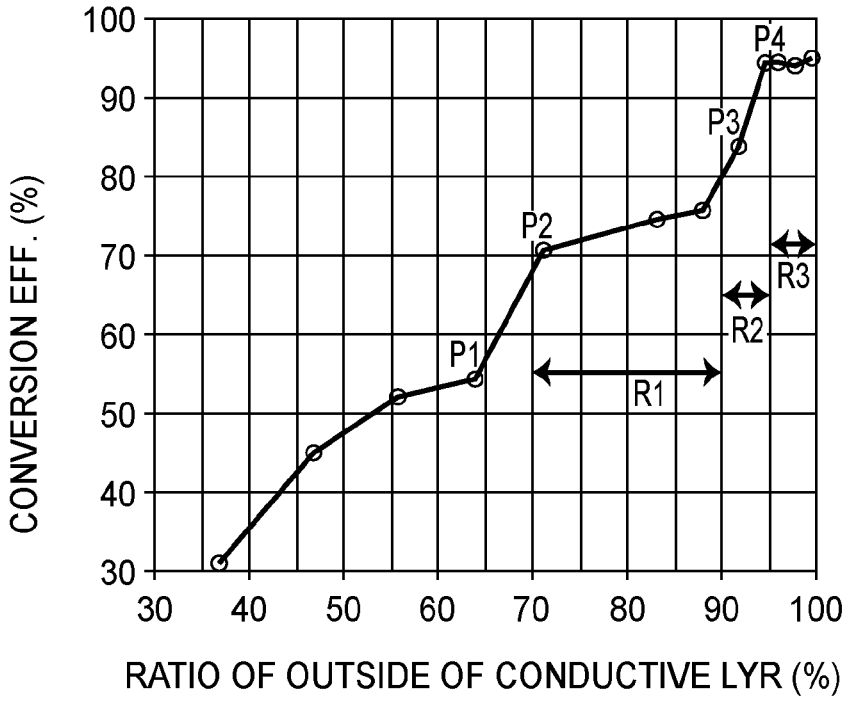

FIG. 16 is a drawing which shows the electric power conversion efficiency.

Figure 17:
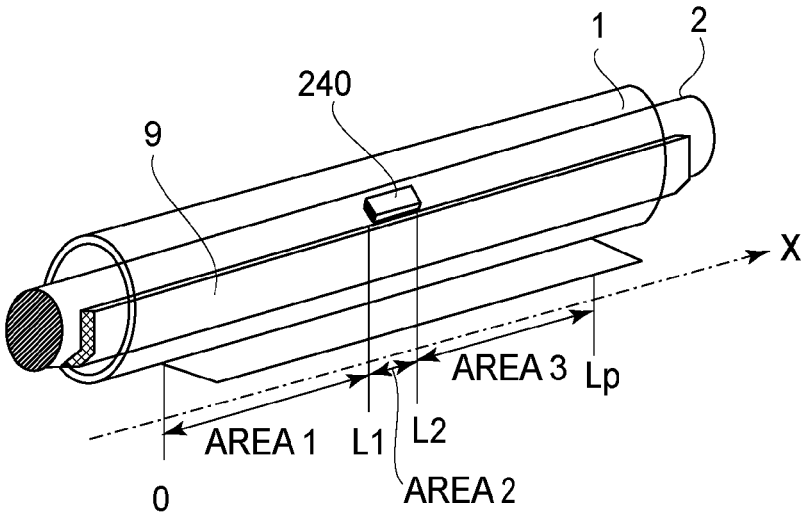

FIG. 17 is a schematic drawing of a fixing device, the structural components of which are nonuniform in cross-section, in terms of the lengthwise direction of the device.

Figure 18:
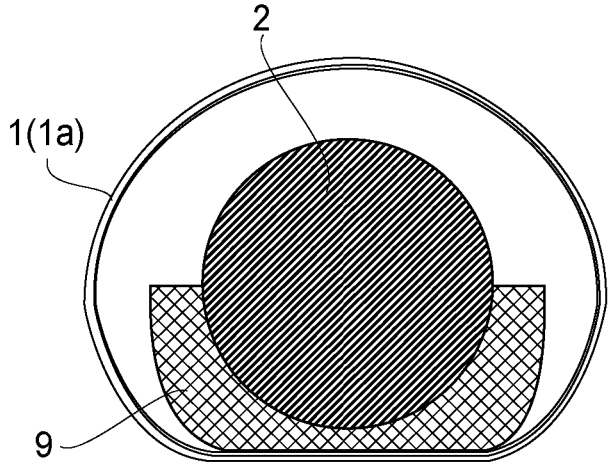
Figure 18:
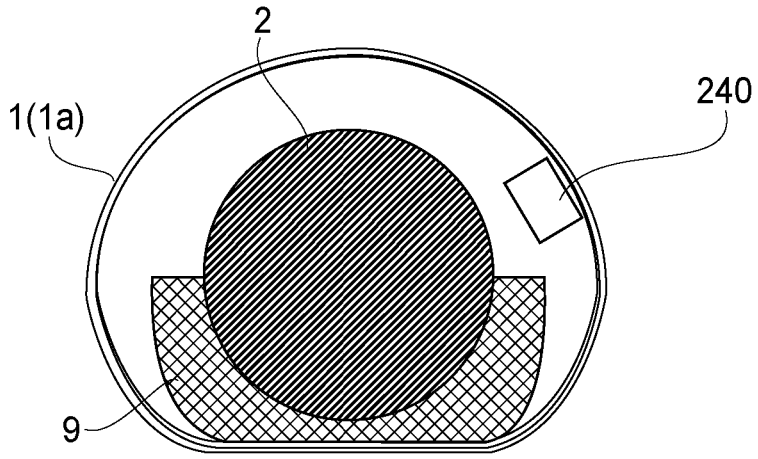

Parts (a) and (b) of FIG. 18 are schematic sectional views of the fixing device in FIG. 17.

Figure 19:
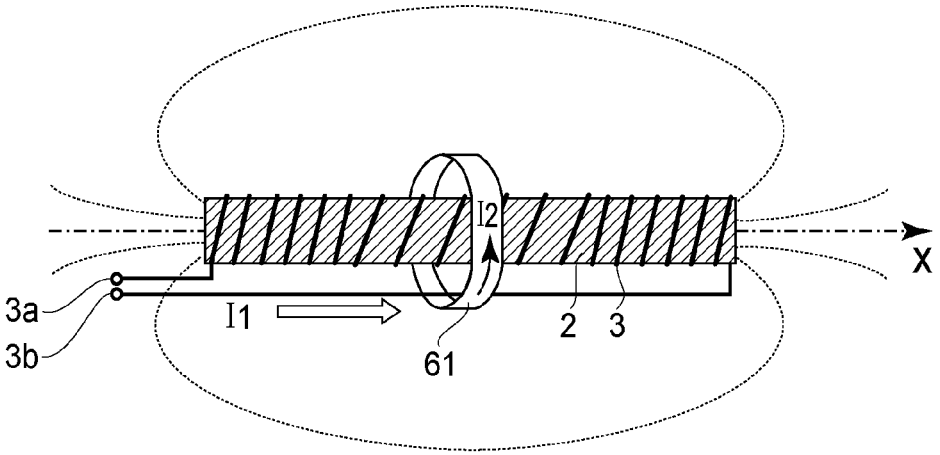
Figure 19:
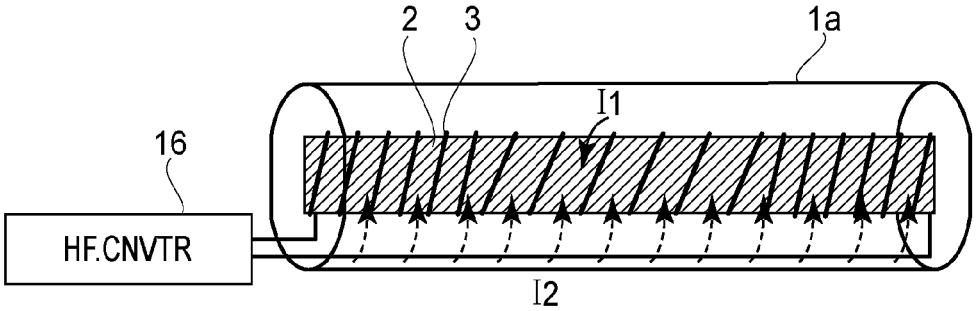

Part (a) of FIG. 19 is a drawing of the magnetic field generated as electric current is flowed through the coil in the direction indicated by an arrow mark.

part (b) of FIG. 19 is a drawing of the electric current which flows through the heat generation layer in the circumferential direction of the heat generation layer as the electric current is flowed in the direction indicated by an arrow mark, and part (b) of FIG. 19 is a drawing which shows the circumferential electric current which flows through the heat generation layer.

Figure 20:
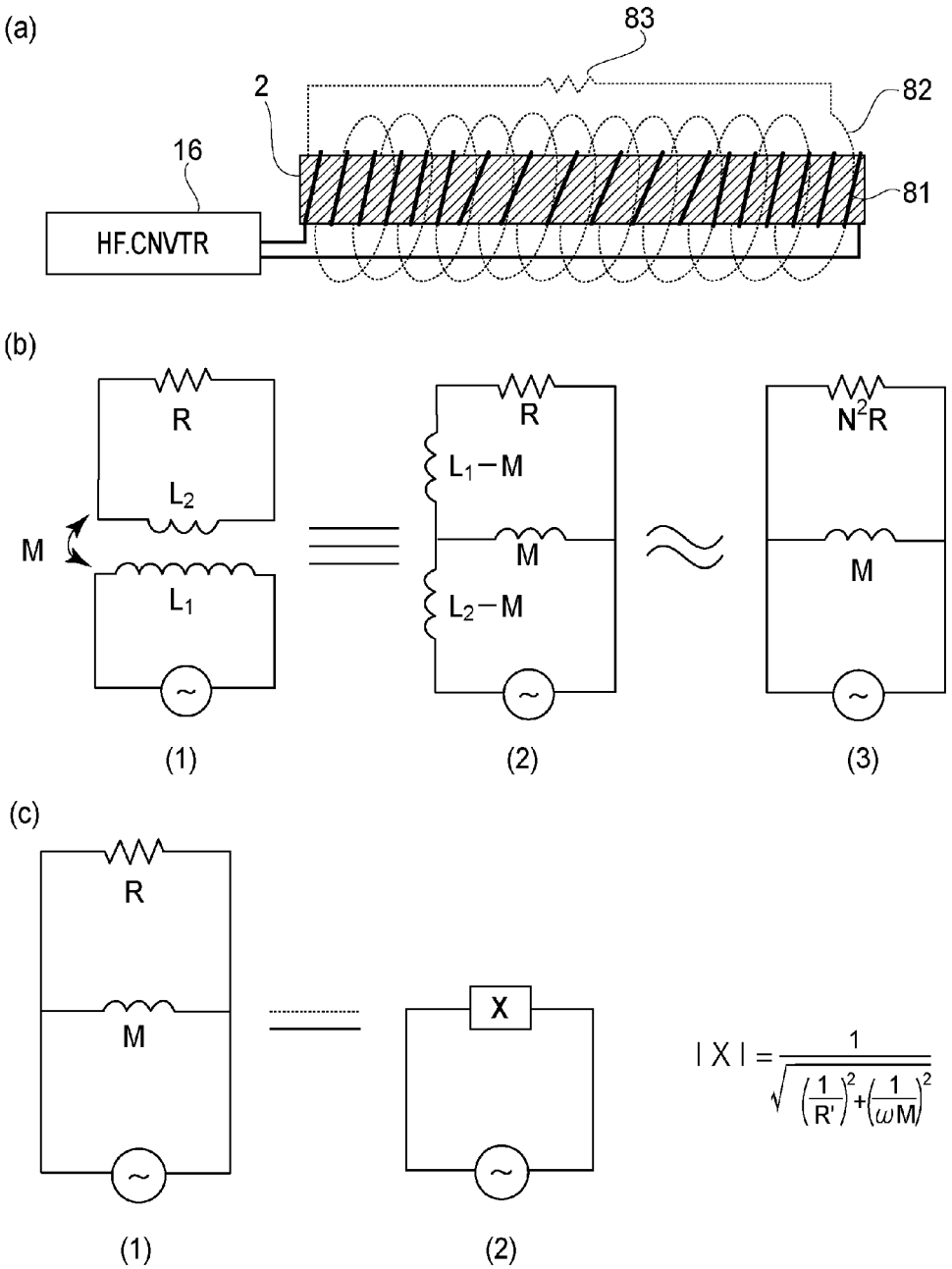

Part (a) of FIG. 20 is a drawing for describing the magnetic coupling of a coaxial transformer, the primary and secondary coils are coaxially wound.

Parts (b) and (c) of FIG. 20 are equivalent magnetic circuits of the transformer.

Figure 21:
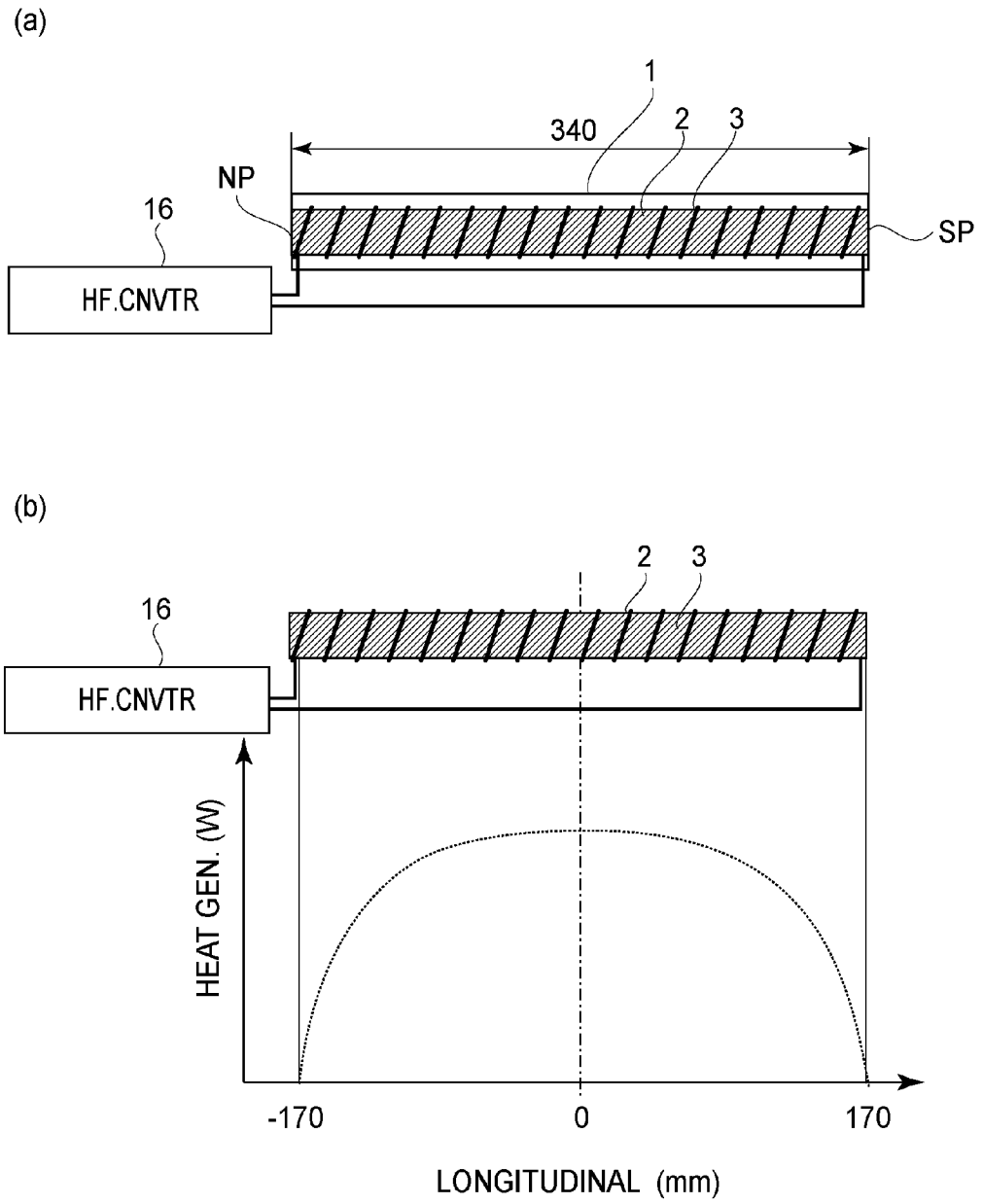

FIG. 21 (*a*) is a drawing which shows the interval between the adjacent two windings of the excitation coil.

part (b) of FIG. 21 is a drawing which shows the heat generation pattern of the heat generation unit.

Figure 22:
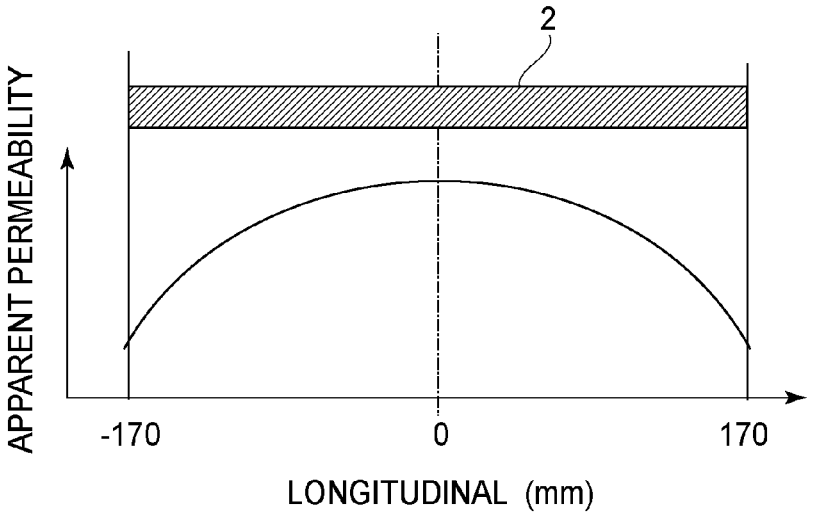

FIG. 22 is a drawing for describing the phenomenon that the lengthwise end portions of the magnetic core are lower in apparent permeability.

Figure 23:
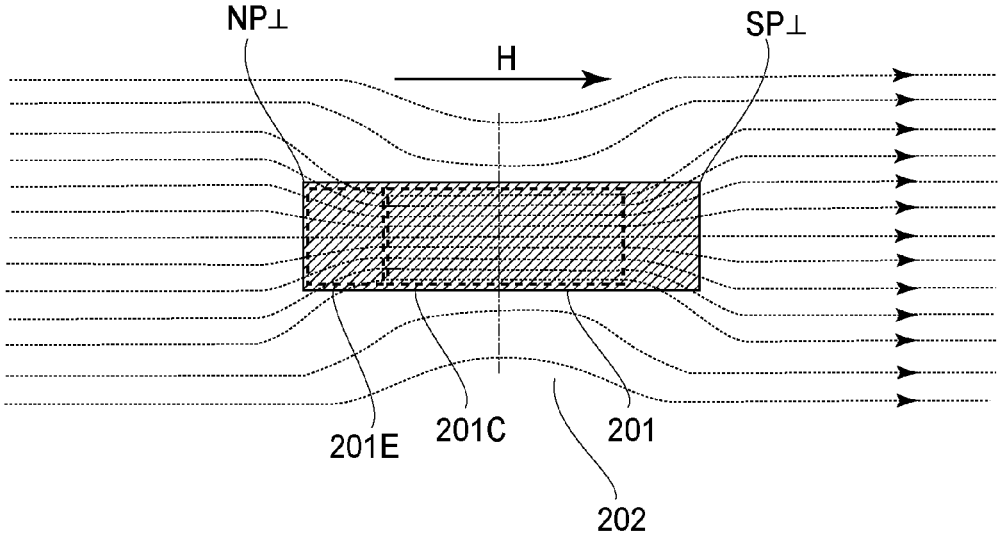

FIG. 23 is a schematic drawing of the pattern in which the magnetic flux is shaped as a ferrite is placed in a uniform magnetic field in a body of air.

Figure 24:
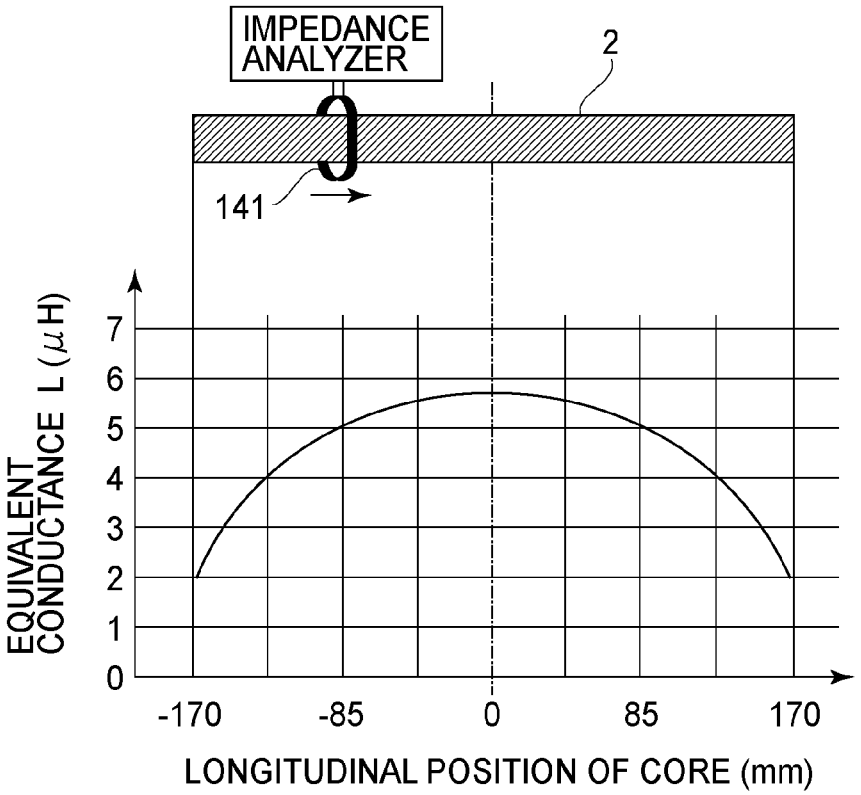

FIG. 24 is a drawing which shows how the magnetic core is scanned by an impedance analyzer.

Figure 25:
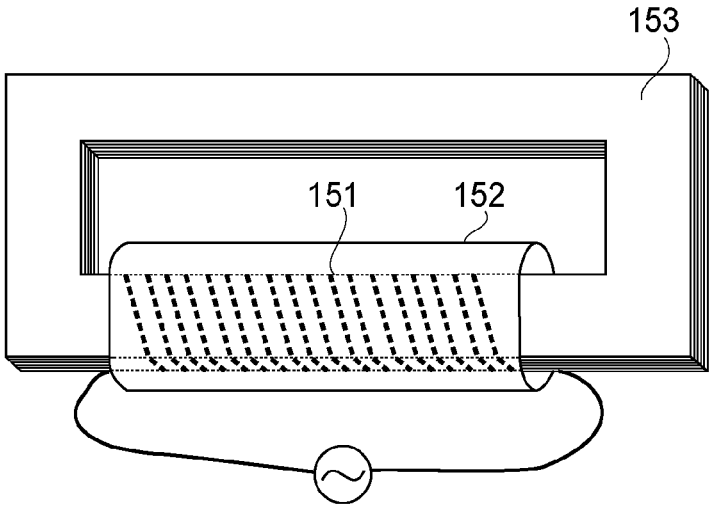

FIG. 25 is a schematic drawing of a heat generation unit having an endless magnetic core.

Figure 26:
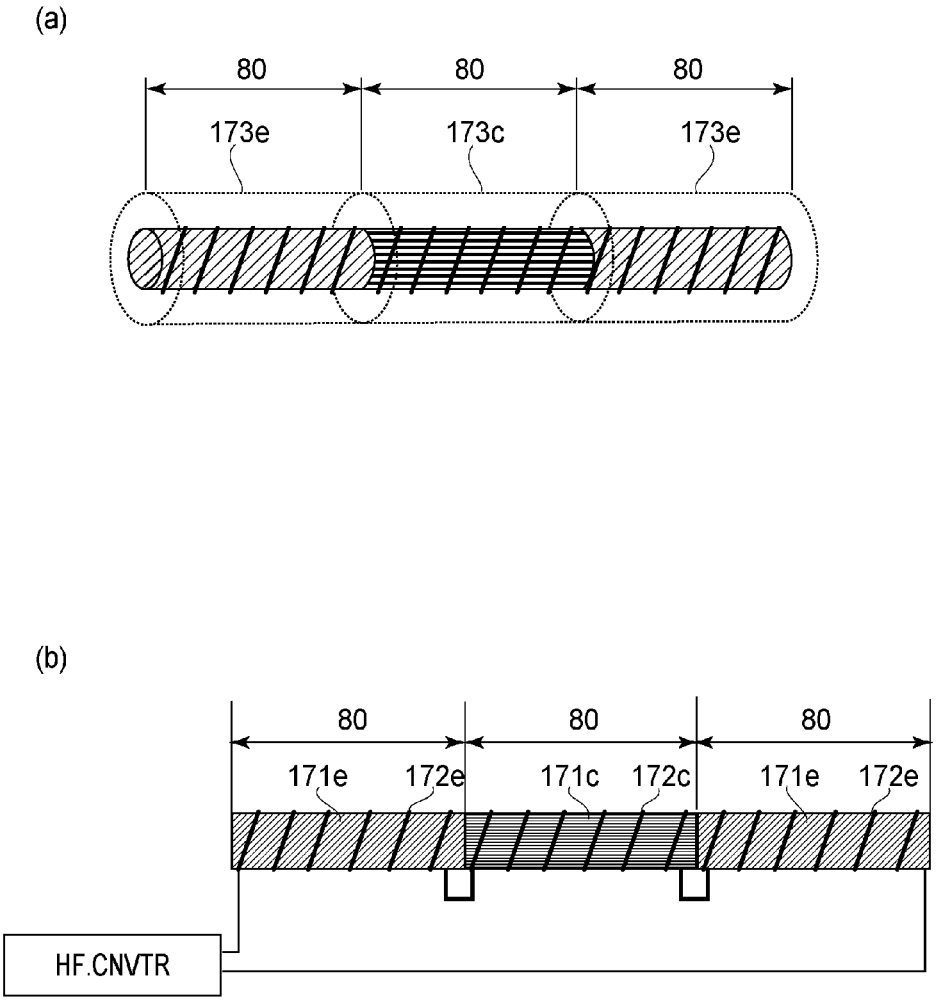

Part (a) and part (b) of FIG. 26 are schematic drawings of a heat generation unit made up of three sections.

Figure 27:
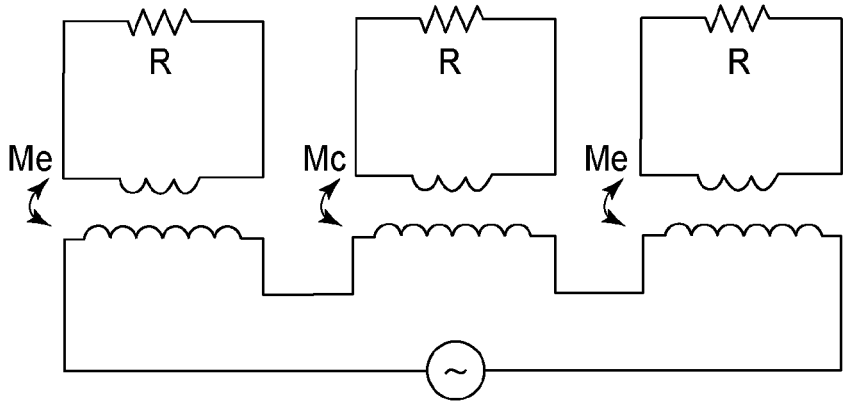
Figure 27:
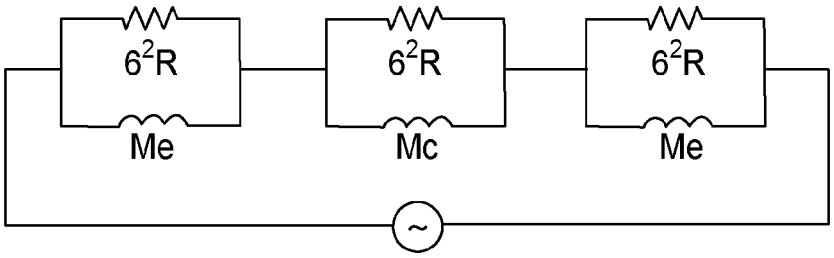
Figure 27:
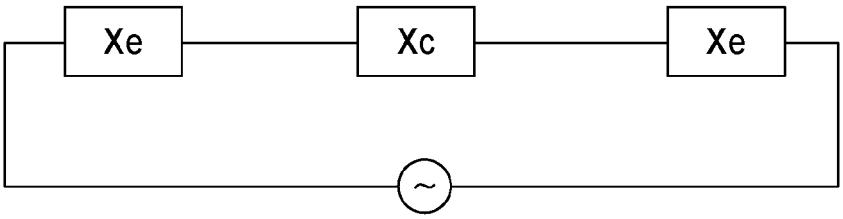

Part (a) of FIG. 27 is a drawing of an equivalent circuit.

Part (b) and (c) of FIG. 27 are simplified versions of part (a) of FIG. 27.

Figure 28:
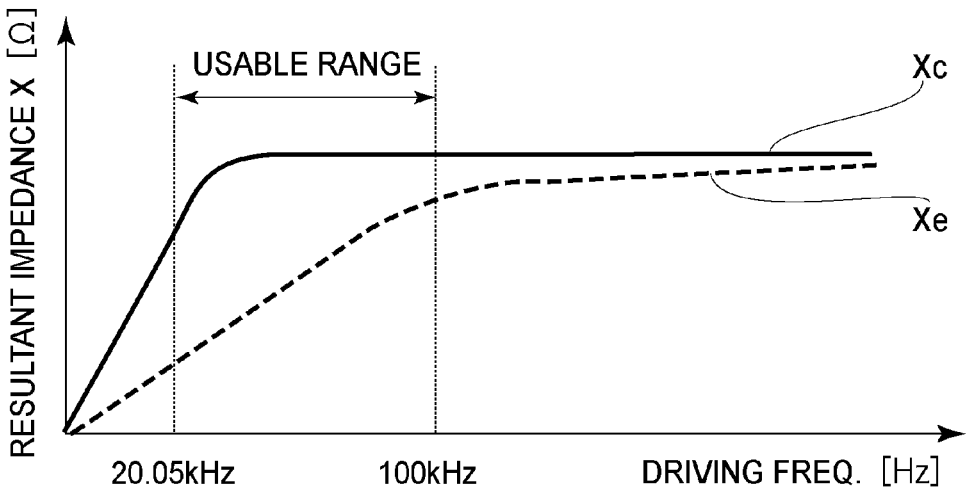
Figure 28:
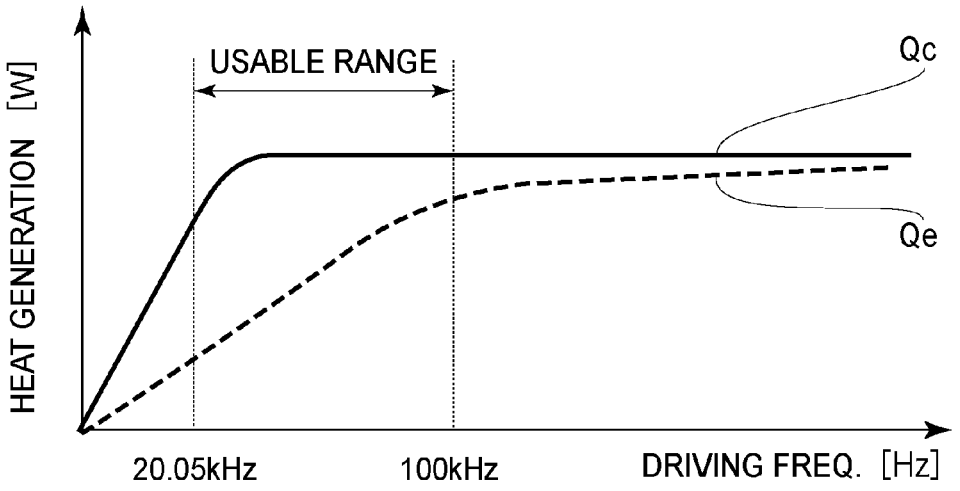

Part (a) of FIG. 28 is a graph which shows the properties of Xe and Xc in terms of frequency. part (b) of FIG. 28 is a graph which shows the properties of the Qe and Qc in terms of frequency.

Figure 29:
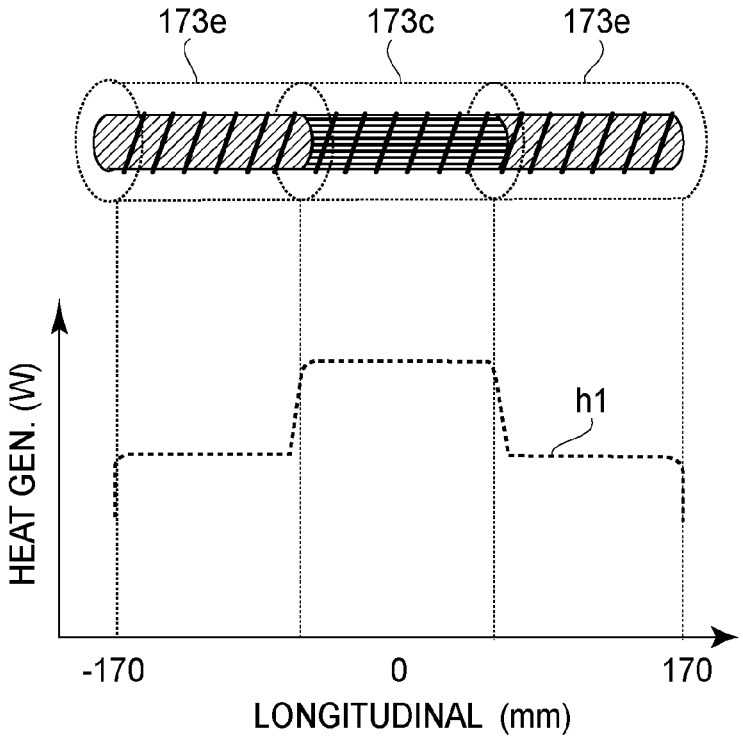

FIG. 29 is a schematic drawing for showing the amount by which heat is generated by the lengthwise center portion of the heat generation unit, and that by the lengthwise end portions of the heat generation unit.

Figure 30:
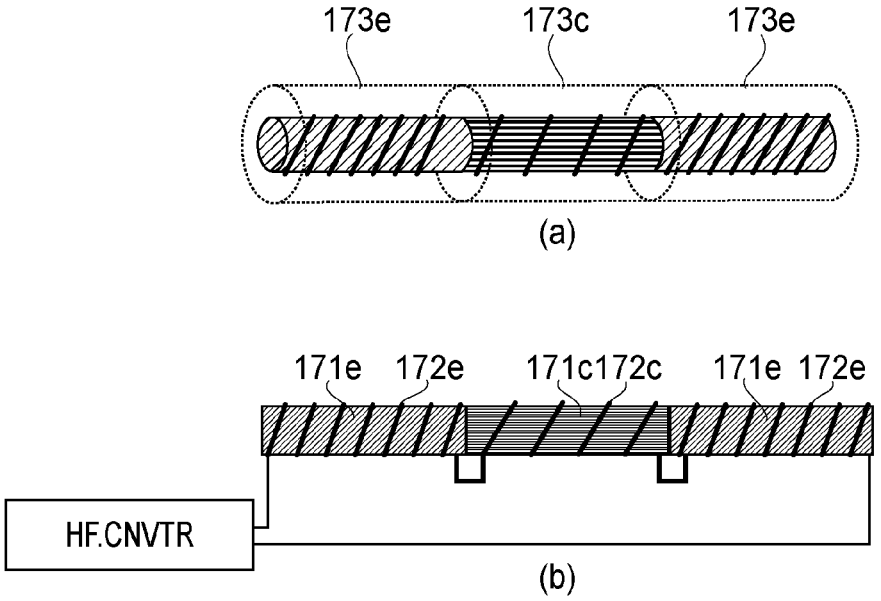

Parts (a) and (b) of FIG. 30 is a drawing of the heat generation unit having three sections.

Figure 31:
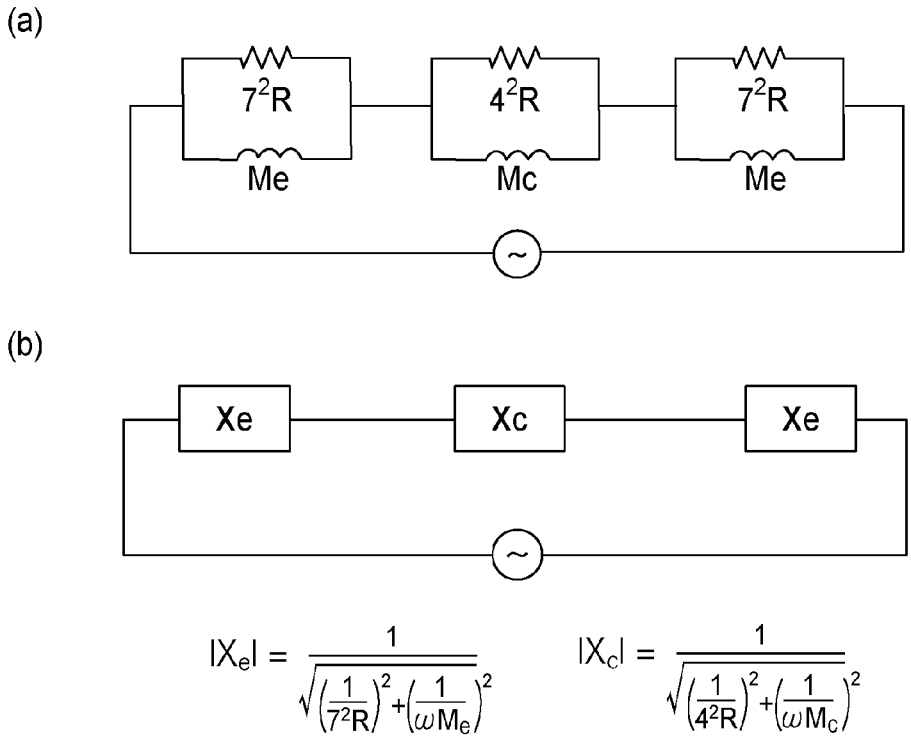

Part (a) of FIG. 31 is a drawing of an equivalent circuit.

part (b) of FIG. 31 is a drawing of a simpler version of the equivalent circuit in part (a) of FIG. 31.

Figure 32:
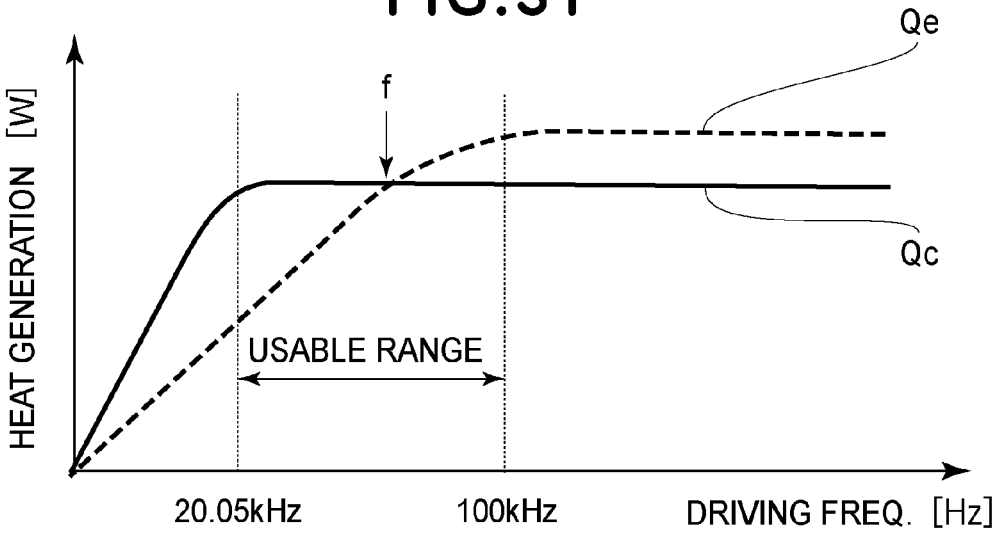

FIG. 32 is a graph which shows the properties of Qe and Qc in terms of frequency.

Figure 33:
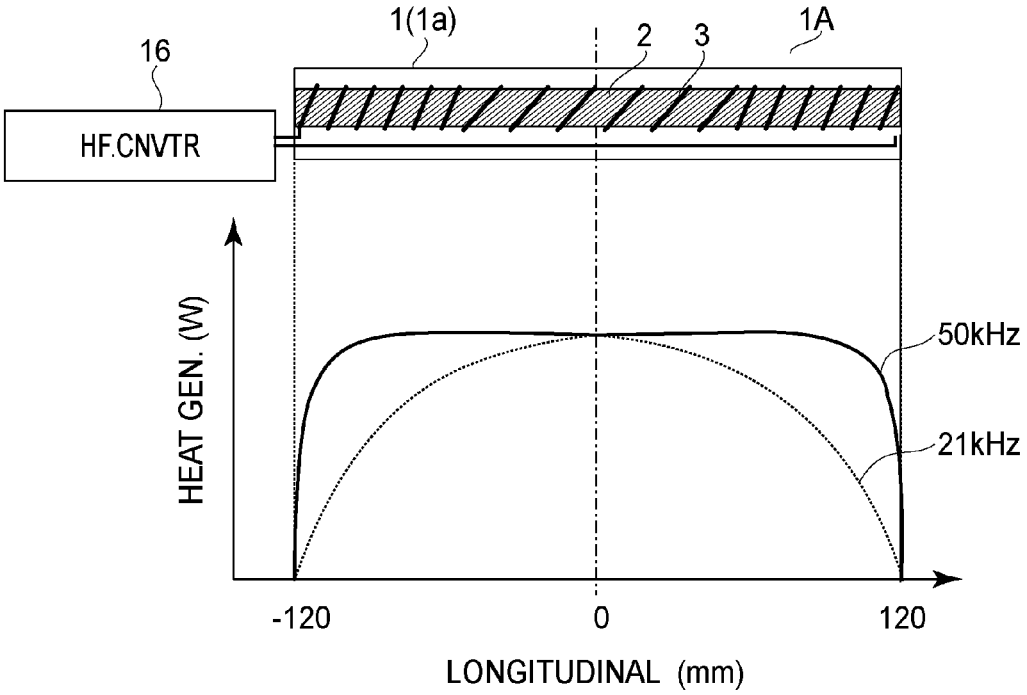

FIG. 33 is a drawing of the heat generation pattern of the heat generation unit the first embodiment in terms of the lengthwise direction of the unit.

Figure 34:
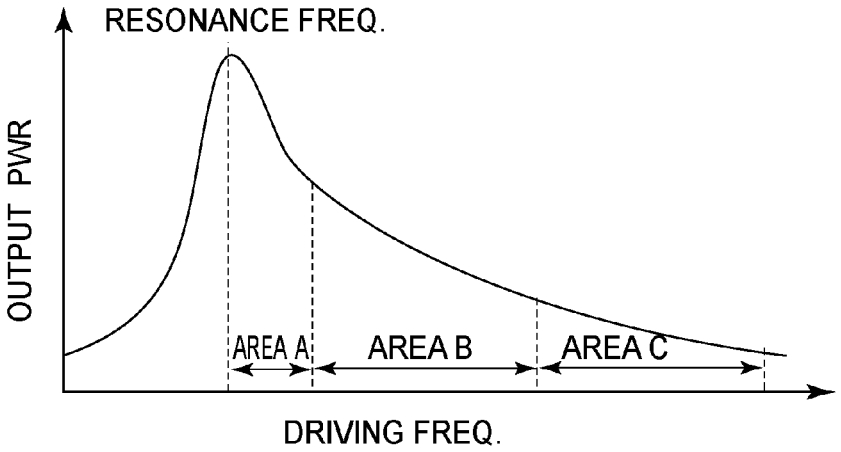

FIG. 34 is a graph which shows the relationship between the driving frequency and electric power output.

Figure 35:
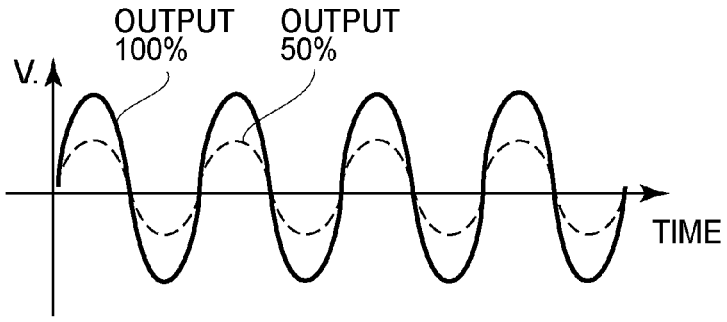
Figure 35:
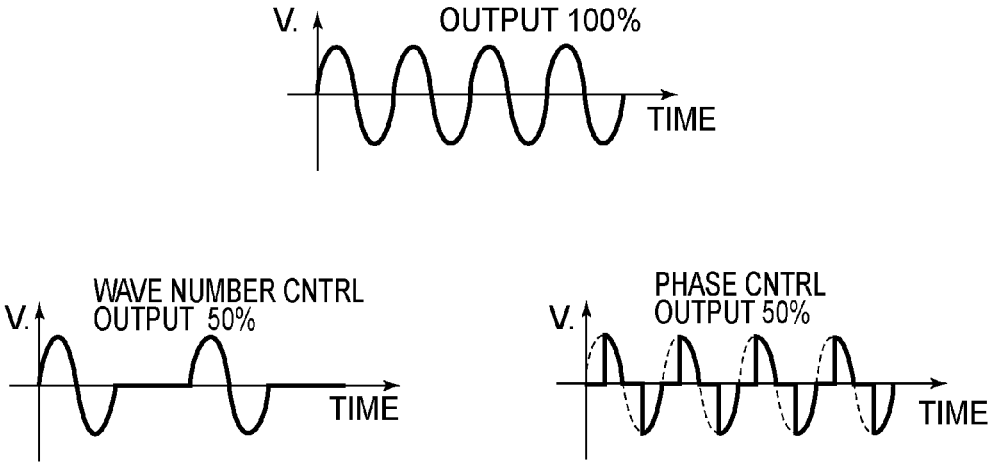

Parts (a) and (b) of FIG. 35 are drawings of the voltage waveform.

DESCRIPTION OF THE EMBODIMENTS

Embodiment 1

Figure 1:
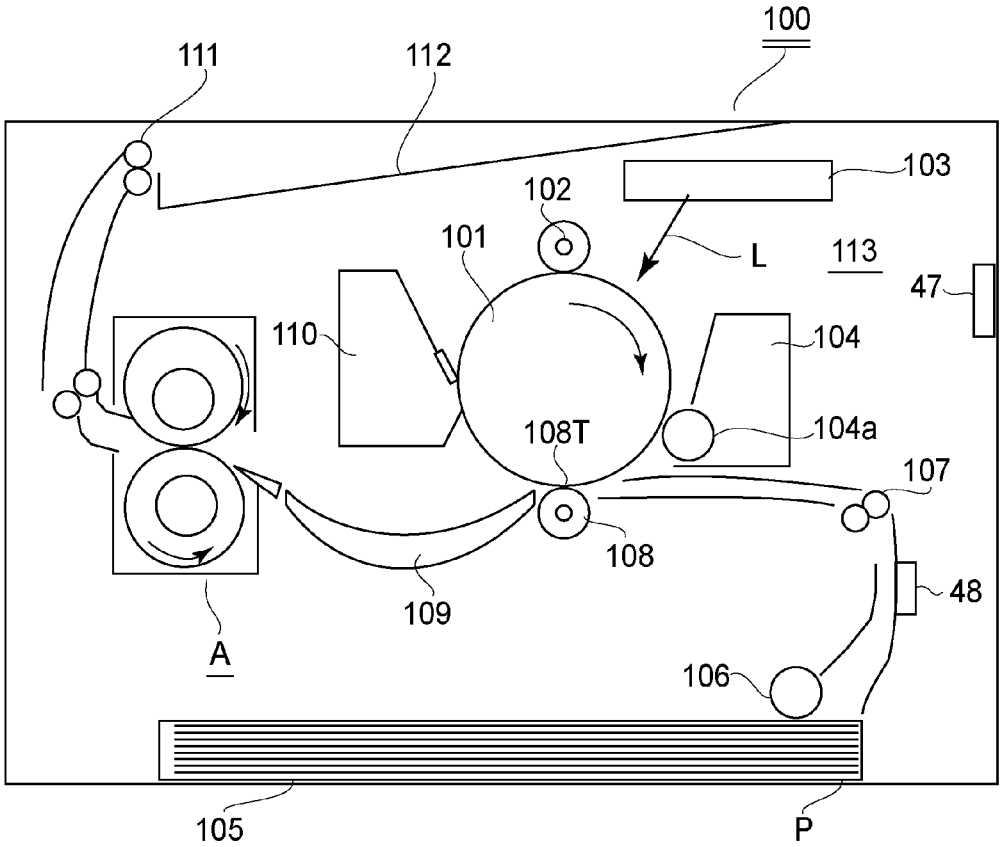
FIG. 1 is a schematic sectional view of an example of image forming apparatus which is equipped with the fixing device in the first embodiment of the present invention. It shows the general structure of the apparatus.

(1) General Description of Image Forming Apparatus Equipped with Fixing Device FIG. 1 is a schematic sectional view of an example of image forming apparatus 100 equipped with a fixing device A as an image heating device in this embodiment. It shows the general structure of the apparatus. The image forming apparatus 100 is an electrophotographic laser beam printer. A referential code 101 stands for a photosensitive drum (which hereafter will be referred to as drum) as an image bearing component. It is rotationally driven in the clockwise direction indicated by an arrow mark at a preset process speed (peripheral velocity). As the drum 101 is rotated, it is uniformly charged by a charge roller 102 to preset polarity and potential level.

A referential code 103 stands for a laser beam scanner as a means for exposing the charged peripheral surface of the drum 101. This scanner 103 outputs a beam L of laser light while modulating (turning on or off) the beam L with digital image formation signals inputted from an external device 42 (FIG. 30 such as a computer, or those generated by an image processing section 41 (printer controller). The uniformly charged peripheral surface of the drum 101 is scanned by (exposed to) this beam L of laser light. The abovementioned digital image formation signals are signals generated based on the image data received from the external device 42.

As the uniformly charged portion of the peripheral surface of the drum 101 is scanned (exposed) as described above, electric charge is removed from the exposed points of the peripheral surface of the drum 101. Consequently, an electrostatic latent image, which reflects the image formation signals, is effected on the peripheral surface of the drum 101. A referential code 104 stands for a developing device. As developer (toner) is supplied to the peripheral surface of the drum 101 from the development roller 104*a* of the developing device 104, the electrostatic latent image on the peripheral surface of the drum 101 is developed into a transferable toner image (image formed of toner), from the downstream side of the latent image in terms of the rotational direction of the drum 101.

In the following description of the embodiments of the present invention, terminologies, such as paper feeding, paper conveying section, paper-path area, out-of-paper-path area, paper dust, paper discharge, paper interval, paper width, large paper, small paper, etc., which are related to paper, are used. However, recording medium choice does not need to be limited to paper. For example, it may be a sheet of resin, a coated sheet of paper, and the like.

Recording medium width, or recording medium size in terms of widthwise direction, means the measurement of a sheet of recording medium in terms of the direction which is perpendicular to the recording medium conveyance direction. The widest sheet of recording medium, in terms of the direction perpendicular to the recording medium conveyance direction, which can be used by (conveyed through) the image forming apparatus 100 or fixing device in this embodiment, will be referred to as a largest sheet of recording medium, and a sheet of recording medium which is narrower than the largest sheet of recording medium will be referred to as a small sheet of recording medium.

A referential code 105 stands for a sheet feeder cassette, in which multiple sheets P of recording medium are stored in layers. As a sheet feeder roller 106 is driven in response to a sheet feeding start signal, the sheets P in the sheet feeder cassette 105 begin to be fed one by one into the main assembly of the image forming apparatus while being separated from the rest in the cassette 105. Then, each sheet P of recording medium is conveyed further by a pair of registration rollers 107 to be introduced into a transferring section 108T, which is the nip between the drum 101, and a transfer roller 108 which is rotated by the rotation of the drum 101, with a preset timing. That is, the conveyance of the sheet P is controlled by the pair of registration rollers 107 in such a manner that the leading edge of the toner image on the drum 101, and the leading edge of the image bearing area of the sheet P of recording medium, arrive at the transferring section 108T at the same time.

Thereafter, the sheet P of recording medium is conveyed through the transfer section 108T while remaining pinched between the drum 101 and transfer roller 108. During the conveyance of the sheet P through the transfer section 108T, transfer voltage (transfer bias) is applied to the transfer roller 108 from an unshown transfer bias application power source while being controlled in a preset manner. The transfer bias applied to the transfer roller 108 is opposite in polarity from the toner. In the transfer section 108T, therefore, the toner image on the peripheral surface of the drum 101 is electrostatically transferred onto the surface of the sheet P. After the transfer, the sheet P is separated from the peripheral surface of the drum 101, and is introduced into the fixing device A (fixing section) through a recording medium conveyance guide 109.

In the fixing device A, the sheet P of recording medium is subjected to a process for thermally fixing the toner image to the sheet P. After the transfer of the toner image from the peripheral surface of the drum 101, onto the sheet P, the peripheral surface of the drum 101 is cleaned by a cleaning device 110; contaminants such as the toner remaining on the peripheral surface of the drum 101 after the transfer, paper dust, etc., on the peripheral surface of the drum 101 are removed by the cleaning device 110. After the conveyance of the sheet P through the fixing device A, the sheet P is discharged onto a delivery tray 112 through a sheet outlet 111.

Regarding the configuration of the image forming apparatus 100, the section of the image forming apparatus 100, which is on the upstream side of the fixing device A (fixing section), in terms of the recording medium conveyance direction, is an image forming section 113 (part (a) of FIG. 2) which forms a toner image T (image to be heated), on the sheet P of recording medium.

(2) General Description of Fixing Device

In this embodiment, the fixing device A is an image heating device which uses a heating method based on electromagnetic induction. Part (a) of FIG. 2 is a schematic sectional view of the essential portion of the fixing device A in this embodiment, at a plane perpendicular to the lengthwise direction of the fixing device A. Part (b) of FIG. 2 is a schematic front view of the same essential portion of the fixing device A. FIG. 3 is a combination of a schematic drawing of the heat generation unit of the fixing device A, and a block diagram of the control system of the image forming apparatus 100. Regarding the orientation of the fixing device A, the front side is the side from which a sheet P of recording medium is introduced into the fixing device A. The left or right side is the left or right side as seen from the front side of the fixing device A.

Roughly speaking, this fixing device A has a heat generation unit 1A, and a pressure roller 8 as a nip forming component (pressure applying component). The pressure roller 8 is pressed upon the heat generation unit 1A, forming thereby a fixation nip (N) through which a sheet P of recording medium is conveyed to apply heat and pressure to the sheet P and the toner image T thereon to fix the toner image T to the sheet P.

The heat generation unit 1A has a fixation sleeve 1 which is a rotatable cylindrical component having an electrically conductive layer. In the hollow of the fixation sleeve 1, a magnetic core 2 as a magnetic component, an excitation coil 3 wound around the magnetic core 2, a pressure application stay 5, a sleeve guide 6, etc., are disposed.

The pressure roller 8 is made up of a metallic core 8*a*, an elastic layer 8*b* and a release layer 8*c*. The elastic layer 8*b* is coaxial with the metallic core 8*a*, and is formed of a heat-resistant and elastic substance. It is in the form of a roller fitted around the metallic core 8*a* in a manner to cover the entirety of the peripheral surface of the metallic core 8*a*. The release layer 8*c* is the surface layer of the pressure roller 8. As the material for the elastic layer 8*b*, such substances as silicone rubber, fluorine rubber, fluorosilicone rubber, or the like, that is elastic and excellent in terms of heat resistance is desired. The metallic core 8*a* is rotatably supported between the pair of unshown lateral plates of the chassis of the fixing device A; the lengthwise ends of the metallic core

8*a* are rotatably supported by a pair of electrically conductive bearings attached to the pair of lateral walls one for one.

The heat generation unit 1A is disposed roughly in parallel to the pressure roller 8, on the top side of the pressure roller 8. Between the lengthwise ends of the pressure application stay 5, and a pair of spring bearing components 18*a* and 18*b* with which the unshown chassis of the fixing device A is provided, a pair of compression springs 17*a* and 17*b* are disposed in a compressed state, respectively. Thus, the pressure application stay 5 remains pressured downward. By the way, in the case of the fixing device A in this embodiment, the total amount of this downward pressure is in a range of roughly 100 N-250 N (roughly 10 kgf-25 kgf).

Thus, the bottom surface of the sleeve guide 6 formed of heat resistant resin such as PPS, and the upwardly facing portion of the peripheral surface of the pressure roller 8, are pressed against each other, with the presence of the fixation sleeve 1 between the two surfaces, being thereby made to form a fixation nip N, which has a preset width, in terms of the recording medium conveyance direction Q. The sleeve guide 6 is a backup component, which is placed in contact with the inward surface of the fixation sleeve 1 to back up the fixation sleeve 1 by opposing the pressure roller 8. Not only does it back up the fixation sleeve 1, but also, it plays the role of guiding the fixation sleeve 1 as the fixation sleeve 1 rotates.

The pressure roller 8 is rotationally driven by an unshown driving means in the counterclockwise direction indicated by an arrow mark in part (a) of FIG. 2. Thus, the friction which occurs between the outward surface of the fixation sleeve 1 and the pressure roller 8, in the fixation nip N, functions to rotate the fixation sleeve 1. Thus, the fixation sleeve 1 is rotated by the rotation of the pressure roller 8, in the clockwise direction indicated by an arrow mark, with the inward surface of the fixation sleeve 1 remaining in contact with the surface of the sleeve guide 6, in the fixation nip N. The sheet P of recording medium is introduced into the fixation nip N, and is conveyed through the fixation nip N while remaining pinched between the fixation sleeve 1 and pressure roller 8.

Referential codes 12*a* and 12*b* stand for a pair of flanges, which are rotatably fitted around the left and right ends of the sleeve guide 6 of the heat generation unit 1A, one for one. In terms of the lengthwise direction of the fixing device A, the flanges 12*a* and 12*b* are fixed in position by regulating components 13*a* and 13*b*, respectively. Thus, they play the role of controlling the movement of the fixation sleeve 1 in terms of the direction parallel to the sleeve guide 6. More concretely, as the fixation sleeve 1 is rotated, it tends to deviate in the direction parallel to the lengthwise direction of the sleeve guide 6. Thus, as the fixation sleeve 1 deviates, it comes into contact with the regulating components 13*a* or 13*b*, being thereby prevented from deviating further. As the material for the flanges 12*a* and 12*b*, LCP (liquid Crystal Polymer) or the like which is excellent in heat resistance is desired.

The fixation sleeve 1 is a cylindrical and rotatable component. It has a laminar structure. That is, it is made up of a heat generation layer 1*a* (electrically conductive layer), an elastic layer 1*b*, and a release layer 1*c*. The heat generation layer 1*a* is made of an electrically conductive substance, and functions as the substrate of the fixation sleeve 1. The elastic layer 1*b* is formed on the peripheral surface of the heat generation layer 1*a*. The release layer 1*c* is formed on the outward surface of the elastic layer 1*b*. In this embodiment, a fixation sleeve, which was reduced in internal diameter to 30 mm by reducing the magnetic core 2 in size, was employed as the fixation sleeve 1.

The fixation sleeve 1 is formed of metallic film which is 10-50 μm in thickness. The elastic layer 1*b* is formed of silicone rubber which is 20 degrees in hardness (JIS-A hardness scale; under 1 kg). It is 0.3 mm-0.1 mm in thickness. The release layer 1*c* is a piece of fluorine resin tube, which is 50 μm-10 μm in thickness. It covers the entirety of the elastic layer 1*b*.

As the heat generation layer 1*a* is subjected to alternating magnetic flux, electric current is induced in the heat generation layer 1*a*. Thus, heat is generated in the heat generation layer 1*a* by this induced electric current. This heat is transmitted to the heat elastic layer 1*b* and release layer 1*c*. Consequently, the entirety of the fixation sleeve 1 is heated. Thus, as the sheet P of recording medium is introduced into the fixation nip N, and is conveyed through the fixation nip N while remaining pinched between the fixation sleeve 1 and pressure roller 8, the sheet P is heated. Thus, the toner image T is fixed to the sheet P.

Next, referring to FIG. 3, a system which causes the heat generation layer 1*a* to generate heat by inducing electric current in the heat generation layer 1*a* by subjecting it to alternating magnetic flux is described in detail. The magnetic core 2 is disposed in the hollow of the fixation sleeve 1 with the use of an unshown means, in such a manner that the magnetic core 2 extends from one lengthwise end of the fixation sleeve 1 to the other. It forms a magnetic flux passage which is straight and open, having therefore magnetic poles NP and SP.

That is, the system has a coil for generating an alternating magnetic field for causing the heat generation layer 1*a* to generate heat based on electromagnetic induction. The coil is disposed in the hollow of the fixation sleeve 1, in such a manner that its axis becomes roughly parallel to the generatrix of the fixation sleeve 1. The system has also the magnetic core 2, which is disposed on the inward side of the spiral portion of the coil to guide the magnetic flux generated by the alternating magnetic field. The shape of the magnetic core 2 is such that it does not form a loop on the outward side of the fixation sleeve 1.

The material for the magnetic core 2 is desired to be such a substance as ferrite made by sintering, ferrite resin, or amorphous alloy, which is small in hysteresis loss and high in specific permeability, Permalloy and the like oxide, or an alloy which is high in permeability. In this embodiment, ferrite formed by sintering, which is 1,800 in specific permeability, was used as the material for the magnetic core 2. The magnetic core 2 is in the form of a cylindrical column, and is 240 mm in length. In this embodiment, a small magnetic core which is 120 $mm^2$ in cross-section as seen from the direction X in FIG. 3 (which is parallel to generatrix, or rotational axis, of fixation sleeve 1) was used as the magnetic core 2.

The excitation coil 3 is formed by spirally winding a piece of ordinary electrically conductive wire around the magnetic core 2. It is disposed in the hollow of the fixation sleeve 1. That is, the excitation coil 3 is wound around the magnetic core 2, directly or with the placement of a bobbin or the like component, between itself and magnetic core 2, in the direction which is intersectional to the generatrix of the fixation sleeve 1, in such a manner that the portions of the excitation coil 3, which correspond to the lengthwise end portions of the open magnetic passage, are narrower in the winding interval than the center portion. The reason why the excitation coil 3 is wound in the above-described manner is given later.

Part (a) of FIG. 2 is a drawing for more concretely illustrating the winding interval. The number of windings of the excitation coil 3 around the magnetic core 2 which is 240 mm in length is 18. The winding interval is 10 mm across the lengthwise end portions, 20 mm across the center portion, and 15 mm across the portion between the lengthwise end portion and center portion. The excitation coil 3 is wound in the direction which is intersectional to the generatrix direction X of the excitation coil 3. Therefore, as high frequency electric current (alternating electric current) is flowed through the excitation coil 3 by way of power supply contacts 3*a* and 3*b*, with the use of a high frequency converter 16, or the like, magnetic flux, which is parallel to the direction which is parallel to the generatrix of the fixation sleeve 1 is generated.

(2-1) Heat Generation Mechanism of Fixing Device

Next, referring to part (a) of FIG. 9, the heat generation mechanism of the fixing device A is described. As alternating electric current is flowed through the excitation coil 3, magnetic flux is generated in such a manner that it permeates through the magnetic core 2, which is on the inward side of the heat generation layer 1*a*, in the direction parallel to the generatrix of the heat generation layer 1*a* (S-to-N direction), comes out of one end (N) of the magnetic core 2, permeates outward of the heat generation layer 1*a*, and permeates back to the other end (S) of the magnetic core 2. Thus, electric current is induced in the heat generation layer 1*a*. This electric current flows in the direction to contradict the fluctuation of the magnetic force in terms of direction and strength.

Thus, the heat generation layer 1*a* is made to generate Joule's heat by this electric current induced in the heat generation layer 1*a*. The amount of the current inducing voltage V generated in the heat generation layer 1*a* is proportional to (i) the amount ($\Delta\phi/\Delta t$) by which the magnetic flux, which passes through the heat generation layer 1*a*, changes per unit length of time, and (ii) the winding count N of the coil.

$$V=-N(\Delta\Phi/\Delta t) \quad (500)$$

(2-2) Relationship Between Ratio of Magnetic Flux which Permeates on Outward Side of Heat Generation Layer 1*a*, and Electric Power Conversion Efficiency.

By the way, the magnetic core 2 shown in part (a) of FIG. 9 does not form a loop. That is, it has lengthwise ends. In the case of a fixing device, the magnetic core 2 of which is endless (forms loop, half of which is on outward side of heat generation layer 1*a*), the magnetic flux is guided out of the inward side of the heat generation layer 1*a*, and guided back into the inward side of the heat generation layer 1*a* by the magnetic core 2*a*.

However, in a case where a magnetic core is like the magnetic core 2 in this embodiment, that is, it is not endless, there is nothing that guides the magnetic flux as the magnetic flux comes out of the magnetic core 2 from one of the lengthwise ends of the magnetic core 2. Thus, it is possible that as the magnetic flux comes out of the magnetic core 2 through one of the lengthwise ends of the magnetic core 2, it will take both the outside route relative to heat generation layer 1*a*, and also, the inside route, to return to the other end.

Hereafter, the route which leads from the N pole of the magnetic core 2 to the S pole of the magnetic core 2 on the outward side of the heat generation layer 1*a*, is referred to as "outside route", whereas the route which leads from the N pole of the magnetic core 2 to the S pole of the magnetic core 2, on the inward side of the heat generation layer 1*a*, is referred to as "inside route".

There is a correlation between the ratio of the portion of the magnetic flux, which takes the outside route as it comes out of the magnetic core 2 through one of the lengthwise ends of the magnetic core 2, and the amount (electric power conversion ratio) by which the electric power supplied to the excitation coil 3 is consumed for the generation of heat in the heat generation layer 1*a*. Thus, this ratio of the portion of the magnetic flux which takes the outside route is an important parameter. The greater the ratio of the magnetic flux which takes the outside route, the higher the ratio (electric power conversion efficiency) by which the electric power supplied to the excitation coil 3 is consumed for the heat generation in the heat generation layer heat 1*a*.

The reason for the occurrence of this phenomenon is the same in principle as that for the occurrence of the phenomenon that in a case where a transformer is satisfactorily small in magnetic flux leakage, and the primary and secondary coils of the transformer are the same in the amount of the magnetic flux which permeates through them, the transformer is high in electric power conversion efficiency. That is, in this embodiment, the closer the amount of the magnetic flux which permeates through the magnetic core 2, to the amount of the magnetic flux which permeates through the outside route, the higher the electric power conversion efficiency, that is, the higher the efficiency with which the high frequency electric current flowed through the excitation coil 3 is converted into the electric current that flows through the heat generation layer 1*a* in the circumferential direction of the heat generation layer 1*a*.

This occurs for the following reason. Referring to part (a) of FIG. 9, the magnetic flux which permeates from the S pole to the N pole through the magnetic core 2, and the magnetic flux which takes the inside route, are opposite in direction. The magnetic flux which takes the outside route and the magnetic flux which takes the inside route cancel each other out, on the inward side of the heat generation layer 1*a*, including the magnetic core 2. Thus, the magnetic flux which permeates and is induced in the direction from the S pole toward the N pole, on the inward side of the heat generation layer 1*a*, becomes smaller, and therefore, the amount by which the magnetic flux changes per unit length of time is decreased. As the magnetic flux reduces in the amount by which it changes per unit length of time, the current inducing voltage V which is generated in the heat generation layer 1*a* by the magnetic flux is decreased, and therefore, the amount by which heat is generated in the fixation sleeve 1 is decreased.

As will be evident from what was described above, from the standpoint of ensuring that the fixing device in this embodiment remains high in electric power conversion efficiency, it is important to control the ratio of the magnetic flux which takes the outside route.

(2-3) Index which Indicates Ratio of Magnetic Flux which Passes on Outward Side of Electrically Conductive Layer 1*a*

Thus, the ratio of the magnetic flux which takes the outside route in the fixing device A is expressed in terms of index which is referred to as permeance. To begin with, a general concept of a magnetic circuit is described. What the electric circuit is to the passage through which electric current flows is what the magnetic circuit is to the passage through which magnetic flux permeates. The amount by which the magnetic flux permeates through the magnetic circuit can be calculated with the use of a method similar to the method for calculating the amount by which electric current flows through an electric circuit. To the magnetic circuit, Ohm's law, which is related to an electric circuit, is applicable. Thus, the mathematical expression (501) is satisfied, in which Φ stands for an amount of magnetic flux, which corresponds to the amount of the electric current in an electric circuit; V, the magnetic force generating voltage, which corresponds to the current inducing force; and R stands for magnetic resistance which corresponds to electrical resistance.

$$\Phi=V/R \tag{501}$$

Here, however, for the purpose of making it easier to understand this principle, the principle is described using "permeance P", which is an inverse number of the magnetic resistance R. With the use of permeance P, the mathematical expression (501) given above is expressible as follows:

$$\Phi=V\times P \tag{502}$$

Further, permeance P is also expressible as follows, in which B stands for the length of the magnetism passage; S stands for the size of the cross-sectional size of the magnetism passage; and μ stands for the permeability of the magnetism passage.

$$P=\mu\times S/B \tag{503}$$

Permeance P is proportional to the cross-sectional size S and permeability μ, and is inversely proportional to the magnetism passage length B.

Part (a) of FIG. 10 is a schematic drawing of the combination of the electrically conductive layer 1*a*, magnetic core 2, and excitation coil 3. The magnetic core 2 is a1 [m] in radius, B [m] in length, and μ1 in specific permeability. The excitation coil 3 is spirally wound N [times] around the magnetic core 2 in such a manner that the axial line of the spiral coil becomes roughly parallel to the generatrix direction of the electrically conductive layer 1*a*. The electrically conductive layer 1*a* is an electrically conductive component which is B [m] in length, 2 [m] in internal diameter, 3 [m] in external diameter, and μ2 in specific permeability. The air on the outward side of the electrically conductive layer 1*a*, and the air on the inward side of the electrically conductive layer 1*a* are μ0 [H/m] in permeability. ϕc(x) stands for the amount of magnetic flux 8 which is generated per unit length of magnetic core 2 as electric current I [A] is flowed through the excitation coil 3.

Part (b) of FIG. 10 is a schematic sectional view of the magnetic core 2, at a plane which is perpendicular to the lengthwise direction of the magnetic core 2. In the drawing, arrows represent the magnetic flux which is generated in parallel to the lengthwise direction of the magnetic core 2, on the inward and outward sides of the electrically conductive layer 1*a* as the electric current I is flowed through the excitation coil 3. Φc (=ϕc(x)) stands for the amount of magnetic flux which moves through the magnetic core 2. Φa-in stands for the amount of magnetic flux which permeates on the inward side (area between electrically conductive layer 1*a* and magnetic core 2) of the electrically conductive layer 1*a*. Φs stands for the amount of magnetic flux which permeates through the electrically conductive layer 1*a*. Φa-out stands for the amount of magnetic flux which permeates on the outward side of the electrically conductive layer 1*a*.

Part (a) of FIG. 11 is the equivalent magnetic circuit, per unit length, of the space which includes the magnetic core 2, excitation coil 3, and electrically conductive layer 1*a*, shown in part (a) of FIG. 9. Vm stands for the amount of magnetomotive force, and Pc stands for the amount of permeance of the magnetic core 2. Pa-in stands for the amount of permeance on the inward side of the electrically conductive layer 1*a*, and Ps stands for the amount of permeance of the electrically conductive layer 1*a* itself, and Pa-out stands for the amount of permeance on the outward side of the electrically conductive layer 1*a*.

It is assumed here that when Pc is large enough compared to Pa-in and Ps, the magnetic flux permeates through the magnetic core 2 and comes out the magnetic core 2 through one of the lengthwise ends of the magnetic core 2, and returns to the other ends of the magnetic core 2 through one among the outside route, electrically conductive layer 1*a*, and inside route. Thus, there is a relationship among them which is expressible in the forms of the mathematical expression (504).

$$c=\phi a_\text{in}+\phi s+\phi a_\text{out} \tag{504}$$

Further, the relationship among ϕa-in, ϕs, ϕa-out can be expressed in the form of the mathematical expressions.

$$\phi c=Pc\times Vm \tag{505}$$

$$\phi s=Ps\times Vm \tag{506}$$

$$\phi a_\text{in}=Pa_\text{in}\times Vm \tag{507}$$

$$\phi a_\text{out}=Pa_\text{out}\cdot Vm \tag{508}$$

Thus, as the terms in mathematical expression (504) are substituted with (505)-(506), Pa-out is expressible in the form of the mathematical expression (509).

$$\begin{aligned} Pc\times Vm &= \text{Pa_in}\times Vm + Ps\times Vm + \text{Pa_out}\times Vm = \\ &\quad (\text{Pa_in} + Ps + \text{Pa_out})\times Vm \\ \therefore \text{Pa_out} &= Pc - \text{Pa_in} - Ps \end{aligned} \tag{509}$$

Thus, based on part (b) of FIG. 10, Pc, Pa-in, Ps can be expressed as "permeability×cross-section size" as follows, in which Sc stands for the cross-sectional size of the magnetic core 2; Sa-in, the internal cross-sectional size of the electrically conductive layer 1*a*; and Ss stands for the cross-sectional size of the electrically conductive layer 1*a* itself. The unit of measurement is [H·m].

$$Pc=\mu 1\cdot Sc=\mu 1\cdot\pi(a1)^2 \tag{510}$$

$$Pa_\text{in}=\mu 0\cdot Sa_\text{in}=\mu 0\cdot\pi\cdot((a2)^2-(a1^2) \tag{511}$$

$$Ps=\mu 2\cdot Ss=\mu 2\cdot\pi\cdot((a3)^2-(a2)^2) \tag{512}$$

Substituting Pc, Pa and Ps in Mathematical expression (509) with mathematical expressions (510), (511) and (512), Pa-out can be expressed in the form of the mathematical expression (513).

$$\begin{aligned} \text{Pa_out} &= Pc - \text{Pa_in} - Ps = \\ &\quad \mu 1\cdot Sc - \mu 0\cdot \text{Sa_in} - \mu 2\cdot Ss = \pi\cdot\mu 1\cdot(a1)^2 - \\ &\quad \pi\cdot\mu 0\cdot((a2)^2-(a1)^2) - \pi\cdot\mu 2\cdot((a3)^2-(a2)^2) \end{aligned} \tag{513}$$

With the use of mathematical expression (513) given above, it is possible to calculate the ratio (Pa-out/Pc) of the amount of magnetic flux which permeates on the outward side of the electrically conductive layer 1*a*.

By the way, the magnetic resistance R may be used in place of permeance P. In a case where magnetic resistance R is used, the magnetic resistance R per unit length can be expressed as "1/(permeability×cross-sectional size)", because the magnetic resistance R is simply the inverse number of the permeance P. The unit of measurement is "1/(H·m)."

The specifications of the fixing device A which were obtained by the calculation based on the parameters of the fixing device A are shown in Table 1.

TABLE 1

| | Unit | Mag. core | Film guide | Inside of conductive layer | Conductive layer | Outside of conductive layer |
|---|---|---|---|---|---|---|
| Cross-sectional area | m^2 | 1.5E−04 | 1.0E−04 | 2.0E−04 | 1.5E−06 | |
| Specific permeability | | 1800 | 1 | 1 | 1 | |
| Permeability | H/m | 2.3E−3 | 1.3E−6 | 1.3E−6 | 1.3E−6 | |
| Permeance/ unit length | H · m | 3.5E−07 | 1.3E−10 | 2.5E−10 | 1.9E−12 | 3.5E−07 |
| Mag. Resistance/ unit length | 1/(H · m) | 2.9E+06 | 8.0E+09 | 4.0E+09 | 5.3E+11 | 2.9E+06 |
| Ratio of mag. flux | % | 100.0 | 0.0 | 0.1 | 0.0 | 99.9 |

The magnetic core 2 is formed of ferrite (1,800 in specific permeability), 14 [mm] in diameter, and $1.5\times10^{-4}$ [$m^2$] in cross-sectional size. The sleeve guide 6 is formed of PPS (polyphenyl sulfide) (1.0 in specific permeability), and is $1.0\times10^{-4}$ [$m^2$] in cross-sectional size. The electrically conductive layer 1*a* is formed of aluminum (1.0 in specific permeability), and is 24 [mm] in diameter, 20 [μm] in thickness, and $1.5\times10^{-6}$ [$m^2$] in cross-sectional size.

By the way, the cross-sectional size of the space between the electrically conductive layer 1*a* and magnetic core 2 was obtained by subtracting the cross-sectional size of magnetic core 2 and the cross-sectional size of the sleeve guide 6 from the cross-sectional size of the hollow of the electrically conductive layer 1*a*, which is 24 [mm] in diameter. The elastic layer 1*b* and release layer 1*c* are on the outward side of the electrically conductive layer 1*a*, and do not contribute to heat generation. Thus, in the case of a magnetic circuit model for calculating permeance, they may be deemed the same as layers of air which are on the outward side of the electrically conductive layer 1*a*. Therefore, they do not need to be taken into consideration. Based on Table 1, the values of Pc, Pa-in, and Ps become as follows.

$$Pc=3.5\times10^{-7}[H\cdot m]$$

$$Pa\text{-in}=1.3\times10^{-10}+2.5\times10^{-10}[H\cdot m]$$

$$Ps=1.9\times10^{-12}[H\cdot m]$$

Value of Pa-out/Pc can be calculated with the use of the above values and the mathematical expression (514).

$$Pa_\text{out}/Pc=(Pc-Pa_\text{in}-Ps)/Pc=0.999(99.9\%) \quad (514)$$

By the way, there are cases where the fixation sleeve 1 is made up of multiple sections aligned in the lengthwise direction of the magnetic core 2, with the presence of a gap between the adjacent two sections. If the gaps are filled with air, which may be deemed 1.0 in specific permeability, or a substance which is substantially smaller in specific permeability than the individual section, these magnetic cores are greater in overall magnetic resistance R, being therefore inferior in terms of the function to guide magnetic flux, than a solid magnetic core like the one in this embodiment.

A method for calculating the permeance of a magnetic core made up of multiple sections as described above is rather complicated. Next, a method for calculating the overall permeance of a magnetic core made up of multiple sections aligned with equal intervals, with the placement of a gap, or a sheet of nonmagnetic substance, between the adjacent two sections, is described. In this case, it is necessary to obtain the overall magnetic resistance of the magnetic core, obtain the magnetic resistance, per unit length, of the core, by dividing the obtained overall magnetic resistance, by the overall length of the core, and use the inverse number of the obtained magnetic resistance, per unit length, of the core, as the permeance, per unit length, of the core.

FIG. 12 is a drawing of the abovementioned magnetic core made up of multiple sections. It shows the structural configuration of the core in terms of the lengthwise direction of the core. It is assumed here that each of the magnetic core sections c1-c10 is Sc in cross-sectional size, μc in permeability, Lc is width, and also, that each of the gaps g1-g9 is Sg in cross-sectional size, μg in permeability, and Lg in width. The overall magnetic resistance Rm-all is given by the mathematical expression (515).

$$Rm_\text{all}=(Rm_c1+Rm_c2+\ldots+Rm_c10)+(Rm_g1+Rm_g2+\ldots+Rm_g9) \quad (515)$$

In the case of this structural configuration, the magnetic core sections are the same in shape and material, and also, all gaps are the same in width.

Therefore, there are relationships which are expressible in the form of the mathematical expressions, in which Σrm-c stands for the sum of Rm-c, and Σrm-g stands for the sum Rm-g.

$$Rm_\text{all}=(\Sigma Rm_c)+(\Sigma Rm_g) \quad (516)$$

$$Rm_c=Lc/(\mu c\cdot Sc) \quad (517)$$

$$Rm_g=Lg/(\mu g\cdot Sg) \quad (518)$$

Substituting Σrm-c and Σrm-g in mathematical expression (516) with mathematical expressions (517), and (518), the overall magnetic resistance Rm-all is expressed in the form of the mathematical expression (519).

$$\text{Rm_all}=\left(\sum \text{Rm_c}\right)+\left(\sum \text{Rm_g}\right)=(Lc/(\mu c\cdot Sc))\times10+(Lg/(\mu g\cdot Sg))\times9 \quad (519)$$

Thus, Rm, or the magnetic resistance, per unit length, of the magnetic core is expressible in the form of the mathematical expression (520), wherein Σlc is the sum of Lc; and Σlg is the sum of Lg.

$$Rm = \mathrm{Rm_all}/\left(\sum Lc + \sum Lg\right) = \mathrm{Rm_all}/(L \times 10 + Lg \times 9) \quad (520)$$

Therefore, Pm, or the permeance, per unit length, of the magnetic core 2 is expressed in the form of the mathematical expression (521).

$$Pm = 1/Rm = \left(\sum Lc + \sum Lg\right)/\mathrm{Rm_all} = \left(\sum Lc + \sum Lg\right)/\left[\left\{\sum Lc/(\mu c + Sc)\right\} + \left\{\sum Lg/(\mu g + Sg)\right\}\right] \quad (521)$$

Increasing the gap Lg leads to the increase (decrease in permeance) of the magnetic resistance of the magnetic core 2. Regarding the structure of the fixing device A in this embodiment, it is desired, based on the heat generation principle, that the fixing device A is designed so that the magnetic core 2 is small in magnetic resistance (large in permeance). Therefore, providing a magnetic core 2 with the above described gaps is rather undesirable. In some cases, however, in order to prevent a magnetic core 2 from being damaged, magnetic core 2 is formed of multiple sections, with the placement of a preset amount of gap between the adjacent two sections.

As will be evident from the foregoing descriptions, the ratio by which the magnetic flux takes the outside route can be expressed with the use of permeance or magnetic resistance of the core.

(2-4) Level of Efficiency of which Fixing Device A is Required in Electric Power Conversion Next, the level of electric power conversion efficiency of which the fixing device A in this embodiment is required is described. For example, in a case where the fixing device A is 80% in electric power conversion efficiency, 20% of electric power supplied to the fixing device A is consumed (converted into thermal energy) by the other components, such as the excitation coil 3 and magnetic core 2, than the electrically conductive layer 1*a*. That is, in the case of a fixing device which is low in electric power conversion efficiency, its magnetic core 2, excitation coil 3, etc., which are not intended to generate heat, generate heat, sometimes requiring means for cooling them.

By the way, in this embodiment, when it is necessary to cause the electrically conductive layer 1*a* to generate heat, high frequency alternating current is flowed through the excitation coil 3 to form an alternating magnetic field, which induces electric current in the electrically conductive layer 1*a*. In terms of a physical model, the electric power conversion efficiency of the fixing device A closely resembles that of the magnetic coupling of a transformer. Therefore, the equivalent circuit of the magnetic coupling of a transformer can be utilized to obtain the electric power conversion efficiency of the fixing device. The excitation coil 3 and electrically conductive layer 1*a* are magnetically connected by the alternating magnetic field. Therefore, the electric power supplied to the excitation coil 3 is transmitted to the electrically conductive layer 1*a*.

Here, "electric power conversion efficiency" means the ratio of the amount by which the electric power supplied to the excitation coil 3, which is a magnetic field generating means, is consumed by the electrically conductive layer 1*a*, relative to the amount by which electric power is supplied to the excitation coil 3. In this embodiment, it is the ratio of the amount by which the electric power supplied to the high frequency converter to supply the excitation coil 3 with high frequency alternating current, is consumed by the electrically conductive layer 1*a*. This electric power conversion efficiency is expressible in the form of the mathematical expression (522).

Electric power conversion efficiency=(electric power consumed by the electroconductive layer)/(electric power supplied to the excitation coil) (522)

A certain portion of the electric power supplied to the excitation coil 3 is consumed by the other components of the fixing device A than the electrically conductive layer 1*a*. For example, there are losses attributable to the electrical resistance of the excitation coil 3, loss attributable to the magnetic properties of the material for the magnetic core 2, etc.

FIG. 13 is a drawing for describing the circuit efficiency. Referring to part (a) of FIG. 13, a referential code 1*a* stands for electrically conductive layer, and a referential code 2 stands for a magnetic core 2. A referential code 3 stands for excitation coil. Part (b) of FIG. 13 is a drawing of the equivalent circuit, in which R1 stands for the amount by which the electric power supplied to the excitation coil 3 is lost (consumed) by the excitation coil 3 and magnetic core 2; L1, the inductance of the excitation coil 3 spirally wound around the magnetic core 2; M1, the mutual inductance between the spirally wound wire and electrically conductive layer 1*a*; L2, the inductance of the electrically conductive layer 1*a*; and R2 stands for the resistance of the electrically conductive layer 1*a*.

Part (a) of FIG. 14 is a drawing of the equivalent circuit when the electrically conductive layer 1*a* is not around the combination of the magnetic core 2 and excitation coil 3. The impedance ZA of the excitation coil 3 as seen from the lengthwise ends can be expressed in the forms of the mathematical expression (523), in which R1 and L1 stands for the measured equivalent linear resistance and inductance, respectively, of the excitation coil 3, as seen from the lengthwise ends.

$$Z_A = R_1 + j\omega L_1 \quad (523)$$

The electric current which flows into this circuit is lost by R1, by a certain amount. That is, R1 represents the loss attributable to the excitation coil 3 and magnetic core 2.

Part (b) of FIG. 14 is a drawing of the equivalent circuit when the electrically conductive layer 1*a* is around the combination of magnetic core 2 and excitation coil 3. As long as the equivalent serial resistances Rx and Lx are measured in advance when the electrically conductive layer 1*a* is around the combination of the magnetic core 2 and excitation coil 3, the mathematical expression (529), in which M stands for the mutual inductance between the excitation coil 3 and fixation sleeve 1 can be obtained by equivalently converting mathematical expression (523) as shown in part (c) of FIG. 14. Referring to part (c) of FIG. 14, mathematical expressions (525), (526), (527), (528) and (529) can be obtained, in which I1 and I2 stand for the electric currents which flow into R1 and R2, respectively. The efficiency (electric power conversion efficiency) is expressed as (electric power consumption of resistance R2)/(electric power consumption of resistance R1+electric power consumption of resistance R2), which is a mathematical expression (529).

$$Z = R1 + j\omega(L1 - M) + \frac{j\omega M(j\omega(L2 - M) + R2)}{j\omega M + j\omega(L2 - M) + R2} \tag{524}$$

$$= R1 + \frac{\omega^2 M^2 R_2}{R_2^2 + \omega^2 L_2^2} + j(\omega(L_1 - M) + \frac{M - R_2^2 + \omega^2 M L_2(L_2 - M)}{R_2^2 + \omega^2 L_2^2}$$

$$Rx = R_1 + \frac{\omega^2 M^2 R_2}{R_2^2 + \omega^2 L_2^2} \tag{525}$$

$$Lx = \omega(L_1 - M) + \frac{M - R_2^2 + \omega^2 M L_2(L_2 - M)}{R_2^2 + \omega^2 L_2^2}\Bigg) \tag{526}$$

$$j\omega M(I_1 - I_2) = (R_2 + j\omega(L_2 - M))I_2 \tag{527}$$

$$I_1 = \frac{R_2 + j\omega L_2}{j\omega M} I_2 \tag{528}$$

$$\text{Conversion } Eff. = \frac{R_2 \times |I_2^2|}{R_1 \times |I_1^2| + R_2 \times |I_2^2|} = \frac{\omega^2 M^2 R_2}{\omega^2 L_2^2 R_1 + R_1 R_2^2 + \omega^2 M^2 R_2} = \frac{Rx - R_1}{Rx} \tag{529}$$

By measuring the serial equivalent resistance R1 of the electrically conductive layer 1*a* when the electrically conductive layer 1*a* is not around the magnetic core 2, and the serial equivalent resistance Rx of the electrically conductive layer 1*a* when the electrically conductive layer 1*a* is around the magnetic core 2, it is possible to obtain the electric power conversion efficiency, which indicates how much of the electric power supplied to the excitation coil 3 is consumed by the electrically conductive layer 1*a*. By the way, in this embodiment, an Impedance analyzer 4294A (product of Agilent Technologies, Co., Ltd.) was used to measure the electric power conversion efficiency.

First, the amount of the equivalent serial resistance R1 of the electrically conductive layer 1*a*, between the lengthwise ends, was measured when the fixation sleeve 1 was not around the combination of the magnetic core 2 and excitation coil 3. Then, the amount of the equivalent serial resistance Rx of the electrically conductive layer 1*a*, between the lengthwise ends, after the insertion of the magnetic core 2 into the fixation sleeve 1. The values of R1 and Rx were 103 mΩ and 2.2Ω (R1=103 mΩ; Rx=2.2Ω). Thus, the electric power conversion efficiency calculated with the use of the mathematical expression (529) was 95.3%. The following is the evaluation of the performance of the fixing device A in terms of electric power conversion.

First, the electric power conversion efficiency level of which the fixing device A was required was obtained. More concretely, the fixing device A was varied in the ratio of the portion of the magnetic flux which takes the outside route (with reference to electrically conductive layer 1*a*), to evaluate the fixing device A in terms of electric power conversion efficiency. FIG. 15 is a drawing of an apparatus used to measure the electric power conversion efficiency of the fixing device A. A metallic sheet 1S is formed of aluminum, and is 230 mm in width, 600 mm in length, and 20 μm in thickness. This metallic sheet 1S was cylindrically bent in such a manner that it surrounded the combination of the magnetic core 2 and excitation coil 3, and its two edges which were parallel to the lengthwise direction of the combination, were connected at the solid bold line 1ST in the drawing to form an electrically conductive cylinder which was equivalent to the electrically conductive layer 1*a*.

The magnetic core 2 was cylindrical, and was formed of ferrite which was 1,800 in specific permeability, and 500 in saturation magnetic flux density, 26 $mm^2$ in cross-sectional size, and 230 mm in length. The magnetic core 2 was disposed at roughly the center of the cylinder formed of the aluminum sheet 1S with the use of unshown fixing means. The excitation coil 3 was spirally wound 25 times around the magnetic core 2. The electrically conductive layer (aluminum cylinder) was adjustable in diameter (1 SD), within a range of 18-192 mm, by pulling the metallic sheet 1S by one of the abovementioned edges.

FIG. 16 is a graph which shows relationship between the electric power conversion efficiency and the ratio of the magnetic flux which permeated on the outside of the electrically conductive layer 1*a*. The horizontal axis of the graph represent the ratio [%] of the portion of the magnetic flux, which permeates on the outward side of the electrically conductive layer (aluminum cylinder), and the vertical axis represents the electric power conversion efficiency when the electric power was 21 kHz in frequency. Referring to FIG. 16, as the ratio of the portion of the magnetic flux which took the outside route was increased beyond a point P1, the fixing device sharply increased in electric power conversion efficiency to no less than 70%, and remained no less than 70% in a range R1 indicated by a two-headed arrow mark. The fixing device sharply increased in electric power conversion efficiency in the adjacencies of a point P3 in a range R3, and remained no less than 80% in a range R2 indicated by another two-headed arrow mark. In a range R4, which is higher in the ratio of the magnetic flux which permeated on the outward side of the electrically conductive layer 1*a*, than the range R3, the fixing device was stable in electric power conversion efficiency, being no less than 94%. This sudden increase in the electric power conversion efficiency indicates that the electric current began to efficiency flow in the electrically conductive layer (aluminum cylinder) in the circumferential direction of the layer.

The following Table 2 shows the results of the evaluation of fixing devices designed to realize the conditions which correspond to points P1-P4.

TABLE 2

| No. | Area | Diameter of conductive layer (mm) | Ratio of mag. Flux outside of conductive layer | Conversion Eff. (%) | Evaluation (high specification fixing device) |
|---|---|---|---|---|---|
| P1 | — | 143.2 | 64.0 | 54.4 | Electric power may be short |
| P2 | R1 | 127.3 | 71.2 | 70.8 | Cooling means is desired. |
| P3 | R2 | 63.7 | 91.7 | 83.9 | Optimization of thermal durability design is desired. |
| P4 | R3 | 47.7 | 94.7 | 94.7 | Optimum structure for flexible film |

(Fixing Device P1)

This fixing device P1 was structured so that it was 26.5 $mm^2$ (5.75 mm×4.5 mm) in the cross-sectional size of its magnetic core, 143.2 mm in the diameter of its electrically conductive layer, and 64% in the ratio of the magnetic flux which took the outside route. This device was 54.4% in the electric power conversion efficiency obtained with the use of the impedance analyzer. The electric power conversion efficiency is a parameter which indicates the amount by which the electric power supplied to a fixing device contributes to the heat generation in the electrically conductive layer. Thus, in the case of this fixing device designed so that its maximum output was 1,000 W, roughly 450 W was lost (consumed) to generate heat in the coil and core.

In a case where a fixing device is structured like the one in this embodiment, its coil temperature sometimes increases beyond 200° C. during a startup period, even if it is only several seconds that the device is supplied with 1,000 W of electric power. In consideration of the fact that the electrical insulator of the coil is roughly 200° C. in heat resistance, and the Curie point of the magnetic core formed of ferrite is normally in a range of 200° C.-250° C., in a case where the loss is 45%, it is rather difficult to keep the temperature of components such as an excitation coil within the safe range for the component. Further, as the temperature of the magnetic core exceeds Curie point, the coil suddenly reduces in inductance, triggering thereby load change.

In the case of this fixing device, roughly 45% of the electric power supplied to the fixing device is not used for generating heat in the electrically conductively layer. Therefore, in order to supply the electrically conductive layer with 900 W (90% of 1,000 W) of electric power, the fixing device has to be supplied with roughly 1,636 W of electric power. This means that the electrical power source of the fixing device has be capable of drawing 16.36 A of electric current, assuming that commercial power source is 100 V in voltage. Therefore, it is possible that the amount of electric power consumption by the fixing device will exceed the amount by which electric current can be drawn through a commercial attachment plug. Therefore, in the case of the fixing device P1, which is 54.4% in electric power conversion efficiency, it is possible that it will not be supplied with electric power by an amount which is sufficient for the device.

(Fixing Device P2)

In terms of the structure, this fixing device P2 was the same as the fixing device P1. It was 127.3 mm in the diameter of its conductive layer. The ratio of the magnetic flux which takes the outside route was 71.2%. The electric power conversion efficiency of this fixing device P2 obtained with the use of the impedance analyzer was 70.8%. The temperature increase of the coil and core sometimes becomes problematic, although it depends on the specifications of each fixing device. In order to turn this fixing device P2 into a high speed fixing device which is capable of outputting 60 prints per minute, the rotational speed of its electrically conductive layer has to be 330 mm/sec, and the temperature of its electrically conductive layer 1*a* has to be maintained at 180° C. If the temperature of the electrically conductive layer is kept at 180° C., it is possible that the temperature of the magnetic core will sometimes exceed 240° C. in 20 seconds.

The Curie temperature of ferrite which is used as the material for the magnetic core is normally in a range of 200° C.-250° C. Thus, it sometimes occurs that as the temperature of the magnetic core exceeds the Curie temperature of ferrite, the magnetic core suddenly reduces in permeability, and therefore, fails to properly guide the magnetic flux, which in turn makes it rather difficult for the magnetic core to induce the circumferential current in the electrically conductive layer to cause the electrically conductive layer to generate heat.

Thus, in a case where the fixing device, which is in the range R1 in the ratio of the magnetic flux which takes the outside route, is turned into the above described high speed device, it is desired that the fixing device is provided with a cooling means for reducing the magnetic core in temperature. As for the cooling means, a cooling fan, a water-based cooling system, a heat radiation plate, heat radiation fins, a heat pipe, a Peltier element, or the like may be employed. Needless to say, when it is unnecessary for the fixing device P2 to be as high in output as described above, the cooling means is unnecessary.

(Fixing Device P3)

This fixing device P3 was the same in the cross-sectional size of its magnetic core as the fixing device P1. In a case where its electrically conductive layer was 63.7 mm in diameter, the electric power conversion efficiency of this fixing device P3 which was obtained with the use of the impedance analyzer was 83.9%. Thus, heat was continuously generated in the magnetic core, excitation coil, etc. However, the amount by which heat was generated was not large enough to make it necessary for the fixing device to be provided with a cooling means.

In order to turn this fixing device P2 into a high speed fixing device which is capable of outputting 60 prints per minute, the rotational speed of its electrically conductive layer has to be increased to 330 mm/sec, and sometimes, the surface temperature of its electrically conductive layer 1*a* of this fixing device P2 may have to be kept at 180° C. But it never occurs that the temperature of the magnetic core (ferrite) exceeds 220° C. Thus, in a case where this fixing device P3 needs to be turned into a high speed device, it is desired that such ferrite that is no less than 220° C. in Curie temperature is used as the material for the magnetic core.

As will be evident from the foregoing description of this fixing device P3, in a case where it is necessary for the fixing device to be in the range R2 in terms of the ratio of the magnetic flux which permeate though the outside route, it is desired that the fixing device is optimized in design in terms of heat resistance (ferrite properties). On the other hand, in a case where the fixing device P3 is not required to be a high speed device, heat resistant design such as the above describe one is unnecessary.

(Fixing Device P4)

This fixing device P4 was the same in the cross-sectional size of its magnetic core as the fixing device P1. Its electrically conductive cylindrical component was 47.7 mm in diameter. The electric power conversion efficiency of this fixing device P4 which was obtained with the use of the impedance analyzer was 94.7%. Thus, even in a case where this fixing device P4 is turned into a high speed device which is capable of outputting 60 prints per minute (330 mm/sec in rotational speed of its electrically conductive layer), it will not occur that the temperature of the excitation coil, magnetic core, etc., reaches higher than 180° C., even if the surface temperature of its electrically conductive layer is kept at 180° C. Thus, it is not necessary for the fixing device P4 to be specifically designed in terms of heat resistance; it is not necessary for the device to be provided with a cooling means for cooling the magnetic core, excitation coil, etc.

It is evident from the description of the fixing device P4 in this embodiment that in the range R3 in which the ratio of the magnetic flux which permeates through the outside route is no less than 94.7, the electric power conversion efficiency of the fixing device P4 is no less than 94.7%, that is, it is sufficiently high. Thus, even if it is turned into a high speed fixing device, it does not require a cooling means.

Further, in the range R3 in which the electric power conversion efficiency of the fixing device P4 remained high at a high level, even if the fixing device P4 slightly changes, per unit length of time, in the amount of the magnetic flux which permeates on the inward side of the electrically conductive layer, because of the changes in the positional relationship between the electrically conductive layer and excitation coil, the amount by which the fixing device changes in the electric power conversion efficiency is small. Therefore, it remains stable in the amount of heat generation in the electrically conductive layer 1*a*. In the case of a fixing device, such as the one that employs a flexible film as the substrate of its heat generation component, which tends to change in the distance between its electrically conductive layer and magnetic core, keeping the electric power conversion efficiency stable in the range R3 provides substantial merit.

It is evident from the foregoing description of the fixing device P4 in this embodiment that in order for the fixing device P4 to be satisfactory in terms of the electric power conversion efficiency, the device P4 has to be no less than 72% in the ratio of the magnetic flux which takes the outside route. According to Table 2, the ratio has only to be no less than 71.2%. However, it is desired to be to 72% or higher, in consideration of measurement errors or the like.

(2-5) Mathematical Expressions Related to Permeance or Magnetic Resistance, which Fixing Device is to Satisfy That the ratio of the magnetic flux which permeates on the outward side of the electrically conductive layer is no less than 70% is equivalent to that the sum of the permeance of the electrically conductive layer and the permeance of the air in the space between the electrically conductive layer and magnetic core is no more than 28% of the permeance of the magnetic core. One of the characteristic features of the structure of the fixing device in this embodiment is that the relationship among the permeance Pc of the magnetic core, permeance Pa of the air in the space between the electrically conductive layer and magnetic core, and permeance Ps of the electrically conductive layer satisfies the following mathematical expression (529).

$$0.28\times Pc\geq Ps+Pa \tag{529}$$

Substituting the magnetic resistances in mathematical expression (529) for permeances provides the following mathematical expression (530). However, a combined magnetic resistance Rsa between magnetic resistances Rs and Ra is to be calculated with the use of the following mathematical expression (531).

$$0.28\times P_C \geq P_s + P_a \tag{530}$$

$$0.28\times \frac{1}{Rc} \geq \frac{1}{R_s} + \frac{1}{R_s}$$

$$0.28\times \frac{1}{Rc} \geq \frac{1}{R_{sa}}$$

$$0.28\times R_{sa} \geq Rc$$

$$\frac{1}{R_{sa}} = \frac{1}{R_s} + \frac{1}{R_a} \tag{531}$$

$$R_{sa} = \frac{R_a \times R_s}{R_a + R_s}$$

Rc: magnetic resistance of magnetic core,

Rs: magnetic resistance of electrically conductive layer,

Ra: magnetic resistance of the air in the space between electrically conductive layer and magnetic core, Rsa: magnetic resistance composed of Rs and Ra.

It is desired that the foregoing mathematical expressions which show the relationship in terms of permeance or magnetic resistance, among the electrically conductive layer, magnetic core, and air in the space between the electrically conductive layer and magnetic core, are satisfied by the fixing device at any cross-section perpendicular to the direction parallel to the generatrix of the cylindrical rotational component, across the entirety of the path of the largest sheet of recording medium conveyable through the fixing device.

Similarly, in consideration of the fact that in the range R2, the fixing device in this embodiment is no less than 92% (numerical value in Table 2 is no less than 91.7%) in electric power conversion efficiency. However, it is thought that it should be no less than 92% in consideration of measurement error or the like) in the ratio of the magnetic flux which permeates on the outward side of the electrically conductive layer. That the fixing device is no less than 92% in the ratio of the magnetic flux which permeates on the outward side of the electrically conductive layer is equivalent to that the fixing device is no more than 8% in the permeance of its electrically conductive layer. The mathematical expression which shows the relationship among these permeances is as follows.

$$0.08\times Pc\geq Ps+Pa \tag{532}$$

The above given mathematical expression (532) about the permeances can be converted into the following mathematical expression (533) which shows the relationship among the magnetic resistances.

$$0.08\times P_C\geq P_s+P_a$$

$$0.08\times R_{s\ a}\geq Rc \tag{533}$$

Further, in the range R3, the fixing device in this embodiment is no less than 95% in the ratio of the magnetic flux which permeates on the outward side of the electrically conductive layer. Precisely speaking, it is no less than 94.2% according Table 2, however, it is set to 94.7% in consideration of the measurement errors and the like. The relationship among the permeances can be expressed in the form of the following mathematical expression (534). That the fixing device is no less than 95% in the ratio of the magnetic flux which permeates on the outward side of the electrically conductive layer is equivalent to that the sum of the permeance of the electrically conductive layer and the sum of the permeance of the air in the space between the electrically conductive layer and magnetic core is no greater than 5% of the permeance of the magnetic core 2. The mathematical expression (534) which shows the relationship among these permeances is as follows.

$$0.05\times Pc\geq Ps+Pa \tag{534}$$

The above given mathematical expression (534) about the permeances is convertible into the following mathematical expression (535) which shows the relationship among the magnetic resistances.

$$0.05\times P_C\geq P_s+P_a$$

$$0.05\times R_{s\ a}\geq Rc \tag{535}$$

By the way, the mathematical expressions which were given in the foregoing were for showing the relationship among the permeances, and the relationship among the magnetic resistances, of a fixing device, the components, sections thereof, etc., of which are uniform in cross-sectional size in terms of the lengthwise direction of the device, across the entirety of the path of the largest sheet of recording medium conveyable through the fixing device. Next, a fixing device, the structural components, sections thereof, etc., of which are nonuniform in cross-sectional size in terms of the lengthwise direction of the device is described. Referring to FIG. 17, the fixing device is provided with a temperature detection component 240, which is on the inward side of the electrically conductive layer (in space between magnetic core and electrically conductive layer). Otherwise, this fixing device is the same in structure as the fixing device A in the first embodiment. That is, this fixing device A is provided with a fixation sleeve 1 having the electrically conductive layer 1*a*, a magnetic core 2, and a sleeve guide 6 (sleeve backing component).

In terms of the lengthwise direction of the magnetic core 2, that is, the direction parallel to the axial line X of the magnetic core 2, the path of the largest sheet of recording medium conveyable through the fixing device corresponds to 0-Lp range of the axis X. For example, in a case of an image forming apparatus structured so that in terms of the direction perpendicular to the recording medium conveyance direction, the largest (widest) sheet of recording medium conveyable through the recording medium passage of the apparatus is a sheet of recording medium of LTR size, which is 215.9 mm in width, all that is necessary to do is to set Lp to 215.9 mm (Lp=215.9 mm). The temperature detection component 240 is formed of a nonmagnetic substance which is 1 in specific permeability. The temperature detection component 240 (which hereafter will be referred to as temperature sensor 240) is 5 mm×5 mm in cross-sectional size in terms of the direction perpendicular to the axis X, and 10 mm in length in terms of the direction parallel to the axis X. It is disposed within a range which corresponds to the range of the axis X, which is between points L1 (102.95 mm from left lateral edge of recording medium passage, FIG. 17) and L2 (112.95 mm).

Here, the range between the points 0 and L1 on the axis X is referred to as range 1, and the range between the points L1 and L2, in which the temperature sensor 240 is present, is referred to as range 2. Further, the range between the points L2 and LP is referred to as range 3. Shown in part (a) of FIGS. 18 and 18(*b*) are the cross-sectional views of the heat generation unit, in the ranges 1 and 2, respectively. They show the structure of the heat generation unit. Referring to part (b) of FIG. 18, the temperature sensor 240 is on the inward side of the fixation sleeve 1. Therefore, it is one of the targets of the magnetic resistance calculation.

For the sake of strict magnetic resistance calculation, the "magnetic resistance, per unit length" of the magnetic core, in the ranges 1, 2 and 3, the magnetic resistance of the magnetic core is calculated in each range with the use of integration. Then, the thus obtained three magnetic resistances of the three portions of the magnetic core were added to obtain the overall magnetic resistance of the magnetic core. First, the magnetic resistance, per unit length, of the portion of the magnetic core, which is in the range 1 or that in the range 3 is shown in the following Table 3.

TABLE 3

| | Unit | Mag. core | Film guide | Inside of conductive layer | Conductive layer |
|---|---|---|---|---|---|
| Cross-sectional area | m^2 | 1.5E−04 | 1.0E−04 | 2.0E−04 | 1.5E−06 |

TABLE 3-continued

| | Unit | Mag. core | Film guide | Inside of conductive layer | Conductive layer |
|---|---|---|---|---|---|
| Specific permeability | | 1800 | 1 | 1 | 1 |
| Permeability | H/m | 2.3E−03 | 1.3E−06 | 1.3E−06 | 1.3E−06 |
| Permeance per unit length | H · m | 3.5E−07 | 1.3E−10 | 2.5E−10 | 1.9E−12 |
| Mag. Resistance per unit length | 1/(H · m) | 2.9E+06 | 8.0E+09 | 4.0E+09 | 5.3E+11 |

The magnetic resistance $r_{c1}$, per unit length, of the portion of the magnetic core, which is in the range 1, is as follows:

$$r_{c1}=2.9\times10^{6}[1/(H\cdot m)]$$

Here, the magnetic resistance $r_a$, per unit length, of the air in the space between the electrically conductive layer and magnetic core is the sum of the magnetic resistance $r_f$, per unit length, of the film guide, and the magnetic resistance $r_{air}$, per unit length, of the air in the space between the electrically conductive layer and magnetic core. Therefore, it can be calculated with the use of the following mathematical expression (536).

$$\frac{1}{r_a}=\frac{1}{r_f}+\frac{1}{r_{a1r}} \tag{536}$$

The results of the calculation are as follows:

$$r_{a1}=2.7\times10^{9}[1/(H\cdot m)]$$

$$r_{s1}=5.3\times10^{11}[1/(H\cdot m)]$$

The range 3 is the same as the range 1. Therefore, the results of the calculation are as follows, which are the same as those in the range 1.

$$r_{c3}=2.9\times10^{6}[1/(H\cdot m)]$$

$$r_{a3}=2.7\times10^{9}[1/(H\cdot m)]$$

$$r_{s3}=5.3\times10^{11}[1/(H\cdot m)]$$

Next, the magnetic resistance, per unit length, of each component of the heat generation unit, which corresponds in position to the range 2, is shown in the following Table 4.

TABLE 4

| | Unit | Mag. core | Film guide | Thermistor | Inside of conductive layer | Conductive layer |
|---|---|---|---|---|---|---|
| Cross-sectional area | m^2 | 1.5E−04 | 1.0E−04 | 2.5E−05 | 1.72E−06 | 1.5E−06 |
| Specific permeability | | 1800 | 1 | 1 | 1 | 1 |
| Permeability | H/m | 2.3E−03 | 1.3E−06 | 1.3E−06 | 1.3E−06 | 1.3E−06 |
| Permeance per unit length | H · m | 3.5E−07 | 1.3E−10 | 3.1E−11 | 2.2E−10 | 1.9E−12 |
| Mag. Resistance per unit length | 1/(H · m) | 2.9E+06 | 8.0E+09 | 3.2E+10 | 4.6E+09 | 5.3E+11 |

The magnetic resistance $r_{c2}$, per unit length, of the portion of the magnetic core, which corresponds in position to the range 2, is as follows.

$$r_{c2}=2.9\times10^{6}[1/(H\cdot m)]$$

The magnetic resistance $r_a$, per unit length, of the space between the electrically conductive layer and magnetic core is the sum of the magnetic resistance $r_f$, per unit length, of the film guide, the magnetic resistance $r_t$, per unit length, of the thermistor, and the magnetic resistance $r_{air}$, per unit length, of the space between the electrically conductive layer and magnetic core. Therefore, it can be calculated with the use of the following mathematical expression (537).

$$\frac{1}{r_a}=\frac{1}{r_t}+\frac{1}{r_f}+\frac{1}{r_{air}} \tag{537}$$

Therefore, the results of the calculation of the magnetic resistance $r_{a2}$, per unit length, and the magnetic resistance $r_{c2}$, which correspond in position to the range 2, are as follows.

$$r_{a2}=2.7\times10^{9}[1/(H\cdot m)]$$

$$r_{s2}=5.3\times10^{11}[1/(H\cdot m)]$$

The method for calculating the magnetic resistance $r_{a3}$, which corresponds in position to the range 3 is the same as the one used to calculate the counterparts which corresponds in position to the range fixation sleeve 1, and therefore, is not shown here.

Next, regarding the magnetic resistance $r_a$, per unit length, of the area between the electrically conductive layer and magnetic core, the reason why $r_{a1}$, $r_{a2}$ and $r_{a3}$ are assumed to be the same in value is described. Regarding the calculation of the magnetic resistance, which corresponds in position to the range 2, in the range 2, the body of the air in the space between the electrically conductive layer and magnetic core is smaller in cross-sectional size than those which correspond to the ranges 1 and 3 because of the presence of the temperature sensor 240, in the range 2. However, both the air in the space and thermistor 240 are 1 in specific permeability. Therefore, the magnetic resistance r2, which corresponds in position to the range 2, remains the same in magnetic resistance, regardless of the presence or absence of the temperature sensor 240.

That is, in a case where it is only a nonmagnetic component (components), beside air, that is between the electrically conductive layer and magnetic core, the magnetic resistance of this section may be calculated as if there is only air between the electrically conductive layer and magnetic core, because a component made of a nonmagnetic substance is virtually zero in specific permeability. However, in a case where a component formed of a magnetic substance (nickel, iron, silicon steel, or the like) is in a given portion of the space between the electrically conductive layer and magnetic core, it is desired that the magnetic resistance of this portion is separately calculated from the rest of the ranges.

The overall magnetic resistance R [A/Wb(1/H)] of the electrically conductive layer in terms of the direction parallel to the generatrix of the electrically conductive layer, which is the sum of the magnetic resistances r1, r2 and r3 [1/(H·m)], can be calculated with the use of the following mathematical expression (538).

$$R=\int_0^{L1} r1\,dl1+\int_1^{L2} r2\,dl1+\int_2^{Lp} r3\,dl1= r1(L1-0)+r2(L2-L1)+r3(LP-L2) \tag{538}$$

Therefore, the magnetic resistance Rs [H] of the portion of the magnetic core, which corresponds in position to the area between one lateral edge of the path of the largest (widest) sheet of recording medium conveyable through the fixing device, and the other lateral edge, can be calculated with the use of the following mathematical expression (539).

$$R_c=\int_0^{L1} r_c1\,dl1+\int_{L1}^{L2} r_c2\,dl1+\int_{L2}^{Lp} r_c3\,dl1= r_c1(L1-0)+r_c2(L2-L1)+r_c3(LP-L2) \tag{539}$$

Further, the combined magnetic resistance Ra [H] of the combination of the electrically conductive layer and the air in the space between the electrically conductive layer and magnetic core, which corresponds to the area between one lateral edge to the other, of the path of the largest (widest) recording medium conveyable through the fixing device, can be calculated with the use of the mathematical expression (540).

$$R_s=\int_0^{L1} r_s1\,dl1+\int_{L1}^{L2} r_s2\,dl1+\int_{L2}^{Lp} r_s3\,dl1= r_s1(L1-0)+r_s2(L2-L1)+r_s3(LP-L2) \tag{540}$$

The combined magnetic resistance Rs [H] of the portion of the electrically conductive layer, which corresponds to the area between one lateral edge to the other, of the path of the largest (widest) sheet of recording medium conveyable through the fixing device is obtainable with the use of the mathematical expression (541).

$$R_s = \int_0^{L1} r_s 1 dl 1 + \int_{L1}^{L2} r_s 2 dl 1 + \int_{L2}^{Lp} r_s 3 dl 1 = r_s 1(L1 - 0) + r_s 2(L2 - L1) + r_s 3(LP - L2) \quad (541)$$

Table 5 shows the permeance and magnetic resistance, per unit length, of each portion of each of the aforementioned electrically conductive layer, magnetic core, and the air in the space between the electrically conductive layer and magnetic core, which were obtained with the use of the mathematical expressions given above.

TABLE 5

| | Area 1 | Area 2 | Area 3 | Combined mag. resistance |
|---|---|---|---|---|
| Start of integration (mm) | 0 | 102.95 | 112.95 | |
| End of integration (mm) | 102.95 | 112.95 | 215.9 | |
| Distance (mm) | 12.95 | 10 | 102.95 | |
| Permeance per unit length pc[H · m] | 3.5E−07 | 3.5E−07 | 3.5E−07 | |
| Mag. Resistance per unit length rc[1/(H · m)] | 2.9E+06 | 2.9E+06 | 2.9E+06 | |
| Integration of mag. Resistance rc [A/Wb(1/H)] | 3.0E+08 | 2.9E+07 | 3.0E+08 | 6.2E+08 |
| Permeance per unit length pa[H · m] | 3.7E−10 | 3.7E−10 | 3.7E−10 | |
| Mag. Resistance per unit length ra[1/(H · m)] | 2.7E+09 | 2.7E+09 | 2.7E+09 | |
| Integration of mag. Resistance ra [A/Wb(1/H)] | 2.8E+11 | 2.7E+10 | 2.8E+11 | 5.8E+11 |
| Permeance per unit length ps[H · m] | 1.9E−12 | 1.9E−12 | 1.9E−12 | |
| Mag. Resistance per unit length rs[1/(H · m)] | 5.3E+11 | 5.3E+11 | 5.3E+11 | |
| Integration of mag. Resistance rs [A/Wb(1/H)] | 5.4E+13 | 5.3E+12 | 5.4E+13 | 1.1E+14 |

Based on Table 5 given above, the values of Rc, Ra and Rs become as follows.

$$Rc = 6.2\times10^{8}[1/(H\cdot m)]$$

$$Ra = 5.8\times10^{11}[1/(H\cdot m)]$$

$$Rs = 1.1\times10^{14}[1/(H\cdot m)]$$

Combined magnetic resistance Rsa between Rs and Ra can be calculated with the use of the following mathematical expression (542).

$$\frac{1}{R_{sa}} = \frac{1}{R_s} + \frac{1}{R_a} \quad (542)$$

$$R_{sa} = \frac{R_a \times R_s}{R_a + R_s}$$

Based on the above described calculation, $$Rsa = 5.8\times10^{11}[1/(H\cdot m)]$$

$$r_{s2} = 5.3\times10^{11}[1/(H\cdot m)]$$

Therefore, the following mathematical expression is satisfied.

$$0.28\times Rsa \geq Rc \quad (543)$$

As described above, all that is necessary to obtain the permeance or magnetic resistance of a fixing device, the electrically conductive layer of which is nonuniform in cross-sectional shape in terms of the direction parallel to the generatrix of the electrically conductive layer, is to divide the electrically conductive layer into multiple sections in terms of the generatrix direction of the electrically conductive layer, calculate the magnetic resistance of each section, and combine the calculated magnetic resistances of all the sections. However, if the object of the magnetic resistance measurement is a nonmagnetic component, its magnetic resistance may be calculated as if it is air, because a nonmagnetic substance is roughly the same in permeability as air.

Next, the components which need to be taken into consideration when permeance or magnetic resistance is calculated with use of the mathematical expressions given above are described. A component, which is at least partially in the path (0-Lp) of the largest (widest) sheet of recording medium, has to be taken into consideration when calculating the magnetic resistance of this section.

In comparison, in a case of a component which is on the outward side of the electrically conductive layer, its permeance or magnetic resistance does not need to be calculated, because, according to Faraday's law, the amount by which electric current is induced in the electrically conductive layer is proportional to the amount of chronological changes which occur to the magnetic flux which perpendicularly penetrate the circuit (electrically conductive layer), that is, it has no relation to the magnetic flux which is on the outward side of the electrically conductive layer. Further, a component which is outside the path of the largest (widest) sheet of recording medium, in terms of the generatrix direction of the electrically conductive layer, has no effect upon the heat generation in the electrically conductive layer. Therefore, the permeance or magnetic resistance of such a component does not need to be calculated.

(3) Printer Control

Referring to FIG. 2, the temperature detection elements 9, 10, and 11 of the fixing device A are disposed on the upstream side of the fixing device A in terms of the direction in which a sheet P of recording medium is conveyed to the fixing device A. Next, referring to part (b) of FIG. 2, in terms of the lengthwise direction, the temperature detection element 9, or one of the three temperature detection elements, is disposed at the center of the fixing device A, and other two (10 and 11) are symmetrically disposed relative to the central one, in the adjacencies of the lengthwise ends of the fixing device A, one for one. The temperature detection elements 9, 10 and 11 are thermistors or the like, of the non-contact type. With the use of these elements 9, 10, and 11, the surface temperature of the fixation sleeve 1 is kept at a preset target level.

The increase in the temperature of the so-called "out-of-sheet-path" areas of the fixing device A, that is, the areas which a sheet P of recording medium does not pass (for example, when a substantial number of small (narrower than largest (widest) sheets of recording medium are continuously conveyed for image formation) can be detected by the temperature detection elements 10 and 11, which are disposed in the adjacencies of the lengthwise ends of the fixation sleeve 1, one for one.

FIG. 3 includes a block diagram of the printer controlling section as well. The printer controller 41 (image processing section) controls the communication between the image forming apparatus 100 and a host computer 42 which is an external device, and the reception of image data. Further, it develops (converts) the received image data into printable information (generates image formation signals, based on received image data). Further, the printer controller 41 controls the serial communication for exchanging signals with the engine control section 43, while developing the image data into the printable information.

The engine control section 43 exchanges signals with the printer controller 41. Further, it controls the fixation temperature control section 44 of the printer engine, the electric power control section 46, and each of units 44-46 of the frequency control section 45 (frequency setting section), using serial communication.

Not only does the fixation temperature control section 44 control the temperature of the fixing device A, based on the temperature detected by the temperature detection elements 9, 10 and 11, but also, detects the anomalies, etc., of the fixing device A. The frequency control section 45 which functions as a frequency setting section, controls the high frequency converter 16 in frequency. The electric power control section 46, which functions as an electric power adjustment section, controls the electric power for the high frequency converter 16, by adjusting the voltage to be applied to the excitation coil 3. The operation of the frequency control section 45 in this embodiment is described in greater detail in Section (10), in which the frequency control in the first embodiment is described.

The host computer 42 of a printer system which has this printer control section transfers image data to the printer controller 41, and also, sets various conditions such as recording medium size, for the printer controller 41, based on the demands from a user.

(4) Detail of Heat Generation Principle part (a) of FIG. 19 is a drawing of the magnetic field at the moment when electric current is increasingly flowing in the direction indicated by an arrow mark I1 through the excitation coil 3. The magnetic core 2 guides the magnetic flux generated by the excitation coil 3, into itself, functioning as a component which forms a magnetic flux passage. Thus, the magnetic field is formed in such a pattern that the magnetic flux permeates mainly through the magnetic core 2, spreads at the lengthwise ends of the magnetic core 2, and reconnects with itself a substantial distance away from the peripheral surface of the magnetic core 2. Because of the limitation of the drawing in terms of size, the magnetic flux appears as if some portions of the magnetic flux fail to reconnect with themselves at the other end of the magnetic core 2 as they spread at the first end. Here, a cylindrical circuit 61 which is narrow in terms of the lengthwise direction of the magnetic core was fitted around the magnetic core in such a manner that the circuit 61 becomes perpendicular to the magnetic flux path. In the magnetic core 2, an alternating magnetic field (magnetic field which periodically changes in direction and magnitude with elapse of time) is formed.

Thus, such an electric force that works in the direction parallel to the circumferential direction of the circuit 61 is generated, the amount of which is proportional to the amount of changes, per unit length of time, in the magnetic field which perpendicularly penetrates the circuit 61 (Faraday's law). The amount of this force can be expressed in the form of the following mathematical expression (1).

$$V = -N\frac{\Delta\Phi}{\Delta t} \tag{1}$$

V: Inductive force,

N: Number of windings of coil, $\Delta\Phi/\Delta t$: Changes, per microscopic unit of time, in magnetic flux which perpendicularly penetrates circuit.

The electrically conductive layer 1*a* may be thought to be a large number of extremely narrow cylindrical circuits 61, which are in alignment in the lengthwise direction of the magnetic core, and in connection to each other. Therefore, the heat generation unit becomes as shown in part (b) of FIG. 19. As an electric current I1 is flowed through the excitation coil 3, an alternating magnetic field is formed in the magnetic core 2, thus, the entirety of the electrically conductive layer 1*a*, in terms of its lengthwise direction, is subjected to an inductive force which is perpendicular to the circumferential direction of the electrically conductive layer 1*a*. Consequently, circumferential electric current I2 flows across the entirety of the electrically conductive layer 1*a* as indicated by dotted lines.

The electrically conductive layer 1*a* has electrical resistance. Thus, as the circumferential electric current I2 flows, heat (Joule's heat) is generated in the electrically conductive layer 1*a* (heat generation layer). As long as the alternating magnetic field is continuously formed in the magnetic core 2, the circumferential electric current I2 continues to be induced while being changed in direction. This is the principle of the heat generation in the heat generation layer of the fixing device A structured in accordance with the present invention. By the way, in a case where the electric current I1 is high frequency alternating current, which is 50 kHz, for example, in frequency, the circumferential electric current I2 also becomes high frequency electric current which is 50 kHz in frequency.

Referring to part (b) of FIG. 19, an arrow mark 11 indicates the direction in which the circumferential electric current I1 flows through the excitation coil 3. Thus, the electric current induced by the magnetic field generated by the electric current which flows in the excitation coil 3 flows in the circumferential direction indicated by dotted lines 12, that is, the direction to cancel the alternating magnetic field generated by the electric current flowed through the excitation coil 3, across the entirety of the magnetic core 2. Referring to part (a) of FIG. 20 which is a drawing of a physical model of the induction of the electric current I2, is equivalent to the magnetic coupling between the primary coil 81, indicated by a solid line, of a transformer, and the secondary coil 82, indicated by a dotted line, of the transformer, which is coaxial with the primary coil 81.

The secondary coil 82 is in the form of a circuit, and has a resistor 83. As alternating voltage is generated by the high frequency converter 16, high frequency electric current is generated in the primary coil 81. Thus, the secondary coil 82 is subjected to inductive force. Consequently, electric current is induced in the secondary coil 82. This current is consumed (turned into heat) by the resistance 83. Here, the combination of the secondary coil 82 and resistor 83 is analogous to the combination of the heat generation layer 1*a*, and its resistance which generates Joule's heat in the heat generation layer 1*a*. part (b) of FIG. 20 is a drawing of the equivalent circuit of the transformer model shown in part (b) of FIG. 20. Referring to part (b) of FIG. 20, L1 stands for the inductance of the primary coil 81 in part (a) of FIG. 20, and L2 stands for the inductance of the secondary coil 82 in part (a) of FIG. 20. M stands for mutual inductance between the primary coil 81 and secondary coil 82, and R stands for the resistor 83. The circuit diagram (1) in part (b) of FIG. 20 can be converted into a circuit diagram (2) which is equivalent to circuit diagram (1).

In order to come up with a simpler model, it is assumed here that the mutual inductance M is sufficiently large, and L1, L2, and M are roughly the same in value (L1≈L2≈M). In this case, (L1−M) and (L2−M) are sufficiently small. Thus, the circuit diagram (1) in part (b) of FIG. 20 can be approximated into the circuit diagram (3) by way of circuit diagram (2).

It is assumed here that the heat generation unit structured as shown in part (b) of FIG. 19 can be substituted by the equivalent circuit (3) in part (b) of FIG. 20. Here, electrical resistance is described. Referring to FIG. 20(*b*-3), the impedance on the secondary side is equivalent to the circumferential electrical resistance R of heat generation (electrically conductive) layer 1*a*. As seen from the primary coil side, the impedance on the secondary side of the transformer is equivalent to resistance R' which is $R \times N^2$ (ratio between number of winding of primary coil and that of secondary coil).

Regarding the ratio N between the number of the windings of the primary coil and that of the secondary coil, if it is presumed here that the number of the windings of the primary coil is equivalent to the number of the windings of the excitation coil in the hollow of the electrically conductive layer 1*a* (18 times in this embodiment), and the heat generation layer 1*a* is one in the number of windings, the ratio N between the primary and secondary coils in terms of the number of windings may be thought to be 18 (N=18). Thus, it may be thought that R' equals $N^2R$, which equals $18^2R$ ($R'=N^2R=18^2R$). Thus, the greater the number of windings, the greater the equivalent resistance R in FIG. 20(*b*-3).

FIG. 20(*c*-2) is a simplified version of FIG. 20(*c*-1). It defines the combined impedance X. The combined impedance X is calculable with the use of the mathematical expression (2).

$$\frac{1}{X} = \frac{1}{R'} + \frac{1}{j\omega M}, \tag{2}$$

-continued $$(\omega = 2\pi f)$$

$$|X| = \frac{1}{\sqrt{\left(\frac{1}{R'}\right)^2 + \left(\frac{1}{\omega M}\right)^2}}$$

According to this expression, the combined impedance X has frequency-dependency in the second term (1/ωM). This means that the inductance M also contributes to the combined impedance, along with the resistance R'. Further, this means also that load resistance has frequency-dependency, since the dimension of impedance is [Ω].

Next, in order to understand the operation of the circuit, this phenomenon that the combined impedance changes according to frequency is quantitatively described. In a case where frequency is low, a circuit responds like a serial circuit. That is, inductance virtually short circuits. Thus, electric current flows toward the inductance. Conversely, in a case where frequency is high, inductance becomes virtually open-circuited, causing thereby electric current to flow toward the resistance R.

In other words, the combined impedance X displays such a behavior that when frequency is low, it is small, whereas when frequency is high, it is large. That is, if a power supply which is no less than 20 kHz in frequency is used, the combined impedance is greater in frequency (ω)-dependency. Therefore, if an electric power supply is no less than 20 kHz in frequency, the effect of the inductance M (term in mathematical expression) upon the combined impedance is not negligible. This simplified equivalent circuit is referred to later.

(5) Reason why Amount of Heat Generation is Less in Adjacencies of Lengthwise Ends of Magnetic Core At this time, a phenomenon that the portions of the electrically conductive layer 1*a* (heat generation layer), which correspond in position to the lengthwise end portions of the magnetic core 2, are smaller in the amount of heat generation than the center portion of the electrically conductive layer 1*a*, and therefore the heat generation unit become nonuniform in the amount of heat generation, is described in detail. Referring to part (a) of FIG. 21, the magnetic core 2 forms a linear and open magnetic circuit having magnetic poles NP and NS. For the sake of simplification in description, it is assumed here that, unlike the manner in which excitation coil 3 is wound in this embodiment as shown in FIGS. 3 and 4, a coil is wound in such a manner that the lengthwise end portions of the coil and the center portion of the coil become the same in winding interval.

More concretely, the magnetic core 2 is 240 mm in length. The excitation coil 3 is wound 18 times, and is uniform in winding interval, being 13 mm, across its entirety in terms of the lengthwise direction. The employment of an open magnetic flux path makes it possible to reduce a fixing device in size. However, it makes the lengthwise end portions of the heat generation layer smaller in the amount of heat generation than the center portion, as shown in part (b) of FIG. 12. That is, it makes the heat generation layer nonuniform in heat generation in terms of the lengthwise direction. In the first place, the reason why the heat generation layer becomes nonuniform in heat generation in terms of the lengthwise direction is closely related to the fact that the magnetic core 2 is not endless, and therefore, it forms an open magnetic path. More concretely, 5-1) The lengthwise end portions of the magnetic core become smaller in apparent permeability; and 5-2) The lengthwise end portions of the magnetic core become smaller in combined impedance, contribute to the occurrence of the above described phenomenon. Next, 5-1) and 5-2) are separately described in detail.

5-1) The Lengthwise End Portions of the Magnetic Core Become Smaller in Combined Impedance The illustration in FIG. 22 is for describing the phenomenon that the lengthwise end portions of the magnetic core are lower in "apparent permeability μ" than the center portion. Next, the reason for the occurrence of this phenomenon is described in detail. In a magnetic field H which is uniform in magnetic force, and in which magnetization of an object is roughly proportional to an external magnetic field, a magnetic flux density B of a space is expressible by the mathematical expression (3).

$$B=\mu H \tag{3}$$

That is, theoretically speaking, as a substance which is high in permeability μ is placed in a magnetic field H, the magnetic field H increases in magnetic flux density to B which is proportional to the permeability of the substance. In the case of the present invention, this space which is high in magnetic flux density is utilized as "magnetic flux path". There are an open magnetic flux path and a closed magnetic flux path, which is in the form of a loop formed by connecting one end of the open magnetic flux path to the other with the use of a magnetic substance. The primary characteristic of the present invention is that an open magnetic flux path is employed.

FIG. 23 is a schematic drawing which shows the magnetic flux pattern which occurs as a ferrite 201 and air 202 are placed in a uniform magnetic field H. The ferrite 201 has an open magnetic flux path; there are interfaces NP⊥ and SP⊥ between the lengthwise ends of the ferrite 201 and air 202. In a case where the magnetic field H is generated in parallel to the lengthwise direction of the magnetic core, the pattern of the magnetic field H becomes as shown in FIG. 23. That is, it becomes thin in density in the air 202, and becomes higher in density in the center portion 201C of the magnetic core. Further, it becomes less in density in the lengthwise end portion 201E of the magnetic core than in the center portion 201C.

The reason why the magnetic field H becomes less in density in the lengthwise end portion 201E of the magnetic core as described above is as follows. The magnetic field is less in density in the lengthwise end portion of the ferrite than in the center portion because of the properties of the interface between the lengthwise end of the ferrite and air. The portion of the magnetic field, which is on the inward side of the magnetic core, relative to the interface NP⊥ (NS⊥) between the magnetic core 2 and air is in connection to the portion of the magnetic field, which is on the outward side of the interface. Thus, the portion of the air, which is in contact with the lengthwise end of the ferrite is higher in magnetic flux density than the other portion of the air, whereas the portion of the magnetic core, which is in contact with the air at the interface NP⊥ (NS⊥) is less in magnetic flux density than the center portion of the magnetic core 2. Thus, the magnetic field H is less in magnetic flux density. This phenomenon makes it seem as if the lengthwise end portion 201E of the ferrite 201 is less in permeability. Thus, in this description of the present invention, this phenomenon is described as "the lengthwise end portion of the magnetic core is less in apparent permeability".

The occurrence of this phenomenon can be indirectly verified with the use of an impedance analyzer. Referring to FIG. 24, a coil 141 (5 times in winding count) which is 30 mm in diameter is in connection to the impedance analyzer by its lengthwise ends. It was fitted around the magnetic core 2, and moved in the direction indicated by an arrow mark, in a manner to scan the magnetic core 2, in order to measure the equivalent inductance L (50 kHz in frequency). Then, as the measured amounts of equivalent inductance L were plotted in the form of a graph, a dome-like pattern emerged. According to this graph, the equivalent inductance L at the lengthwise ends of the magnetic core is no more than half that at the center of the magnetic core 2. L is expressed in the form of the mathematical expression (4).

$$L=\mu N^2 S/l \tag{4}$$

Here, μ stands for the permeability of the magnetic core; N, number of windings of the coil; l, the length of the coil; and S stands for the cross-sectional size of the coil. The coil 141 was kept the same in shape. Thus, S, N and l did not change in value during this test. Therefore, it may be concluded that the reason why the measured equivalent inductance L of the magnetic core displays a dome-like pattern is that "the end portions of the magnetic core are smaller in apparent permeability than the center portion".

To summarize, "as the magnetic core is shaped so that it forms an open magnetic path", the phenomenon that "the lengthwise end portions of the magnetic core become smaller in apparent permeability than the center portion" emerges.

By the way, in a case where the magnetic core forms a closed magnetic flux path, or is formed of multiple sections which are aligned with preset intervals, this phenomenon does not occur. Next, referring to FIG. 25, a case in which the magnetic core forms a closed magnetic flux path is described. In this case, the magnetic core 153 forms a loop which encircles the excitation coil 151 and heat generation layer 152. Thus, the magnetic flux remains only in the magnetic flux path (which is closed (endless)). Therefore, there are absolutely no interfaces NP^ and SP^, shown in FIG. 23, which are perpendicular to the magnetic flux. Therefore, the entirety of the magnetic core 153 (entirety of magnetic flux path) is uniform in magnetic flux density.

5-2) Reason why Lengthwise End Portions are Small in Combined Impedance

In the case of this structural configuration, the magnetic core is nonuniform in apparent permeability in terms of the lengthwise direction. In order to describe these properties with the use of a simpler model, the phenomenon is described with reference to FIG. 26 which is a schematic drawing of a heat generation unit structured as described above. Referring to part (a) of FIG. 26, both the magnetic core and heat generation layers are made up of three sections in terms of their lengthwise direction, unlike the counterparts shown in part (a) of FIG. 21. Referring to part (a) of FIG. 26, the heat generation layer is made up of three sections (pair of lengthwise sections 173*e* and center section 173*c*) which are the same in shape and properties, and are 80 mm in dimension in terms of the lengthwise direction. It is assumed here that the electrical resistance of each section 173*e* in terms of the circumferential direction is Re, and the electrical resistance of the section 173*c* in terms of the circumferential direction is Rc.

The "circumferential resistance" of an object means the amount of electrical resistance of the object when electric current is flowed through the object in the circumferential direction of the object. In this case, the sections 173*e* and 173*c* are the same in circumferential resistance R (Re=Rc (=R)). As for the magnetic core, it is made up of a pair of end sections 171*e* (which are μe in permeability) and a center section 171*c* (which is μc in permeability). The three sections are 80 mm in dimension in terms of the lengthwise direction. The end sections 171*e* are greater in permeability than the center section 171*c* (μe<μc). Here, in order to think with reference to a physical model which is as simple as possible, the nonuniformity, in apparent permeability, of each of the sections 171*e* and 171*c* are not taken into consideration.

Referring to part (b) of FIG. 26, the coil 171 has three sections (pair of lengthwise sections 171*e* and single center section 171*c*). The section 171*e* of the coil 171 is wound six times around the section 172*e* of the magnetic core, and the section 171*c* of the magnetic coil is wound six times around the section 172*c* of the magnetic core. The three sections 171*e* and 171*c* are in serial connection (171*e*-171*c*-171*e*) with each other. It is also assumed here that the effect of the lengthwise end portion 171*e* upon the center portion 171*c*, and the effect of the center portion 171*c* upon the lengthwise end portion 171*e*, are small enough to allow the circuit to be simplified in a circuit model made up of three branch sections as shown in part (a) of FIG. 27. The lengthwise end portion 171*e* of the magnetic core is smaller in permeability than the lengthwise center portion 171*c* (μe<μc). Therefore, the relationship in terms of inductance M between the lengthwise end portions 171*e* and lengthwise center portion 171*c* is analogous to the relationship in permeability between the lengthwise end portions 171*e* and the lengthwise end portion 171*c* (Me<Mc). Shown in part (b) of FIG. 27 is a more simplified version of the model.

As the equivalent resistance of each circuit is seen from the primary side, $R'=6^2R$ across the lengthwise end portion, and $R'=6^2R$ across the center portion. Thus, the combined impedances Xe and Xc are expressible in the form of the following mathematical expressions (5) and (6).

$$|X_e| = \frac{1}{\sqrt{\left(\frac{1}{6^2R}\right)^2 + \left(\frac{1}{\omega M_e}\right)^2}} \tag{5}$$

$$|X_c| = \frac{1}{\sqrt{\left(\frac{1}{6^2R}\right)^2 + \left(\frac{1}{\omega M_c}\right)^2}} \tag{6}$$

As the parallel circuit portion of R and L is substituted with the combined impedance X, the diagram shown in part (c) of FIG. 27 is obtained. The relationship of the mutual inductance is: Me<Mc. Therefore, the frequency-dependency of Xe and Xc is: Xe<Xc across the entire frequency range, as indicated by the graph in part (a) of FIG. 28. As the power supply is increased in frequency as high as possible, Xe becomes virtually equal to Xc. However, the frequency range which can be used for a fixing device is limited.

In terms of frequency, the electric power to be supplied to the excitation coil comes under the ordinance for enforcement of image forming apparatus specifications which is in accordance with the Wireless Radio Act of the Commercial Code, a frequency range of 20.05 kHz-100 kHz can be used. Therefore, within the usable frequency range, the relationship between Xe and Xc is always: Xe<Xc. In the case of the serial circuit shown in part (c) of FIG. 27, the relationship between the amount of heat generated by the section 171*e* as alternating voltage is applied, and that by the section 171*c*, is determined by the relationship between the value of Xe and that of Xc. Therefore, within the usable frequency range, Qe<Qc as shown in part (b) of FIG. 28.

Therefore, as alternating current which is 20.05 kHz-100 kHz in frequency is flowed through the excitation coil, the amount by which heat is generated by the lengthwise end sections 171*e* is smaller than that by the center section 171*c*, as indicated by a dotted line h1 in FIG. 29. In the case of this model, the heat generation unit was divided into three sections, for the simplification of the phenomenon. In the case of the actual structural configuration of the heat generation unit shown in part (a) of FIG. 21, however, it may be assumed that infinite number of sections which are different in permeability are aligned in the lengthwise direction, in connection to each other. Further, if the mutual effects, in terms of inductance, among the infinite number of sections are taken into consideration, the circuit becomes complicated. However, the gist (reason why lengthwise end portions of the heat generation unit (heat generation layer) are smaller in amount of heat generation than center portion) can be described with the use of this model.

(6) How to Control Amount by which Heat is Generated by Lengthwise End Portion of Heat Generation Layer Next, the reason why the heat generation unit in this embodiment is structured so that the number of times the excitation coil is wound around the lengthwise end portions of the magnetic core is greater than that around the center portion of the magnetic core, as shown in FIGS. 3 and 4, is described.

A heat generation unit can be changed in the balance between the inductance and resistance, between the lengthwise end portion and center portion, by making the number of times the excitation coil is wound around the lengthwise end portions of the magnetic core greater than that around the center portion of the magnetic core. This method is described with reference to the previously referenced model in which the heat generation unit was made up of three sections aligned in the lengthwise direction.

In comparison to the model in part (a) of FIG. 26, in the case of the model in part (a) of FIG. 30, the excitation coil 172*e* is wound seven times (Ne=7) around the section 171*e* of the magnetic core, and four times (Nc=4) around the section 171*c* of the magnetic core. Otherwise, the model in part (a) of FIG. 30 is the same as the model in part (a) of FIG. 26. Part (a) of FIG. 31 is a simplified version of part (a) of FIG. 30. Regarding the equivalent resistance of each subcircuit as seen from the primary side, the resistance R' of the lengthwise end section 172*e* is $7^2R$, and the resistance R' of the center section 172*c* is $4^2R$. Therefore, combined impedances Xe and Xc can be calculated with the use of the following mathematical expressions (5) and (6).

$$|X_e| = \frac{1}{\sqrt{\left(\frac{1}{7^2R}\right)^2 + \left(\frac{1}{\omega M_e}\right)^2}} \tag{5}$$

$$|X_c| = \frac{1}{\sqrt{\left(\frac{1}{4^2R}\right)^2 + \left(\frac{1}{\omega M_c}\right)^2}} \tag{6}$$

By substituting the portion of the circuit, in which R and L are parallel, with the combined impedance X, part (b) of FIG. 31 is obtained. As for the frequency-dependency of Xe and Xc, unlike the graph in part (a) of FIG. 28, because the two sections are difference in the value of R', it is possible to make Xe equal to Xc by selecting a proper frequency within the usable frequency range. This is attributable to the fact that Xe is greater in the value of R'. It is assumed here that frequency f is the frequency that can make Xe equal to Xc. As alternating voltage is applied from the high frequency converter, it is possible to make Qe equal to Qc by properly setting the driving frequency of the converter to f. Moreover, it is possible to make Qe smaller than Qc by reducing the converter in frequency (f).

To summarize the foregoing;

6-1) By making the number of times the excitation coil 3 is wound around the lengthwise end portions of the magnetic core, smaller than that around the center portion of the magnetic core;

6-2) by selecting a proper frequency for driving the high frequency converter, it is possible to controls the amount by which the lengthwise end portions of the heat generation layer generates heat, and the amount by which the center portion of the heat generation layer generates heat.

Referring to FIG. 33, in a case where alternating current, the frequency f of which is 50 kHz, is flowed through the excitation coil of the heat generation unit structured as shown in part (a) of FIG. 4, the heat generating layer becomes uniform in the amount of heat generation in terms of its lengthwise direction, whereas in a case where alternating current, the frequency f of which is 21 kHz, is flowed through the excitation coil, the lengthwise end portions of the heat generation layer becomes smaller in the amount of heat generation than the center portion of the heat generation layer.

In other words, by varying in frequency the alternating current to be flowed through the excitation coil, within a range of 21 kHz to 50 kHz, it is possible to control the heat generation pattern of the heat generation layer in terms of the lengthwise direction. By the way, needless to say, the alternating current may be changed in frequency f, according to the ratio between the number of times the excitation coil is wound around the lengthwise end portions of the magnetic core, and that around the center portion, shape of the magnetic core, and circumferential resistance of the heat generation layer.

(7) Temperature Control for Fixing Device, and Electric Power Control

Next, referring to FIG. 3, the method for controlling the fixing device A in temperature is described. The temperature detection elements 9, 10 and 11 are thermistors of the non-contact type. They detect the temperature of the fixation sleeve 1. The signals from the temperature detection elements 9, 10 and 11 are compared with the target temperature sent in advance by the fixation temperature control section 44. Based on the results of the comparison, the amount by which electric power is supplied to the high frequency converter 16 is determined. The electric power control section 46 supplies electric power to the high frequency converter 16 by the above described amount. The electric power control section 46 is limited in the largest amount by which it is allowed to supply the high frequency converter 16, for the reason which is provided later.

Next, the method for controlling the electric power in this embodiment is concretely described. Generally speaking, in the case of a fixing device which uses a conventional heating method based on electromagnetic induction, the amount by which electric power is supplied to a fixing device has been controlled by changing in frequency the alternating current to be supplied to the fixing device. Referring to the graph in FIG. 34, in the case of a heating method which uses a resonance circuit to generate heat by electromagnetic induction, the output of the converter is affected by the frequency of the electric power with which the converter is supplied. For example, if a frequency in the range A is selected, the converter becomes the largest in output, whereas as the power to the fixing device is increased in frequency to a value in the range B, a value in the range C, and so on, the converter reduces in the output, for the following reason.

That is, these properties are attributable to the characteristic of the converter that the converter becomes largest in output when the driving frequency coincides with the resonance frequency of the circuit, and the greater the difference between the driving frequency and the resonance frequency of the circuit, the smaller the converter in output. That is, the method used in this embodiment to generate heat in the heat generation layer of the fixing device is such a method that adjusts the converter in output by varying the driving frequency within a range of 21 kHz to 100 kHz, according to the difference between the target temperature and the temperature detected by the temperature detection element 9, without changing the output (Japanese Laid-open Patent Application No. 2000-223253).

However, to control the heat generation layer of the fixing device A in this embodiment so that the heat generation layer generates heat in a desired pattern in terms of its lengthwise direction is to adjust the driving frequency to a desired value. In other words, electric power cannot be adjusted by changing the driving frequency.

In this embodiment, therefore, electric power is adjusted in the following manner. The driving frequency is set by the frequency control section 45 (frequency setting section), shown in FIG. 3, so that the fixation sleeve 1 generates heat in the desired pattern in terms of its lengthwise direction. Then, the engine control section 43 sets the target temperature for the fixation sleeve 1, based on the temperature detected by the temperature detection element 9, recording medium information obtainable from the printer controller, image information, print count information, etc. Thereafter, the fixation temperature control section 44 compares the temperature detected by the temperature detection element 9 with the target temperature, and determines the output voltage based on the result of the comparison.

Then, the output voltage is adjusted in amplitude (of waveform) by the electric power control section 46 according to the voltage value determined as described above. Then, voltage having the waveform shown in part (a) of FIG. 35 is outputted by the power control section 46. The waveforms shown in part (a) of FIG. 35 are the waveform of the voltage which is maximum (100%) in amplitude, and the waveform of the voltage which is 50% in amplitude. The outputted voltage is changed in driving frequency by the high frequency converter 16 to a preset driving frequency, and then, is applied to the excitation coil 3.

By the way, a method other than the above described one may be used. For example, the output may be controlled by adjusting the length of time the voltage is kept turned on or off. In such a case, the ratio between the length of time the output voltage is kept turned on and the length of time the output voltage is kept turned off is determined by the engine control section 43. Then, power is outputted by the power control section 46 according to the determined ON/OFF ratio. Part (b) of FIG. 35 shows the waveform which corresponds to 100% in output, and waveforms which corresponds to 50% in output. The ratio between ON period and OFF period may be controlled with the use of a frequency controlling method, or a phase controlling method. The outputted voltage is converted by the high frequency converter 16 into a voltage having the preset driving frequency, and then, is applied to the excitation coil 3.

With the use of a control such as the above described one, it is possible to flow such alternating current that has the desired driving frequency, through the excitation coil 3. Therefore, it is possible to control the amount by which power is supplied to the fixing device, while keeping the heat generation pattern of the heat generation layer in the desired one in terms of the lengthwise direction.

(8) Setting of Basic Frequency According to Recording Medium Size

The image forming apparatus in this embodiment is controlled in the heat generation pattern in terms of the lengthwise direction, with the use of the above described control method. More specifically, during an image forming operation in which a sheet of recording medium (which hereafter is referred to as small sheet of paper), which are narrower than the width of the path of the widest sheet of recording medium which is conveyable through the fixing device, are conveyed, the alternating current to be flowed through the excitation coil is actively controlled in driving frequency.

Generally speaking, in a case where a substantial number of sheets of paper which are narrower than the width of the path of the widest sheet of paper are continuously conveyed through a fixing device, the so-called out-of-sheet-path temperature increase, which is the phenomenon that, the portions of the fixation sleeve 1 (which is the rotational heating component), which are outside the recording medium path (out-of-sheet-path portions) in terms of the lengthwise direction of the fixation sleeve 1, excessively increase in temperature, occurs. As the out-of-sheet-path temperature increase continues, it sometimes occurs that the structural components of the fixing device are damaged.

As for the means for dealing with this problem, such control as increasing the fixing device in the sheet feeding interval (sheet conveyance interval), reducing the fixing device in printing speed (sheet conveyance speed in fixation nip), and/or the like, to slow down the out-of-sheet-path temperature increase. However, this type of control reduces a fixing device in the number of prints which the fixing device can output per unit length of time (which hereafter is referred to as print output ratio).

In the case of the image forming apparatus in this embodiment, in order to maximize the print output ratio, the entirety of the frequency range of 50 kHz (which makes heat generation layer uniform in the amount of heat generation in terms of the lengthwise direction) to 21 kHz (which is the lowest of usable frequency range) is used. The fixation sleeve 1 is actively controlled in temperature distribution in terms of the lengthwise direction, by controlling the high frequency converter 16 in driving frequency, within this frequency range. That is, the frequency control section 45 controls the high frequency converter 16 in such a manner that the narrower the sheet of recording medium which is being conveyed through the fixation nip, the lower the high frequency converter 16 in driving frequency, in order to minimize the out-of-sheet-path temperature increase.

Part (b) of FIG. 4 is a drawing for describing the changes which occur to the heat generation pattern of the heat generation layer 1*a* in terms of the lengthwise direction as the driving frequency is changed. As the driving frequency of the electric power supplied to the excitation coil is reduced from fixing device 50 kHz to 44 kHz, 36 kHz and 21 kHz, the lengthwise end portions of the heat generation layer 1*a* reduces in the amount of heat generation in response to the reduction in driving frequency. This properties of the heat generation unit is used to control the out-of-sheet-path temperature increase by controlling the driving frequency in such a manner that the smaller the path of recording medium, the lower the driving frequency.

Shown in Table 6 is the relationship between the recording medium size and basic driving frequency. Similarly, part (a) of FIG. 5 also shows the relationship between the recording medium size and basic driving frequency. Hereafter, by the way, the driving frequency values which correspond to recording medium sizes are referred to as basic driving frequency.

TABLE 6

| | Sheet size | | | |
|---|---|---|---|---|
| | Ltr. size 216 mm W × 279.4 mm L | A4 size 210 mm W × 297 mm L | B5 size 182 mm W × 257 mm L | A5 size 148 mm W × 210 mm L |
| Basic driving frequency | 50 kHz | 44 kHz | 36 kHz | 21 kHz |
| Between adjacent sheets | 50 mm | 35 mm | 75 mm | 120 mm |

The basic driving frequency values in Table 6 are those which make the lengthwise end portions of the fixation sleeve 1, in terms of the lengthwise direction, lower in temperature by 5% than the portions of the fixation sleeve 1, which correspond to the edges of the sheet of recording medium, in terms of the widthwise direction of the sheet, which is being conveyed through the nip.

In this embodiment, the frequency control section 45 (frequency setting section) changes the basic driving frequency, based on the recording medium size information set by a user through the host computer 42. Also in this embodiment, the recording medium conveyance speed is 350 mm/sec, and the sheet interval is 50 mm for a letter size sheet, 35 mm for an A4 size sheet, 75 mm for B5 size sheet, and 120 mm for an A5 size sheet. The print output ratio is 45 prints per minute regardless of sheet size.

As described in the foregoing, in the case of the image forming apparatus in this embodiment, the out-of-sheet-path temperature increase can be minimized by controlling its fixing device in such a manner that the narrower, in terms of the lengthwise direction, the path of the sheet of paper which is being introduced into the nip, the lower the basic driving frequency.

(9) Description of Driving Frequency, and Maximum Available Amount of Electric Power However, reducing the high frequency converter 16 in driving frequency creates the following problem. Part (a) of FIG. 5 is a graph which shows the relationship between the driving frequency of the alternating current to be flowed through the excitation coil 3, and the maximum amount of electric power available for the high frequency converter 16. Referring to part (b) of FIG. 5, the lower the driving frequency, the smaller the amount of the electric power which is available to the high frequency converter 16. Next, the reason for this phenomenon is described.

As alternating current is flowed through the excitation coil 3, magnetic flux is generated in the magnetic core 2. As the magnetic core 2 becomes saturated with the magnetic flux, that is, as the density of the magnetic flux in the magnetic core 2 reaches its saturation level, the excitation coil 3 suddenly reduces in impedance. As a result, a large amount of current flows through the excitation coil 3, causing the high frequency converter 16 to malfunction. Therefore, a control has to be executed to prevent the magnetic flux generated in the magnetic core 2 from reaching the point of saturation in terms of density.

Referring to mathematical expression (600), the density B of the magnetic flux generated in the magnetic core 2 is proportional to the voltage V applied to the excitation coil 3, and inversely proportional to the driving frequency f of the alternating current flowed through the excitation coil 3.

$$B \propto V/f \tag{600}$$

Therefore, in a case where only the driving frequency is reduced while the voltage V is kept stable at a preset level, the magnetic core 2 increases in magnetic flux density. Conversely, all that can be done to keep the magnetic flux density B below the saturation level when the driving frequency f is low, is to reduce the voltage V. Here, there is a relation between the voltage V and the amount P by which electric power is supplied to the excitation coil 3, which is indicated by mathematical expression (601), in which X stands for the impedance of the excitation coil 3.

$$P=V^2/X \tag{601}$$

It is evident from mathematical expressions (600) and (601) that all that can be done to keep the magnetic flux density B below the saturation level when the driving frequency f is low, is to reduce the amount by which the high frequency converter 16 is supplied with electric power.

Part (b) of FIG. 5 shows the relationship between the driving frequency and electric power when the magnetic flux density within the magnetic core 2 is exactly at the saturation level.

It was stated previously that in this embodiment, a control is executed so that the narrower the sheet of recording medium which is being conveyed through the nip, the lower the driving frequency. Hereafter, this controlling method is described with reference to a case where sheets of recording medium, which are A5 in size, for which the lowest basic driving frequency is used, are as recording medium. Referring to Table 6, in this embodiment, in an image forming operation in which sheets of recording medium which are A5 in size are used as recording medium, the basic driving frequency f is set to 21 kHz. It is evident from part (b) of FIG. 5 that in a case where the driving frequency f is 21 kHz, the largest available amount of power is roughly 520 W.

On the other hand, Table 7 shows the amount of electric power which is necessary in a case where sheets of recording medium (paper) which are A5 in size, and 80 g/m$^2$ in basis weight, are continuously conveyed through the fixing device in this embodiment, at a print output ratio of 45 prints/min.

In this test for confirming the necessary amount of electric power, the driving frequency f was set to 36 kHz which is the basic driving frequency for a sheet of recording medium which is B5 in size, in order to increase the maximum available amount of electric power.

Referring to Table 7, the necessary amount of electric power is affected by the toner image on a sheet of recording medium. For example, the greater the print ratio, the greater the necessary amount of electric power. Table 7 shows the results of a test in which there was no toner image on the sheet (solid white), a test which was 10% in print ratio, a test which was 50% in print ratio, and a test which was 100% in print ratio. Here, "print ratio" means dot count of the toner image/dot count of the entire area of the sheet, across which an image can be formed. Those images having the above given print ratios were uniform in density.

TABLE 7

| Print ratio of image (%) | Required electric power (W) |
|---|---|
| 0 | 480 |
| 10 | 490 |
| 50 | 520 |
| 100 | 550 |

The following are evident from Table 7. In a case where an image to be formed is 10% in print ratio, satisfactorily images can be formed even if the maximum available amount of electric power is no more than 520 W, which is the maximum amount of electric power available when the driving frequency f is 21 kHz which is the basic driving frequency for a sheet of recording medium which is A5 in size. However, in the case of an image which is 50% in print ratio, the necessary amount of electric power is 520 W. That is, the maximum available amount of electric power is the same as the necessary amount of electric power. Further, in the case of an image which is 100% in print ratio, the necessary amount of electric power is 550 W, which is greater than the maximum available amount of electric power. In reality, if electric power has to be supplied by an amount which is greater than the maximum available amount, the high frequency converter 16 will malfunction. Therefore, a control is executed so that the maximum amount by which electric power is supplied is limited to 520 W.

In such a case, however, if an image which is greater in density than an image which is 100% in print ratio is introduced into the fixing device, electric power cannot be supplied by the amount necessary for proper fixation. That is, the fixing device is supplied with an insufficient amount of electric power. Thus, fixation failure occurs.

In Table 7, amounts by which electric power needs to be supplied when a substantial number of sheets of recording medium which are the same in size are conveyed in succession to form the same images are shown. For example, in a case where a substantial number of sheets of recording medium, which are the same in size, are continuously conveyed to alternately form images which are 10% in print ratio, and images which are 100% in print ratio, the necessary amount of electric power significantly fluctuates as shown in FIG. 6. In particular, as the leading edge of a sheet of recording medium on which an image which is 100% in printer ratio is present, enters the fixation nip, the necessary amount of electric power jumps up to roughly 800 W. In this case, if the driving frequency was set low, and therefore, the available amount of electric power was limited, the image which is 100% in print ratio is unsatisfactorily fixed.

(10) Driving Frequency Control in First Embodiment

It is possible to set higher the basis driving frequency for a sheet of recording medium which is A5 in size, in order to prevent the unsatisfactory fixation which occurs as the driving frequency is set to the value for a sheet of recording medium which is A5 in size. In such a case, however, the primary objective of changing the high frequency converter in driving frequency according to the recording medium size to prevent the out-of-sheet-path temperature increase is reduced in effectiveness. Further, an image forming apparatus is not always used to print images which are 100% in print ratio, or the like. Therefore, setting higher the basis driving frequency is undesirable to users who convey nothing but images which are low in print ratio.

In this embodiment, therefore, in consideration of the above described issues, the fixing device is structured so that when small sheets of paper are conveyed, the basis driving frequency (first frequency) is set to one of the values listed in Table 6 according to paper size. On the other hand, if it is determined that unfixed images (prints) which are about to be introduced into the fixing device are high in print ratio, the high frequency converter 16 is temporarily increased in driving frequency to increase the high frequency converter 16 in the maximum amount by which it can supply electric power.

That is, in a case where an image formed on a sheet of recording medium is higher in print ratio than a preset value, the engine control section 43 switches the first frequency (basis driving frequency), set as the frequency for the alternating current to be flowed to the coil 3, according to the recording medium width (size), to the second frequency (value) which is higher than the first frequency (value).

Next, this control is concretely described. Referring to FIG. 3, as the printer controller 41 receives image data from the host computer 42, it transmits print signals to the engine control section 43, and also, converts the received image data into bit map data for image formation. The engine control section 43 which includes an image processing means causes the exposing means to emit a beam of laser light in a manner to scan (expose) the charged peripheral surface of the drum while modulating the beam with the image formation signals originated from the bit map data. Incidentally, the image forming apparatus in this embodiment obtains print information from the bit map data into which the image formation signals were converted in the printer controller 41.

"Print information" means data which are correlated to the amount of toner on a sheet P of recording medium. It has only to be set according to the properties of an image forming apparatus. Typically, it is density information, and print ratio. In a case of a color laser printer, it may be the amount of multiple layers of toner, different in color, on a sheet P of recording medium, or the largest value among the representative values for a single page (single sheet) obtainable by dividing the entire area of a sheet of recording medium, across which an image is printable, into multiple sections of an optional size, and detecting no less than one value which represents density information (Japanese Laid-open Patent Application No. 2013-41118). In the case of the image forming apparatus in this embodiment, the above described print ration D was used.

The obtained information about the print ratio D is sent to the engine control section 43. The electric power amount estimating means included in engine control section 43 stores a table such as the following Table 8, and calculates (estimates) the necessary amount of electric power. The calculated necessary amount of electric power is sent to the frequency control section 45 as a frequency setting section.

The frequency control section 45 stores the table, shown in part (b) of FIG. 5, which shows the relationship between the driving frequency and the maximum amount by which the high frequency converter 16 can supply electric power, and sets the driving frequency f for enabling the high frequency converter 16 to supply the necessary amount of electric power, based on this table. The frequency control section 45 controls the high frequency converter 16 so that the high frequency converter 16 flows to the excitation coil 3, alternating current having the set frequency f.

TABLE 8

| Print ratio of image (%) | Driving frequency (kHz) | Max. suppliable power (W) |
|---|---|---|
| $0 \leq D \leq 10$ | 21 | 520 |
| $10 < D \leq 50$ | 25 | 730 |
| $50 < D \leq 100$ | 27 | 830 |

Referring to Table 8, in this embodiment, the print ratio is set to 10%. In the case of images which are no more than 10% in print ratio, the engine control section 43 flows alternating current, which is 21 kHz in driving frequency f, to the excitation coil 3.

When the print ratio is no less than 10%, the engine control section 43 changes the alternating current, which is to be flowed to the excitation coil 3, in driving frequency f, from the abovementioned 21 kHz to 25 kHz (second frequency) which is higher than 21 kHz.

When the print ratio is higher than 50% (second preset value), the engine control section 43 changes the alternating current to be flowed to the excitation coil 3, in driving frequency f, to 27 kHz (third frequency) which is even higher than the abovementioned 25 kHz which is higher than the abovementioned 21 kHz. That is, in a case where the second frequency causes the magnetic core 2 to be saturated with magnetic flux, the engine control section 43 changes the electric current in frequency f, to the third frequency.

In other words, the frequency control section 45 controls the high frequency converter 16 in driving frequency, according to the print ratio. Further, the frequency control section 45 controls the electric power, which is to be supplied to the high frequency converter 16, in such a manner that the temperature detected by the temperature detection element 9 remains stable at a preset level, while keeping the amount by which electric current is supplied to the high frequency converter 16, below the maximum amount.

As described in the foregoing, the image forming apparatus in this embodiment can execute such a control that when small sheets of paper are conveyed, the high frequency converter 16 is reduced in driving frequency, according to the amount of toner on each sheet, within a range in which the heat generation unit can be supplied with the necessary amount of electric power. Therefore, not only can it effectively control the out-of-sheet-path temperature increase, but also, can prevent the occurrence of unsatisfactory images such as unsatisfactorily fixed images.

By the way, in a case where the control in this embodiment is executed, unsatisfactory fixation does not occur. However, the out-of-sheet-path temperature increase is greater than in a case where the control is executed with the driving frequency set to the basic one. For example, in a case where only an image which is 100% in print ratio is continuously conveyed by a large number, the driving frequency f is kept at 27 kHz. Therefore, it is possible that the out-of-sheet-path temperature increase continues.

Therefore, even the image forming apparatus in this embodiment is controlled like a conventional apparatus so that as the out-of-sheet-path temperature increase exceeds a preset value, the apparatus is increased in the feeding-conveying interval (conveyance interval) with which sheets of recording medium are continuously introduced into the fixing device. Whether or not the out-of-sheet-path temperature increase has exceeded the preset value has only to be determined based on the temperature detected by the temperature detection elements 10 and 11. In this embodiment, the preset value was 220° C. This value has only to be set in consideration of the heat resistance, or the like properties, of the structural components of the fixing device.

Further, the timing with which the feeding-conveying interval is to be increased may be when the number of the sheets of recording medium conveyed with the driving frequency set to a value which is greater than the basis driving frequency value, exceeds a preset value.

That is, as the fixing device satisfies preset condition while alternating current having the frequency set by the frequency control section 45 is flowed to the excitation coil 3, the printer controller 41 widens the interval with which sheets of recording medium are continuously conveyed through the image forming apparatus. For example, the abovementioned condition is whether or not the temperature detected by the temperature detection elements 10 and 11 for detecting the temperature of the fixation sleeve 1 has reached a preset level.

Further, in this embodiment, it is the print information of the toner image on a sheet of recording medium that was used as the means for estimating the necessary amount of electric power. This embodiment, however, is not intended to limit the present invention in scope. For example, in the case of an image forming apparatus equipped with a sensor other than the temperature detection elements, for example, an environment sensor 47 (FIGS. 1 and 3) which detects the ambient condition such as the temperature, humidity, etc., within or outside the image forming apparatus, the results of the detection by the environment sensor 47 may be reflected upon the estimation. That is, the electric power amount estimating section 43 estimates the amount of electric power necessary for fixation, based on the results of the detection by the abovementioned environment sensor 47.

More concretely, all that is required is to set the driving frequency in such a manner that the lower the internal and/or ambient temperature of the image forming apparatus, or the higher the internal and/or ambient humidity, the higher the driving frequency.

That is, when the temperature detected by the environment sensor 47 is lower than the preset level, the engine control section 43 changes the driving frequency to the second frequency which is higher than the first frequency, or when the humidity detected by the environment sensor 47 is higher than a preset level, the engine control section 43 changes the driving frequency to the second frequency level which is higher than the first driving frequency level.

Further, when the second frequency level causes the magnetic core 2 to be completely saturated with magnetic flux, the engine control section 43 changes the driving frequency f to the third frequency value which is higher than the second frequency value.

Further, an image forming apparatus may be equipped with a recording medium information detecting section 48 (FIGS. 1 and 3) for obtaining the information of a sheet of recording medium which is being conveyed, so that the results of the detection can be reflected upon the setting of the driving frequency. That is, the electric power amount estimating section 43 estimates the amount of electric power necessary for an image fixing operation, according to the results of detection by the abovementioned recording medium information detecting section 48. More concretely, even if two prints are the same in recording medium size, the print which is greater in the basis weight (weight of recording medium per unit area) of its recording medium requires a greater amount of electric power than the print which is less in the basis weight of its recording medium. Therefore, in a case where the results of the detection by the recording medium information detecting section 48 indicates that the recording medium in use is large in basis weight, the driving frequency may be set higher.

The recording medium information detecting section 48 detects the thickness, basis weight, and/or other information about a sheet of recording medium, based on an optional principle, while the sheet is conveyed through the recording medium conveyance passage which extends from the sheet feeder cassette 105 to the transfer area 108T, for example, and feeds the detected information back to the printer controller 41. The recording medium information may be inputted into the printer controller 41 by a user by way of the host computer 42. In such a case, the host computer 42 and printer controller 41 are the recording medium information detecting section.

Embodiment 2

Referring to FIG. 7, unlike the image forming apparatus in the first embodiment of the present invention, the image forming apparatus in this (second) embodiment of the present invention divides a sheet P of recording medium into three sections in terms of the conveyance direction Q, and switches the driving frequency while the sheet P is being conveyed through the fixing device. By executing such a control, it is possible to properly set the driving frequency for each section of the sheet P, even when an image such as the one shown in FIG. 8, which is nonuniform in print ratio, in terms of the conveyance direction Q, is conveyed.

In the second embodiment, when a sheet of recording medium on which such an image as the one shown in FIG. 8 is present, is conveyed, the driving frequency is controlled according to Table 8. That is, while the section 1 of the sheet P is moving through the fixation nip N, the driving frequency f is kept at 27 kHz, and while the section 2 of the sheet P is moving through the fixation nip N, the driving frequency f is kept at 25 kHz. Further, when the section 3 of the sheet P is moving through the fixation nip N, the driving frequency f is kept at 21 kHz.

By controlling the driving frequency as described above, it is possible to set the driving frequency for each section of a sheet P of recording medium, according to the amount of electric power which is necessary for the proper fixation of the section. Therefore, it is possible to effectively slowing down the out-of-sheet-path temperature increase, which is attributable to the use of unnecessarily high driving frequency, while preventing the occurrence of unsatisfactory fixation attributable to an insufficient amount of electric power.

In this embodiment, the image was divided into three sections in terms of the conveyance direction. However, the embodiment is not intended to limit the present invention in scope, in terms of the number of sections into which an image is to be divided. That is, an image may be divided into four or more smaller sections.

[Miscellanies]

(1) The cylindrical rotational component 1 having the electrically conductive layer 1*a* may be replaced with a flexible endless component, such as an endless belt, which is suspended, and kept tensioned, by multiple belt suspending components, and is rotationally driven, or a hard and hollow roller, or a piece of pipe.

(2) In a case where a fixing device is structured so that it is the rotational component 1 that is driven by a driving force source, the nip forming component 8 which forms the fixation nip N between itself and the cylindrical rotational component 1, in coordination with the cylindrical rotational component 1, may be rotationally driven by the rotation of the rotational component 1.

Further, in a case where a fixing device is structured so that the rotational component 1 is rotationally driven by a driving force source, the nip forming component 8 may be replaced with a non-rotational component, such as a rectangular pad, the surface of which is smaller in coefficient of friction than a sheet of recording medium and rotational component 1. In a case where a non-rotational component is employed in place of the nip forming component 8, as a sheet P of recording medium is introduced into the fixation nip N, it is conveyed through the fixation nip N, by the rotation of the rotational component 1 while remaining pinched by the non-rotational component and rotational component 1, with the backside (side on which image is not formed) of the sheet P sliding on the surface of the non-rotational nip forming component, which is smaller in coefficient of friction than the sheet P.

(3) An electrophotographic image forming section of an image forming apparatus, to which the present invention is applicable is not limited to the image forming section 113 of the image forming apparatus in the preceding embodiments, which form a toner image on a sheet P of recording medium. For example, the present invention is also applicable to an electrophotographic image forming section of the direct type, which uses a sheet of photosensitive paper, and directly forms a toner image on the sheet of photosensitive paper. Further, the present invention is also applicable to an electrostatic image forming section of the transfer type, which uses an electrostatically recordable dielectric component as an image bearing component, or a magnetic image forming section of the transfer type, which employs a magnetically recordable magnetic component as an image bearing component. Moreover, the present invention is also applicable to an electrostatic image forming section of the direct type, which uses a sheet of electrostatically recordable paper as recording medium, and forms a toner image directly on the recording medium, or a magnetic image forming section which uses a sheet of magnetically recordable sheet as recording medium, and forms a toner image directly on the recording medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-214504 filed on Oct. 21, 2014, which is hereby incorporated by reference herein in its entirety.

What is claimed is:

1. An image heating apparatus for heating an image formed on a recording material, said image heating apparatus comprising:

a rotatable member including an electroconductive layer;

a coil provided in a hollow portion of said rotatable member, said coil having a spiral portion of which a spiral axis extends along a generatrix direction of said rotatable member;

a magnetic core provided in the spiral portion of said coil, said magnetic core extending in the generatrix direction and having an end portion;

a recording material detecting portion configured to detect a size of the recording material;

a controller configured to control a frequency of an AC current supplied to said coil to change a heat generation distribution of said rotatable member in the generatrix direction based on the size of the recording material; and an acquisition portion configured to acquire a print ratio of the image formed on the recording material, wherein, when the AC current flows through said coil, a magnetic flux is generated in the generatrix direction to cause said electroconductive layer to generate heat, wherein the image formed on the recording material is heated by heat from said rotatable member, and wherein, in a case where the print ratio acquired by said acquisition portion is less than a predetermined value, said controller sets the frequency to a first frequency based on the size of the recording material, and, in a case where the print ratio is greater than the predetermined value, said controller sets the frequency to a second frequency greater than the first frequency.

2. The apparatus according to claim 1, wherein the predetermined value is a first predetermined value, and said controller sets the frequency to a third frequency greater than the second frequency in a case where the print ratio is greater than a second predetermined value, which is larger than the first predetermined value.

3. The apparatus according to claim 1, further comprising a pressing member cooperative with said rotatable member to form a nip therebetween, through which the recording material is fed.

4. The apparatus according to claim 3, wherein when a plurality of recording materials having the same widths are continuously fed through said nip, a gap between adjacent ones of the plurality of recording materials is larger when said controller sets the frequency to the second frequency than when said controller sets the frequency to the first frequency.

5. The apparatus according to claim 1, wherein said rotatable member includes a cylindrical film.

6. The apparatus according to claim 1, wherein the first frequency is set in a range of 20.05 kHz-100 kHz.

7. An image heating apparatus for heating an image formed on a recording material, said image heating apparatus comprising:

a rotatable member including an electroconductive layer;

a coil provided in a hollow portion of said rotatable member, said coil having a spiral portion of which a spiral axis extends along a generatrix direction of said rotatable member;

a magnetic core provided in said spiral portion of said coil, said magnetic core extending in the generatrix direction and having an end portion;

a recording material detecting portion configured to detect a size of the recording material;

a controller configured to control a frequency of an AC current supplied to said coil to change a heat generation distribution of said rotatable member in the generatrix direction based on the size of the recording material; and an acquisition portion configured to acquire a print ratio of the image formed on the recording material, wherein, when the AC current flows through said coil, a magnetic flux is generated in the generatrix direction to cause said electroconductive layer to generate heat, wherein the image formed on the recording material is heated by heat from said rotatable member, and wherein said controller sets the frequency in accordance with the size of the recording material and the print ratio of the image.

8. An image forming apparatus, comprising:

an image forming portion configured to form an image on a recording material based on image data; and an image heating portion, comprising:

a rotatable member including an electroconductive layer;

a coil provided in a hollow portion of said rotatable member, said coil having a spiral portion of which a spiral axis extends along a generatrix direction of said rotatable member;

a magnetic core provided in the spiral portion of said coil, said magnetic core extending in the generatrix direction and having an end portion;

a recording material detecting portion configured to detect a size of the recording material;

a controller configured to control a frequency of an AC current supplied to said coil to change a heat generation distribution of said rotatable member in the generatrix direction based on the size of the recording material; and an acquisition portion configured to acquire a print ratio of the image formed on the recording material, from the image data, wherein, when the AC current flows through said coil, a magnetic flux is generated in the generatrix direction to cause said electroconductive layer to generate heat, wherein the image formed on the recording material is heated by heat from said rotatable member, and wherein, in a case where the print ratio acquired by said acquisition portion is less than a predetermined value, said controller sets the frequency to a first frequency based on the size of the recording material, and, in a case where the print ratio is greater than the predetermined value, said controller sets the frequency to a second frequency greater than the first frequency.

9. The apparatus according to claim 1, wherein said electroconductive layer is made of the same material on an entire area thereof in the generatrix direction.

10. The apparatus according to claim 7, wherein said electroconductive layer is made of the same material on an entire area thereof in the generatrix direction.

11. The apparatus according to claim 8, wherein said electroconductive layer is made of the same material on an entire area thereof in the generatrix direction.

12. The apparatus according to claim 1, wherein a ratio of an amount of heat generation at longitudinal end portions of said electroconductive layer to an amount of heat generation at a center portion of said electroconductive layer decreases when the frequency decreases.

13. The apparatus according to claim 7, wherein a ratio of an amount of heat generation at longitudinal end portions of said electroconductive layer to an amount of heat generation at a center portion of said electroconductive layer decreases when the frequency decreases.

14. The apparatus according to claim 8, wherein a ratio of an amount of heat generation at longitudinal end portions of said electroconductive layer to an amount of heat generation at a center portion of said electroconductive layer decreases when the frequency decreases.

* * * * *